US005477244A

United States Patent [19]

Shibata et al.

[11] Patent Number: 5,477,244

[45] Date of Patent: Dec. 19, 1995

[54] TESTING METHOD AND APPARATUS FOR JUDGING A PRINTING DEVICE ON THE BASIS OF A TEST PATTERN RECORDED ON A RECORDING MEDIUM BY THE PRINTING DEVICE

[75] Inventors: Masaru Shibata, Kawasaki; Fumio Ichikawa, Kamakura; Asao Saito; Akihiro Yamanaka, both of Yokohama, all of Japan

[73] Assignee: Canon Kabushiki Kaisha, Tokyo, Japan

[21] Appl. No.: 222,005

[22] Filed: Apr. 4, 1994

Related U.S. Application Data

[63] Continuation of Ser. No. 882,501, May 13, 1992, abandoned.

[30] Foreign Application Priority Data

| | | | |
|---|---|---|---|
| May 14, 1991 | [JP] | Japan | 3-109225 |
| May 14, 1991 | [JP] | Japan | 3-109234 |
| May 14, 1991 | [JP] | Japan | 3-109235 |
| May 14, 1991 | [JP] | Japan | 3-174268 |

[51] Int. Cl.[6] ..... B41J 2/01

[52] U.S. Cl. ..... 347/19; 29/890.1; 364/552; 382/112

[58] Field of Search ..... 347/19; 400/74; 382/57, 22, 8; 364/552, 551.01; 29/890.1, 407, 705, 593

[56] References Cited

U.S. PATENT DOCUMENTS

| | | | |
|---|---|---|---|
| 4,350,448 | 9/1982 | Hanagata | 400/175 X |
| 4,493,993 | 1/1985 | Kanamuller | 347/19 X |
| 4,699,531 | 10/1987 | Ulinski | 400/74 |
| 4,872,024 | 10/1989 | Nagai | 347/19 X |
| 5,060,281 | 10/1991 | Ohnishi | 382/57 X |

FOREIGN PATENT DOCUMENTS

| | | | |
|---|---|---|---|
| 162350 | 9/1983 | Japan | B42J 3/10 |
| 61-229576 | 10/1986 | Japan | B41J 3/20 |
| 63-027284 | 2/1988 | Japan | B41J 29/00 |
| 64-001576 | 1/1989 | Japan | B41J 29/46 |
| 1130948 | 5/1989 | Japan | B41J 3/04 |
| 01476 | 4/1985 | WIPO | B41J 3/44 |
| WO8804503 | 6/1988 | WIPO | H04N 1/44 |

*Primary Examiner*—Joseph W. Hartary
*Attorney, Agent, or Firm*—Fitzpatrick, Cella, Harper & Scinto

[57] ABSTRACT

A table having a plurality of holding portions for holding recording heads to be tested is arranged to be pivotal between a printing position and a changing position, so that the recording head located at the changing position can be changed during estimation of the recording head located at the printing position. An estimation pattern in which dots are arranged so as not to contact each other is printed on a recording medium. The printed estimation pattern is read by an image pick-up device, and character amounts in units of dots are extracted from image data obtained by the image pick-up device. Pattern estimated values are calculated according to the dot character amounts and are used to judge whether the recording head is normal. Another printed pattern is read by the image pick-up device, and an edge image is extracted from density image data obtained by the image pick-up device. After enlargement/reduction processing is performed for the edge image, an edge image is extracted again. Shape character values in units of areas separated by edge lines of the edge image are obtained, and the pattern and any stain are discriminated based on the shape character values, thereby detecting a stain state. A one-dimensional average density in the line direction of the pattern is obtained from the density image data, and a line width is obtained based on the average density. A stain is detected on the basis of the line width.

96 Claims, 41 Drawing Sheets

| FIG. 14A | FIG. 14B |
|---|---|

FIG. 18

| | PICK-UP IMAGE NUMBER | STAGE POSITION | | IMAGE PROCESSING DEVICE NUMBER | AREA CONNECTION DATA | | PATTERN NUMBER | PRINT DIRECTION |
|---|---|---|---|---|---|---|---|---|
| | | X | Y | | X | Y | | |
| 250(1) ~ | 1 | 1000 | 100 | 2 | 1 | 1 | 1 | 1 |
| 250(2) ~ | 3 | 1100 | 100 | 1 | 2 | 1 | 1 | 1 |
| 250(3) ~ | 2 | 1000 | 180 | 2 | 1 | 2 | 1 | 1 |
| 250(4) ~ | 4 | 1100 | 180 | 1 | 2 | 2 | 1 | 1 |
| 250(5) ~ | 5 | 1300 | 100 | 2 | 3 | 1 | 1 | 2 |
| 250(6) ~ | 7 | 1400 | 100 | 1 | 4 | 1 | 1 | 2 |
| 250(7) ~ | 6 | 1300 | 180 | 2 | 3 | 2 | 1 | 2 |
| 250(8) ~ | 8 | 1400 | 180 | 1 | 4 | 2 | 1 | 2 |
| 250(9) ~ | 9 | 1600 | 100 | 2 | 5 | 1 | 2 | 1 |
| 250(10) ~ | 11 | 1800 | 100 | 1 | 6 | 1 | 2 | 1 |
| 250(11) ~ | 10 | 1600 | 180 | 2 | 5 | 2 | 2 | 2 |
| 250(12) ~ | 12 | 1800 | 180 | 1 | 6 | 2 | 2 | 2 |
| 250(13) ~ | 13 | 2100 | 140 | 2 | 7 | 1 | 3 | 1 |
| 250(14) ~ | 14 | 2400 | 140 | 1 | 8 | 1 | 3 | 2 |
| 250(15) ~ | -1 | | | | | | | |
| | ⋮ | ⋮ | ⋮ | ⋮ | ⋮ | ⋮ | ⋮ | ⋮ |
| | 251 | 252(1) | 252(2) | 253 | 254(1) | 254(2) | 255 | 256 |

250
MEASUREMENT CONDITION DATA

DOT DATA NUMBER OF AREAS MANAGEMENT TABLE

TESTING METHOD AND APPARATUS FOR JUDGING A PRINTING DEVICE ON THE BASIS OF A TEST PATTERN RECORDED ON A RECORDING MEDIUM BY THE PRINTING DEVICE

This application is a continuation of application Ser. No. 07/882,501 filed May 13, 1992, now abandoned.

BACKGROUND OF THE INVENTION

The present invention relates to an apparatus for performing printing estimation of a recording head used in, e.g., a printer.

Conventionally, in order to test a recording head, e.g., an ink-jet recording head, a head to be tested is attached to a jig having a mechanism equivalent to a main body of a printer which performs printing while moving the head, patterns in units of estimation items are printed on paper sheets, and the printed patterns are visually estimated. Therefore, estimation results vary due to personal differences of test persons who are in charge of estimation, and due to non-quantitative estimation.

From this point of view, estimation, which is conventionally performed by visual observation, may be automatically performed using a measurement unit such as a CCD. In this case, the measurement unit must be arranged behind a head. In addition, since the relative speed between a paper sheet and an ink droplet obtained by synthesizing the speed of an ink discharged from a head and the moving speed of the head influences the printing position on a paper sheet, when the influence (displacement) of the speed of a discharged ink is to be tested, a moving mechanism for moving a head to be tested to escape from an area necessary for measurement, or for generating the moving speed of a head obtained when the head to be tested is attached to the main body in a printing operation, is necessary.

In this arrangement, when a printed image is measured by the measurement unit, the recording head must always be escaped from a measurement area. For this reason, the mounting operation of the recording head to the apparatus, and the printing test cannot be simultaneously performed. Thus, the test time is prolonged, and cost is undesirably increased. In addition, a position where the measurement unit can be arranged is limited, and when a plurality of large-scale measurement devices or a plurality of measurement devices are necessary, measurement cannot be performed.

When a test is conducted, a head to be tested, which has a wiring member, must be inevitably moved, and the problems of disconnection of the wiring member, a complicated mechanism, and the like remain unsolved.

Furthermore, since the relative speed between a paper sheet and an ink droplet obtained by synthesizing the speed of an ink discharged from a head and the moving speed of the head influences the printing position on a paper sheet, when the influence (displacement) of the speed of a discharged ink is to be tested, a moving mechanism for moving a head to be tested to escape from an area necessary for measurement, or for generating the moving speed of a head obtained when the head to be tested is attached to the main body in a printing operation, is necessary.

Moreover, since the number of test items is large, and each test item requires a large pattern amount, not only a test but also a drawing operation itself of an estimation pattern requires a long time.

SUMMARY OF THE INVENTION

The present invention has been made in consideration of the above situation, and has as its object to provide an improved printing estimation method and apparatus.

It is another object of the present invention to provide a printing estimation method and apparatus, which can shorten a time required for a test.

It is still another object of the present invention to provide a printing estimation method and apparatus, which can reliably test a recording head with a simple arrangement.

It is still another object of the present invention to provide a printing estimation method and apparatus, which can eliminate a variation in estimation result, and can realize estimation with high precision.

It is still another object of the present invention to provide a printing estimation method and apparatus, which can perform estimation with particularly high precision for a stain.

It is still another object of the present invention to provide a printing estimation apparatus, which can mount the next recording head to be tested during measurement of an estimation pattern printed by a recording head to be tested.

It is still another object of the present invention to provide a printing estimation apparatus, which prints an estimation pattern by moving a support means for supporting a recording medium during printing of the estimation pattern, and carries the recording medium to be moved to the next recording position.

It is still another object of the present invention to provide a printing estimation method and apparatus, which automatically reads a pattern drawn by an output device to be estimated, extracts a character amount in units of dots from the read image data, and estimates the output device to be estimated on the basis of the extracted character amount.

It is still another object of the present invention to provide a printing estimation method and apparatus, which generates an edge image on the basis of density image data obtained by automatically reading an estimation pattern drawn by an output device to be estimated, extracts an edge image again after enlargement/reduction processing of the generated edge image is performed, obtains a shape character value in units of areas separated by the edge line of the extracted edge image, and discriminates a pattern from a stain on the basis of the shape character value, thereby detecting a stain state.

It is still another object of the present invention to provide a printing estimation method and apparatus, which obtains a linear average density in a line direction of a pattern on the basis of density image data obtained by automatically reading an estimation pattern, obtains a line width from the average density, and detects a stain on the basis of the obtained line width.

The above and other objects of the present invention will be apparent from the following description taken in conjunction with the accompanying drawings.

BRIEF DESCRIPTION OF THE DRAWINGS

FIG. 18 is a table showing the content of measurement condition data;

DETAILED DESCRIPTION OF THE PREFERRED EMBODIMENTS

The preferred embodiments of the present invention will be described in detail hereinafter with reference to the accompanying drawings.

(1) Recording Head

FIGS. 1 to 5 show the arrangement of an ink-jet recording head to be tested in this embodiment, which is of a type for discharging an ink from discharge orifices using heat energy.

Figure 1:
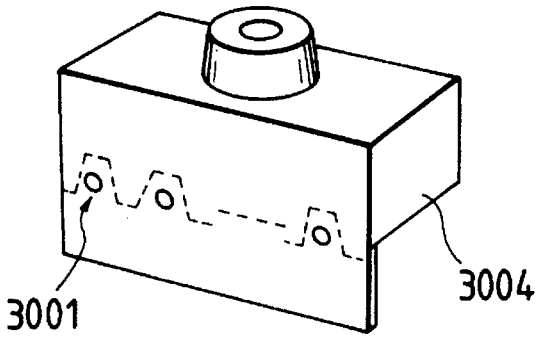
FIG. 1 is a perspective view for explaining a top member of a recording head.
Figure 2:
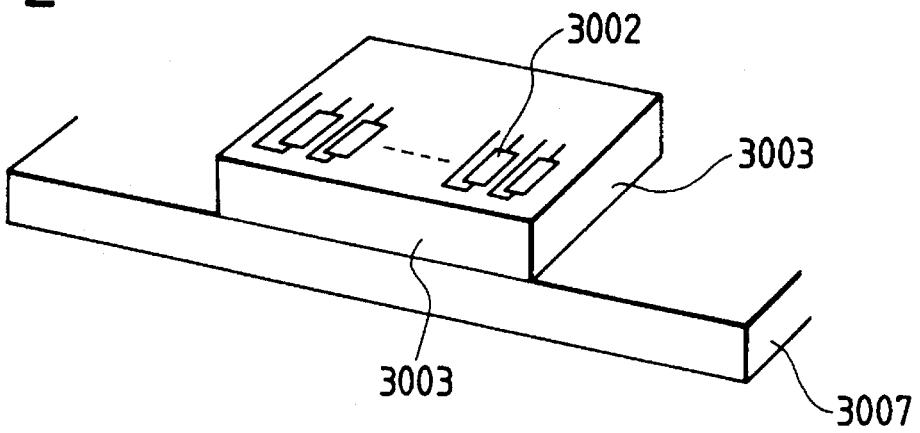
FIG. 2 is a perspective view for explaining a silicon plate of the recording head.
Figure 3:
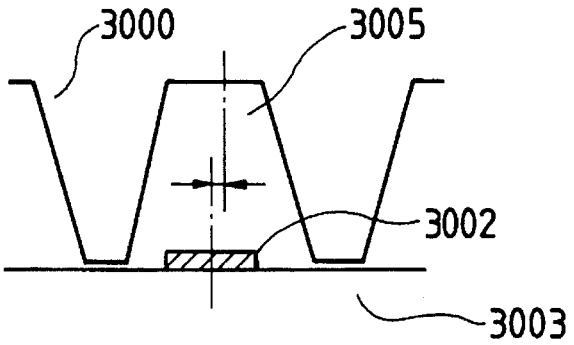
FIG. 3 is a sectional view for explaining the positional relationship between the silicon plate and the top plate of the recording head.
Figure 4:
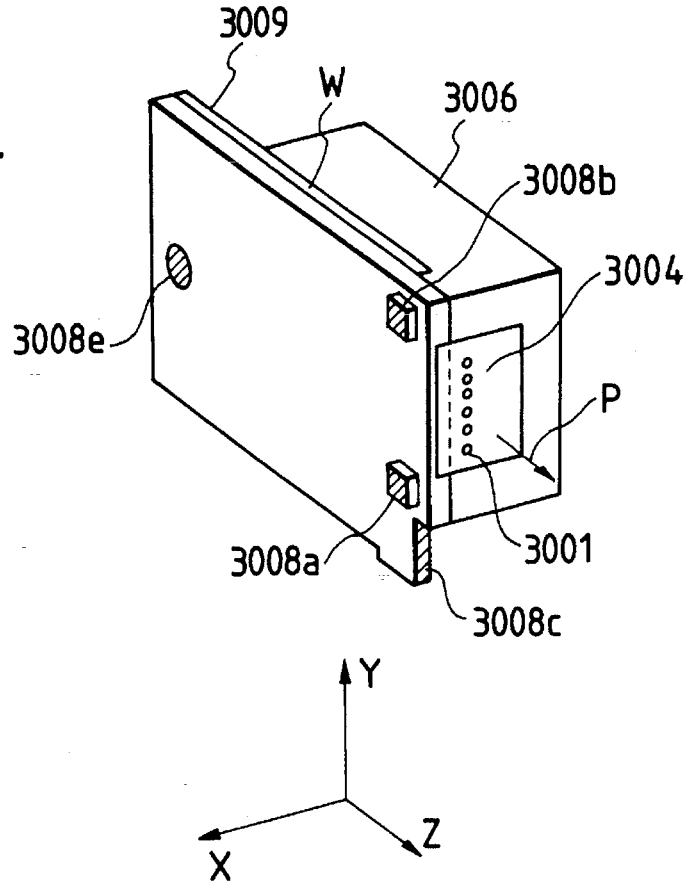
FIG. 4 is a perspective view showing the overall structure of the recording head.

In FIGS. 1 to 5, the recording head comprises a linear array of a plurality of discharge orifices 3001 for discharging an ink, and heaters 3002, arranged in correspondence with the discharge orifices, for generating heat upon energization, and heating the ink to cause film boiling, thereby discharging the ink from the corresponding discharge orifices in a P direction (FIG. 4). The discharge orifices 3001 and the heaters 3002 are formed on a silicon board 3003. The recording head also comprises a top member 3004, in which grooves 3005 and discharge holes are formed in correspondence with the discharge orifices. The silicon board 3003 and the top member 3004 are adhered to each other while aligning the positions of the grooves 3005 and the heaters 3002, thereby forming nozzles. The recording head further comprises an ink tank 3006 for supplying the ink to the nozzles, and an aluminum plate 3007 which fixes the silicon board 3003, and has reference surfaces 3008*a* to 3008*f* for defining the positional precision of the positions of the heaters 3002.

Of the reference surfaces on the aluminum plate 3007, the reference surfaces 3008*d* and 3008*f* are those for the aligning direction (to be referred to as an x-direction hereinafter) of the discharge orifices 3001, the reference surface 3008*c* is one for the discharge direction (P direction) (to be referred to as a y-direction hereinafter) of the ink, and the reference surfaces 3008*a*, 3008*b*, and 3008*e* are those for a direction (to be referred to as a z-direction hereinafter) perpendicular to the plane defined by the x- and y-directions.

A printed circuit board 3009 is fixed to the aluminum plate 3008, and is electrically connected to the silicon board 3003 through bonding wires 3011. The printed circuit board 3009 has pads 3010 on a surface, which contacts a connector for signals from a recording apparatus main body or a printing estimation apparatus main body (to be described later), and comprises a conductor pattern 3012 for electrically connecting between the pads 3010 and pads for the bonding wires 3011.

A test apparatus of the recording head will be described below.

(2) Test Apparatus Main Body

Figure 6:
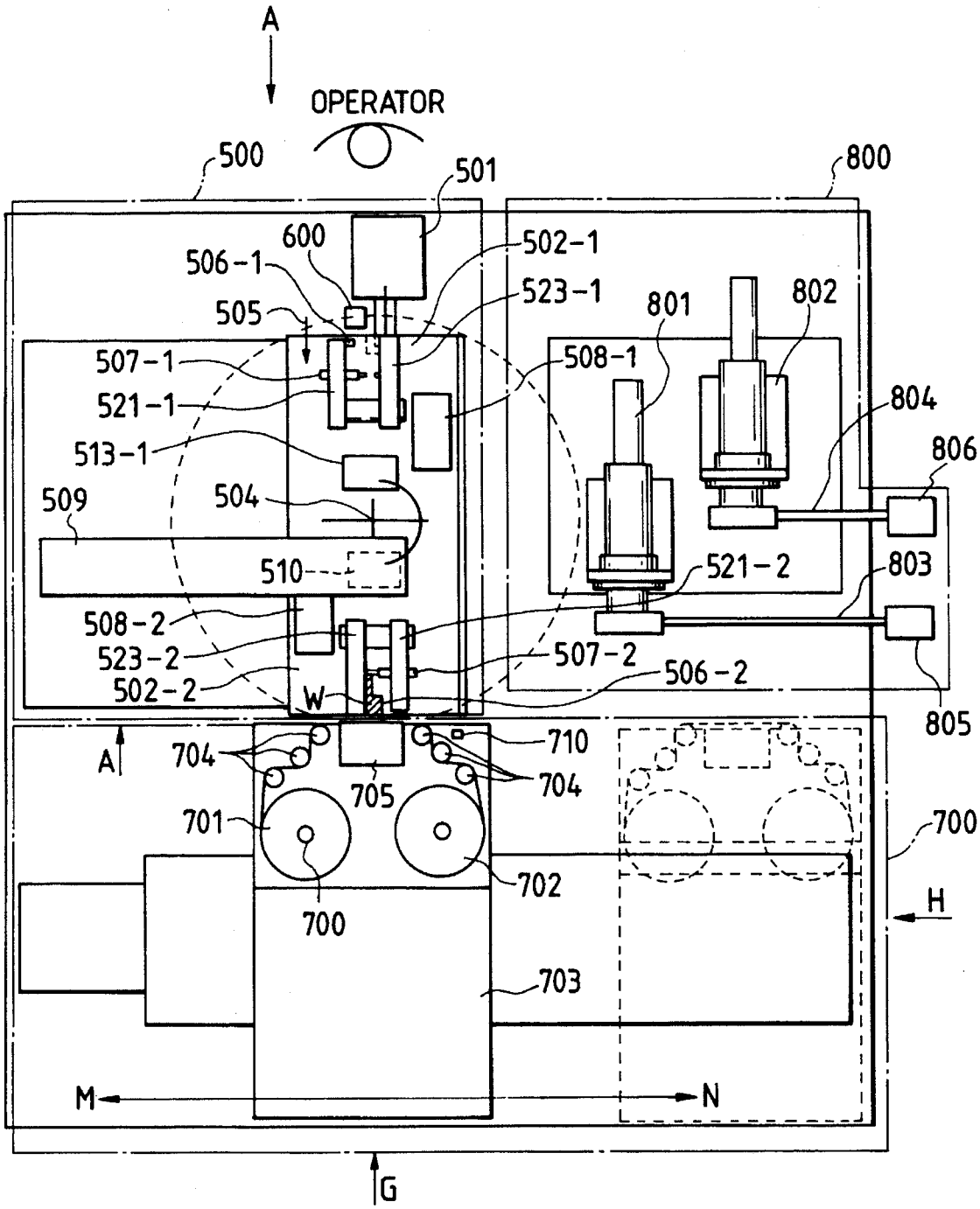
FIG. 6 is a plan view of a printing test apparatus.

FIG. 6 is a plan view showing the overall structure of the test apparatus of this embodiment. The test apparatus comprises a work set mechanism 500 for fixing a recording head (to be referred to as a work hereinafter), a recovery mechanism 600 for performing a recovery operation for the fixed work, a paper carry mechanism 700 having paper on which a predetermined test pattern is printed by the work, and a measurement mechanism 800 for reading the test pattern on the paper in the paper carry mechanism 700. The respective mechanisms will be described in turn.

(a) Work Set Mechanism 500

Figure 7:
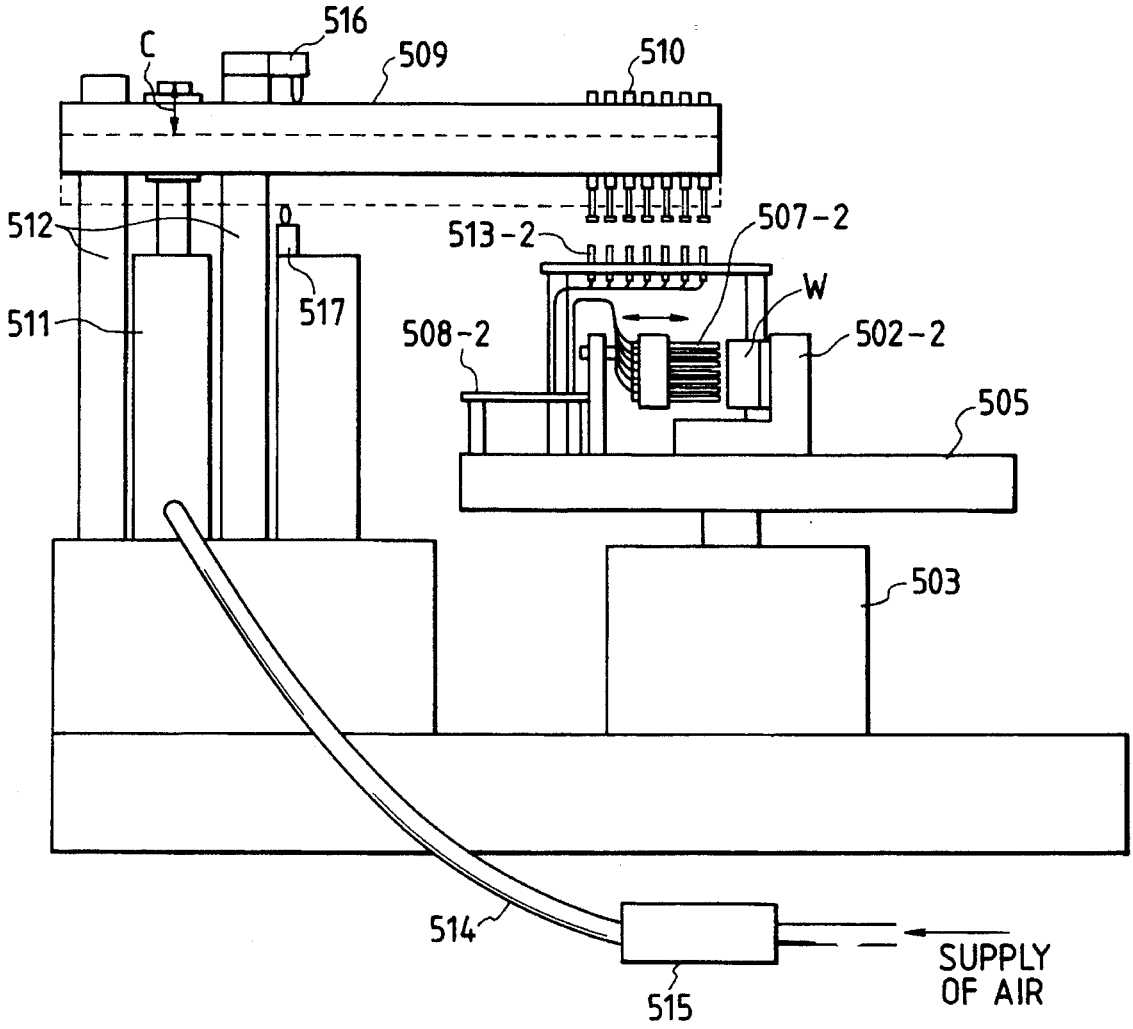
FIG. 7 is a rear view of a work set mechanism.

FIG. 7 is a rear view of the work set mechanism when viewed from a direction of an arrow A in FIG. 6. The work set mechanism will be described below with reference to FIGS. 6 and 7. A work clamp unit 501 clamps a work to be tested, which is manually set by an operator, and will be described in detail later. Work fixing portions 502-1 and 502-2 for fixing set works W are arranged on a rotary table 505, which is rotated about a shaft 504 by a rotary table rotation driver source 503. The work fixing portions 502-1 and 502-2 respectively have work fixing arms 521-1 and 521-2, and work fixing jigs 523-1 and 523-2. The work fixing arms 521-1 and 521-2 respectively have work pressing members 506-1 and 506-2 for fixing the works W, and work connection contact pins 507-1 and 507-2 for electrically connecting the works W and head driver boards 508-1 and 508-2. A contact pin fixing arm 509 comprising rotary table contact pins 510 is vertically moved (in a direction of an arrow C in FIG. 7) along two shafts 512 by a contact pin vertical driving cylinder 511. In a test printing operation, the contact pin fixing arm 509 is lowered to a broken line position in FIG. 7. Thus, the rotary table contact pins 510 are connected to one of two rotary table contact pin receiving pads 513-1 and 513-2 arranged on the rotary table 505, and transmit signals for printing a test pattern to the driver circuit board 508-1 or 508-2. A tube 514 is used for supplying air to the contact pin vertical driving cylinder 511, and the contact pin fixing arm 509 is vertically moved upon air supply. An air supply solenoid 515 is for supplying air to the tube 514.

Figure 8:
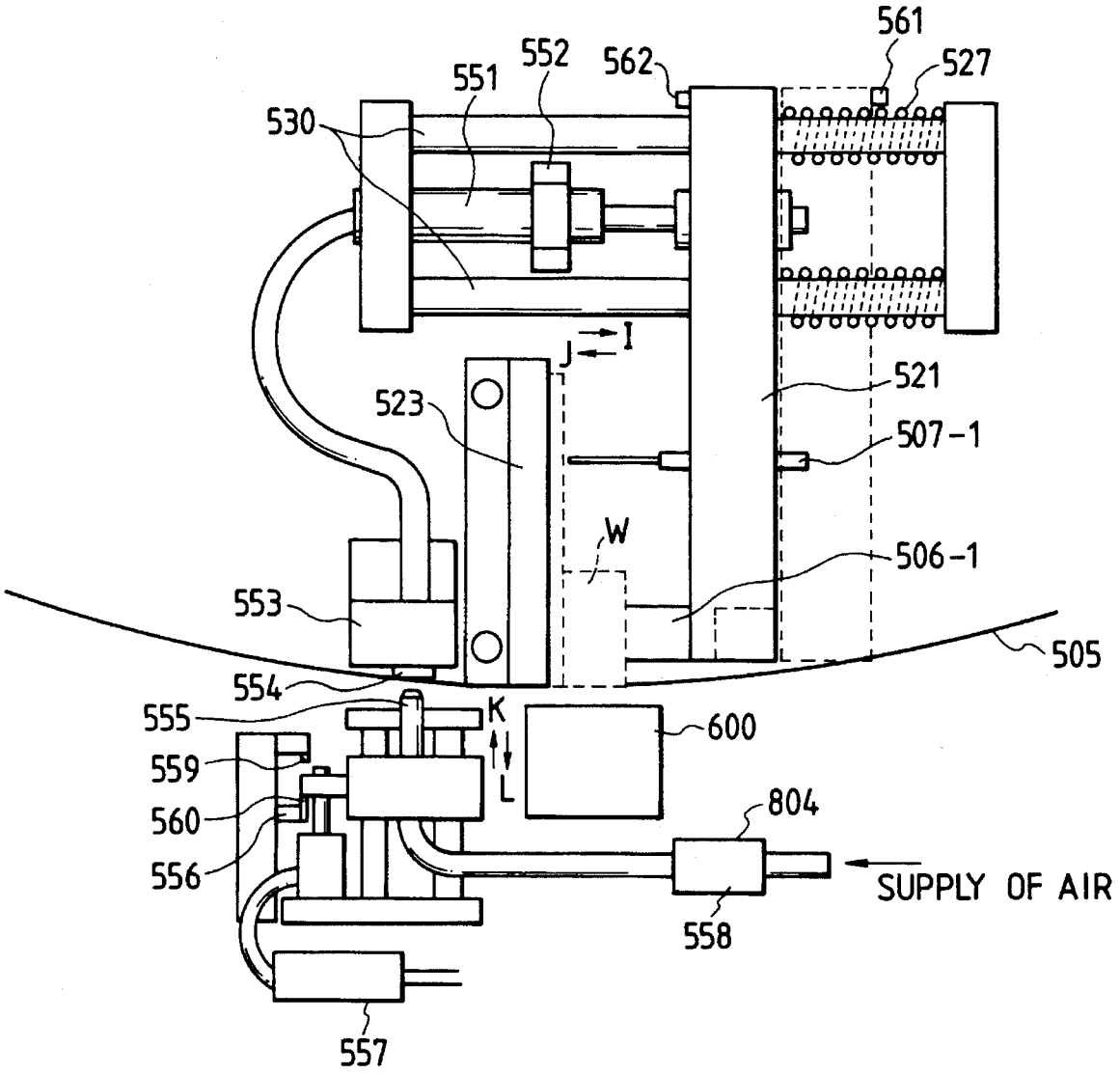
FIG. 8 is a view showing a work lamp unit.

FIG. 8 shows details of the work clamp unit 501 for clamping the work W. A work fixing arm driving cylinder 551 for driving the work fixing arm 521 is fixed to a cylinder fixing member 552. When air is supplied, the work fixing arm 521 is moved in an unclamp direction (a direction of an arrow I) along a work fixing arm driving shaft 530 to release the clamped work W. When air supply is stopped, the work fixing arm 521 is moved by springs 527 in a clamp direction (a direction of an arrow J) along the work fixing arm driving shaft 530, thereby clamping the work W by the work pressing member 506-1 and the work connection contact pins 507-1.

An air reception port fixing jig 553 has an air reception port 554 for the work fixing arm driving cylinder 551. An air supply port 555 can be jointed to the air reception port 554, and is movable in directions of arrows K and L by an air supply port driving cylinder 556. An air supply solenoid 557 is for supplying air to the air supply port driving cylinder 556. An air supply solenoid 558 is for supplying air to the work fixing arm driving cylinder 551 when the air supply port 555 and the air reception port 554 are joined to each other.

The clamped work W is released as follows. That is, when the rotary table 505 stands still, the air supply port 555 is moved in a direction (the direction of the arrow K) toward the rotary table by the air supply port driving cylinder 556 to join the air supply port 555 to the air reception port 554. Air is supplied from the air supply port 555 to the air reception port 554 on the rotary table 505, and the work fixing arm driving cylinder 551 is driven by this air pressure, thereby moving the work fixing arm 521 fixed to the cylinder 551 along the driving shaft 530. In this manner, the clamped work is released. When the rotary table 505 is rotated, the air supply solenoid 557 is driven to stop air supply. Thus, the work fixing arm 521 is moved by the springs 527 in the direction of the arrow J, thus clamping the work. Thereafter, the air supply port 555 is moved in a direction (the direction of the arrow L) to be separated from the rotary table 505 by the air supply port driving cylinder 556, and after the air supply port 555 is separated from the rotary table 505, the rotary table 505 is rotated.

Figure 13A:
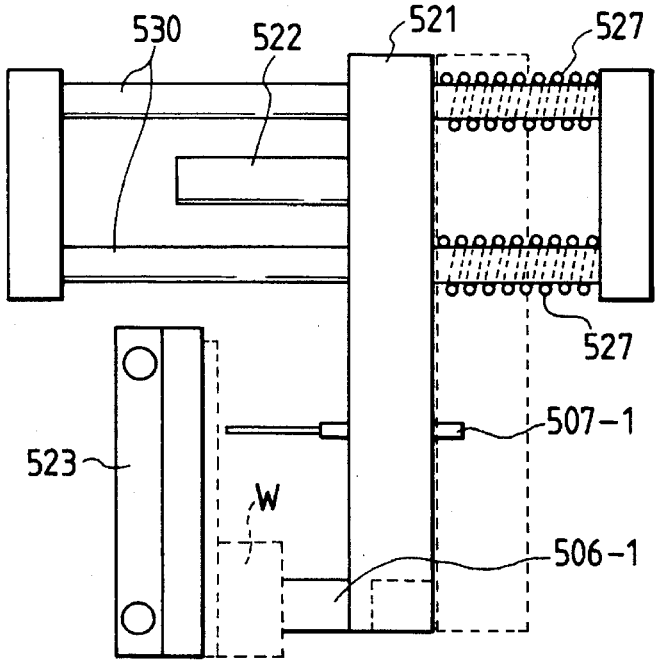
FIGS. 13A to 13C are views showing another embodiment of a work clamp unit.
Figure 13B:
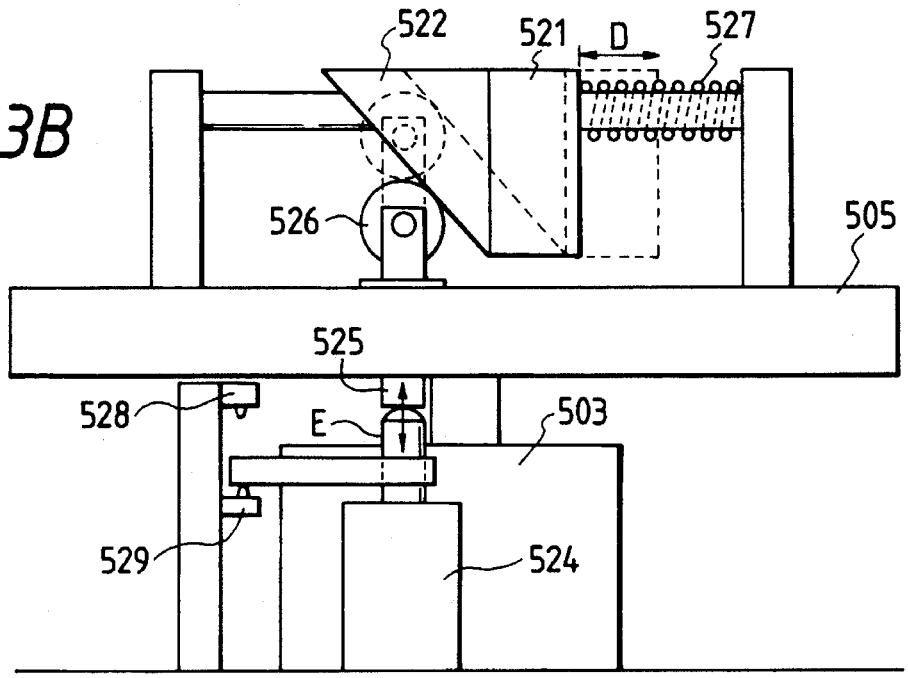
Figure 13C:
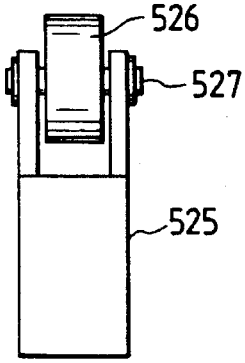

FIGS. 13A to 13C show details of another embodiment of the work clamp unit 501. The same reference numerals in FIGS. 13A to 13C denote the same parts as in FIGS. 6 and 8. A work fixing arm 521 has a work pressing member 506-1, work connection contact pins 507-1, and a driving direction conversion member 522, and is movable in a direction of an arrow D. A work fixing jig 523 is fixed to a rotary table 505. When the work pressing member 506-1 or 506-2 and the work connection contact pins 507-1 or 507-2 provided to the work fixing arm 521 press a work W against the work fixing jig 523, the work W is fixed in position. The driving direction conversion member 522 has an oblique surface with respect to the moving direction of the work fixing arm 521, as shown in FIG. 13B, and is movable in the direction of the arrow D by being pushed by a roller 526 (FIG. 13C) arranged at the distal end of a driving force transmission lever 525, which is vertically moved in a direction of an arrow E by a work fixing/releasing cylinder 524 arranged on a base. Springs 527 press the work fixing arm 521. Sensors 528 and 529 detect the position of the driving force transmission lever.

The clamp operation of the work W, and the release operation of the clamped work W are performed as follows. Normally, in a state wherein no air is supplied to the work fixing/releasing cylinder 524, the cylinder is separated from the driving force transmission lever 525, and the springs 527 work to press the work fixing arm 521 toward the work. Thus, the work pressing member 506 and the work connection contact pins 507 arranged on the work fixing arm 521 press the work W, and the work W is fixed while being clamped between the work fixing jig 523 and the work pressing member 506.

When air is supplied to the work fixing/releasing cylinder 524, the driving force transmission lever 525 arranged on the rotary table 505 is pushed by the cylinder, and the roller 526 arranged on the upper surface of the lever is moved along a work fixing arm driving shaft 530. As a result, the driving direction conversion member 522 having the oblique surface with respect to the driving direction, which contacts the roller 526 generates a force along the driving shaft 530. Thus, the work fixing arm 521 is moved in a direction opposite to the work W along the work fixing arm driving shaft 530, so that the work pressing member 506 and the work connection contact pins 507 are separated from the work W, thus allowing change of the work W. The sensors 528 and 529 are arranged to detect the upper and lower end positions of movement of the driving force transmission lever 525 by the work fixing/releasing cylinder 524, thereby detecting the release position of the clamped work, and the clamp position of the work.

The work W has the six reference surfaces 3008*a* to 3008*f*, as described above. The work fixing jig 523 has reference surfaces for fixing these reference surfaces, and the work W is set so that the reference surfaces are in contact with each other.

(b) Recovery Mechanism 600

Figure 9:
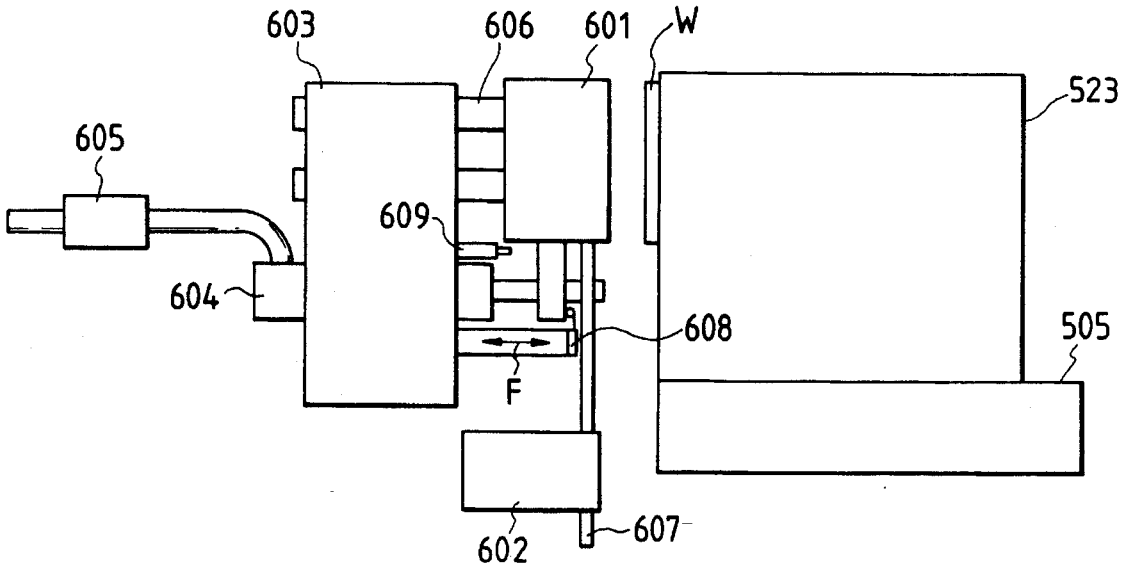
FIG. 9 is a view showing a recovery mechanism.
Figure 10A:
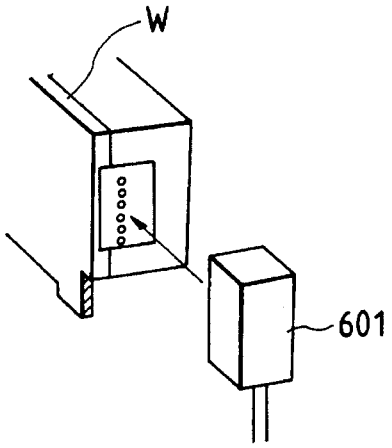
FIGS. 10A to 10C are views for explaining the principle of recovery processing.
Figure 10B:
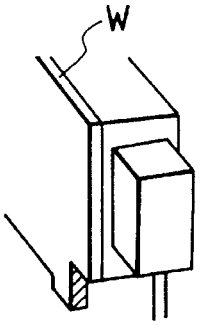
Figure 10C:
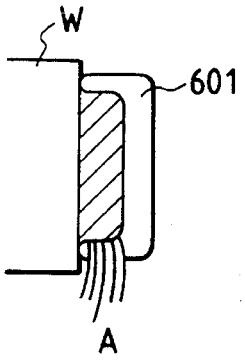

FIG. 9 shows details of the recovery mechanism, and FIGS. 10A to 10C show the principle of the recovery operation. In the test apparatus of this embodiment, a suction recovery operation is performed for the work W after the work is clamped, and before a test printing operation is performed, thereby preventing clogging by, e.g., dust. The recovery mechanism comprises a recovery port 601, which contacts the discharge surface of the work W, a recovery vacuum pump 602 for drawing by vacuum suction an ink in the work W from the discharge orifices, a recovery mechanism fixing jig 603, a recovery port moving cylinder 604 for moving the recovery port 601 forward or backward in a direction of an arrow F along a driving shaft 606, an air supply solenoid 605 for supplying air to the recovery port moving cylinder 604, an ink exhaust port 607 for exhausting the ink drawn by suction by the recovery vacuum pump 602, and sensors 608 and 609 for detecting the position of the recovery port.

The recovery port 601 of the recovery mechanism 600 is a horn-like member having an opening portion larger than the surface, where the discharge orifices are aligned, of the head, and a wall surface having dimensions smaller than the surface, where the discharge orifices are aligned, of the head. A suction hole is formed in a portion of the recovery port 601, and is connected to a tube, which is connected to the recovery vacuum pump 602. When the recovery port 601 is moved forward by the recovery port moving cylinder 604, it is brought into contact with the work, and is closed except for the hole of the tube connected to the recovery vacuum pump 602, as shown in FIG. 10B. When air in a space A surrounded by the recovery port 601 and the work W is evacuated by the recovery vacuum pump 602, a negative pressure is applied to the orifices of the head, and the ink is drawn by suction through the discharge orifices. Thus., the discharge orifices, from which the ink is not easily discharged due to, e.g., dust, can be recovered to a ready-to-print state.

(c) Paper Carry Mechanism 700

Figure 11A:
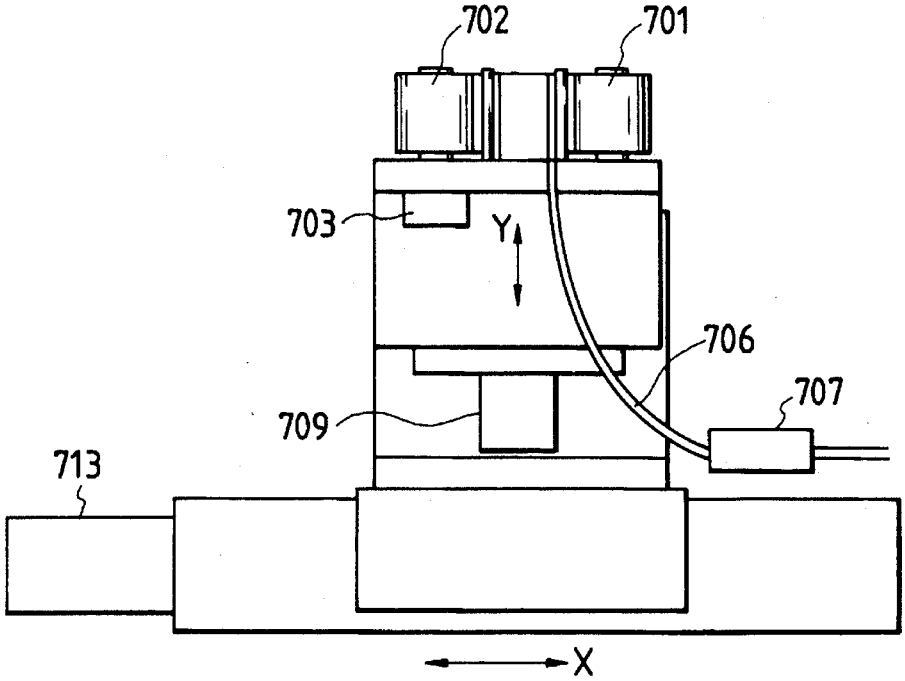
FIGS. 11A and 11B are respectively a rear view and a side view showing a paper carry mechanism.
Figure 11B:
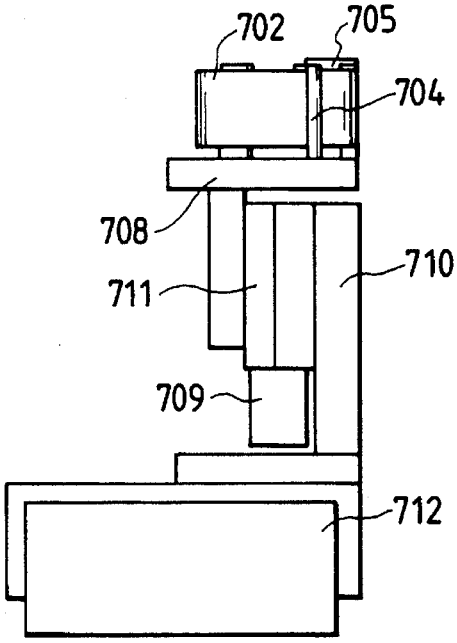

FIG. 11A is a rear view of the paper carry mechanism when viewed from a direction of an arrow G in FIG. 6, and FIG. 11B is a side view of the paper carry mechanism when viewed from a direction of an arrow H in FIG. 6.

Figure 12A:
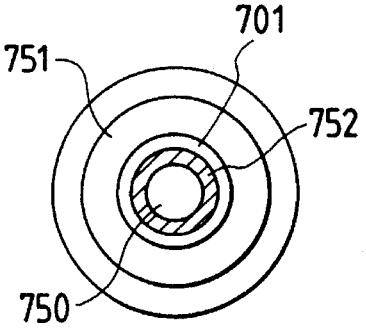
FIGS. 12A to 12D are views showing details of the respective portions of the paper carry mechanism.
Figure 12B:
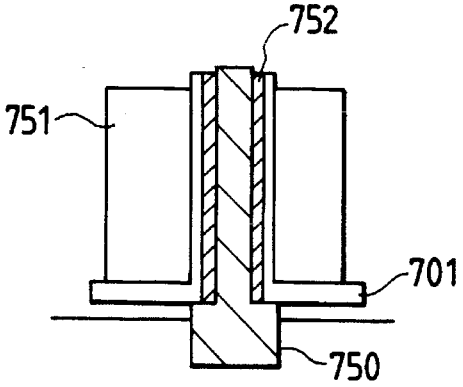
Figure 12C:
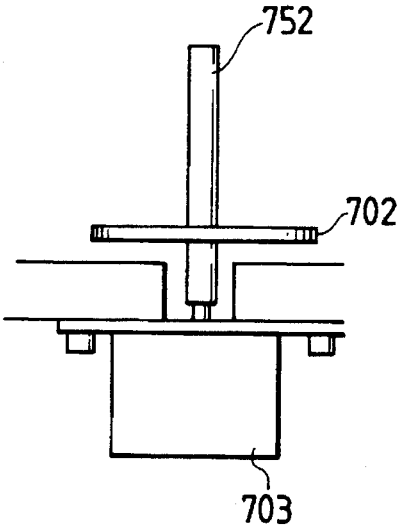

The paper carry mechanism comprises a paper supply reel 701 around which roll paper 751, on which a test pattern is printed, is wound, a paper take-up reel 702 for taking up the paper, a motor 703, whose driving shaft is connected to a reel shaft 752 of the take-up reel 702, as shown in FIG. 12C, for rotating the reel 702 in a direction to take up the roll paper wound around the paper supply reel 701, and a plurality of rollers 704 for feeding the paper. As shown in FIGS. 12A and 12B, a felt 752 for applying a tension to the paper supply reel 701 is arranged between the paper supply reel 701 and a reel shaft 750.

Figure 12D:
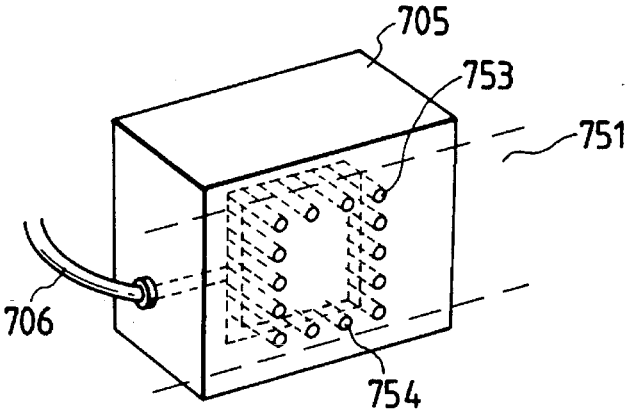

The paper carry mechanism also comprises a paper chucking jig 705 in which a plurality of vacuum holes are formed in its paper sliding surface, and which is shown in detail in FIG. 12D. A plurality of holes 753 are connected to a tube 706 through a communication path 754, and are drawn by suction by an air vacuum solenoid 707 in a test pattern printing operation, thereby chucking the paper.

The above-mentioned members are arranged on a paper feed unit base 708. The paper feed unit base 708 is movable in the y-direction by vertically moving a vertical driving stage 711 with respect to a stage fixing base 710 by driving a paper feed unit driving motor 709.

The above-mentioned members are also movable in the x-direction together with a paper carry stage 712 by driving a paper carry stage driving motor 713.

A weak voltage is applied to the motor 703 in a direction to drive the paper take-up reel 702. Even in this state, the paper supply reel 701 is braked not to be rotated. More specifically, since the soft felt 752 having flexibility is wound around the shaft 750 of the paper supply reel 701, the paper supply reel 701 is weakly braked by a frictional resistance generated among the inner surface of the paper supply reel, the felt, and the paper supply reel shaft. In this state, a tension is applied to the paper, and the paper is drawn by vacuum suction through the holes 753 of the paper chucking jig 705, thereby fixing the paper. Prior to the next test, a high voltage overcoming the braking effect is applied to the motor 703 for a predetermined period of time to rotate the motor 703 in a direction to take up the paper, thereby taking up the paper. After an elapse of the predetermined period of time, the weak voltage is applied to the motor 703 again to stop the motor, and the paper is chucked again. The moving path of the paper is limited since the paper is moved along the plurality of roller shafts.

The paper feed unit base 708 is fixed to the vertical driving stage 711, which is arranged on the stage fixing base 710 fixed to a movable portion of the paper carry stage 712, and is movable in the y-direction, and allows the paper chucking jig 705 to move vertically. This movement is required in a high-magnification measurement mode of a printed test pattern, as will be described later.

(d) Measurement Mechanism 800

In FIG. 6, the measurement mechanism comprises a two-dimensional image pick-up device 801 having a high-magnification optical system, a two-dimensional image pick-up device 802 having a low-magnification optical system, and illumination fibers 803 and 804 and illumination sources 805 and 806, which are respectively arranged in correspondence with the image pick-up devices 801 and 802.

In this embodiment, since tests are conducted for a plurality of items, as will be described later, a test pattern is read using the two-dimensional image pick-up devices 801 and 802 with the optical systems having different magnifications.

For example, in order to measure a landing position of an ink droplet discharged from each nozzle, the position of a dot printed by each nozzle must be measured at a resolution of about 5 μm. At this time, the measurement area is 2.5 $mm^2$ (for a 500×500 pixel pattern), and a measurement system or printed paper must be moved four times, and image processing must be performed four times so as to measure the landing position of an ink droplet from a head having a nozzle length of 10 mm.

When a density nonuniformity in the nozzle r aligning direction is measured by reading different patterns by a single optical system, since the resolution can be as low as about 25 μm, the measurement area is 12.5 $mm^2$ (for a 500×500 pixel pattern). In this test, a head having a nozzle length of 10 mm can be measured in a single measurement operation. Therefore, in order to shorten a measurement time, a plurality of two-dimensional image pick-up devices with optical systems having magnifications necessary for measurements are preferably arranged.

In this embodiment, the image pick-up device 801 has a high-magnification optical system, and is used for testing a shift (displacement) of the landing position of an ink droplet. The image pick-up device 802 has a low-magnification optical system, and is used for testing a density nonuniformity in the nozzle aligning direction.

(3) Control Unit

Figures 14, 14A:
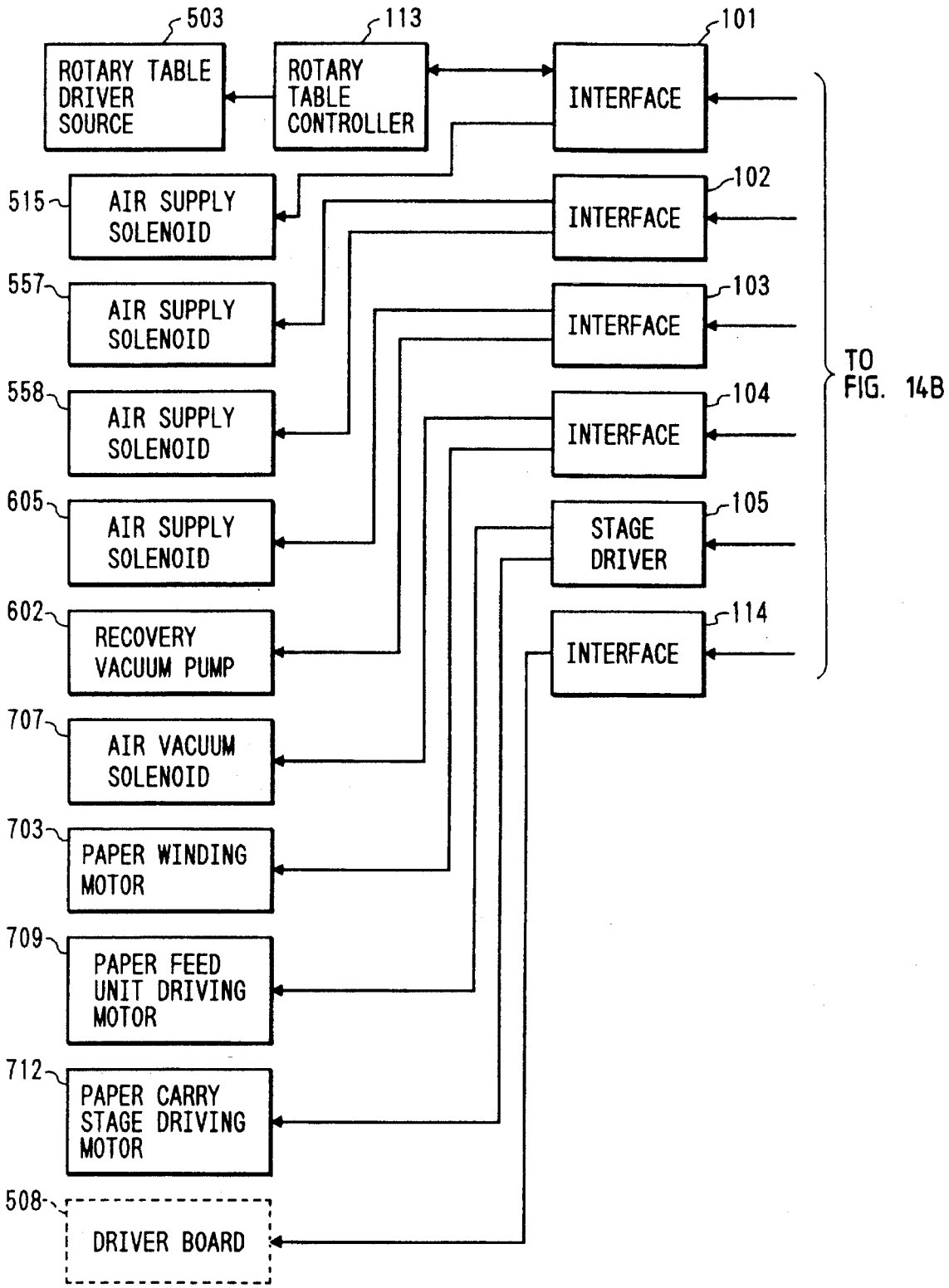
FIG. 14, which is comprised of FIGS. 14A and 14B, is a block diagram showing a control unit of the test apparatus.
Figure 14B:
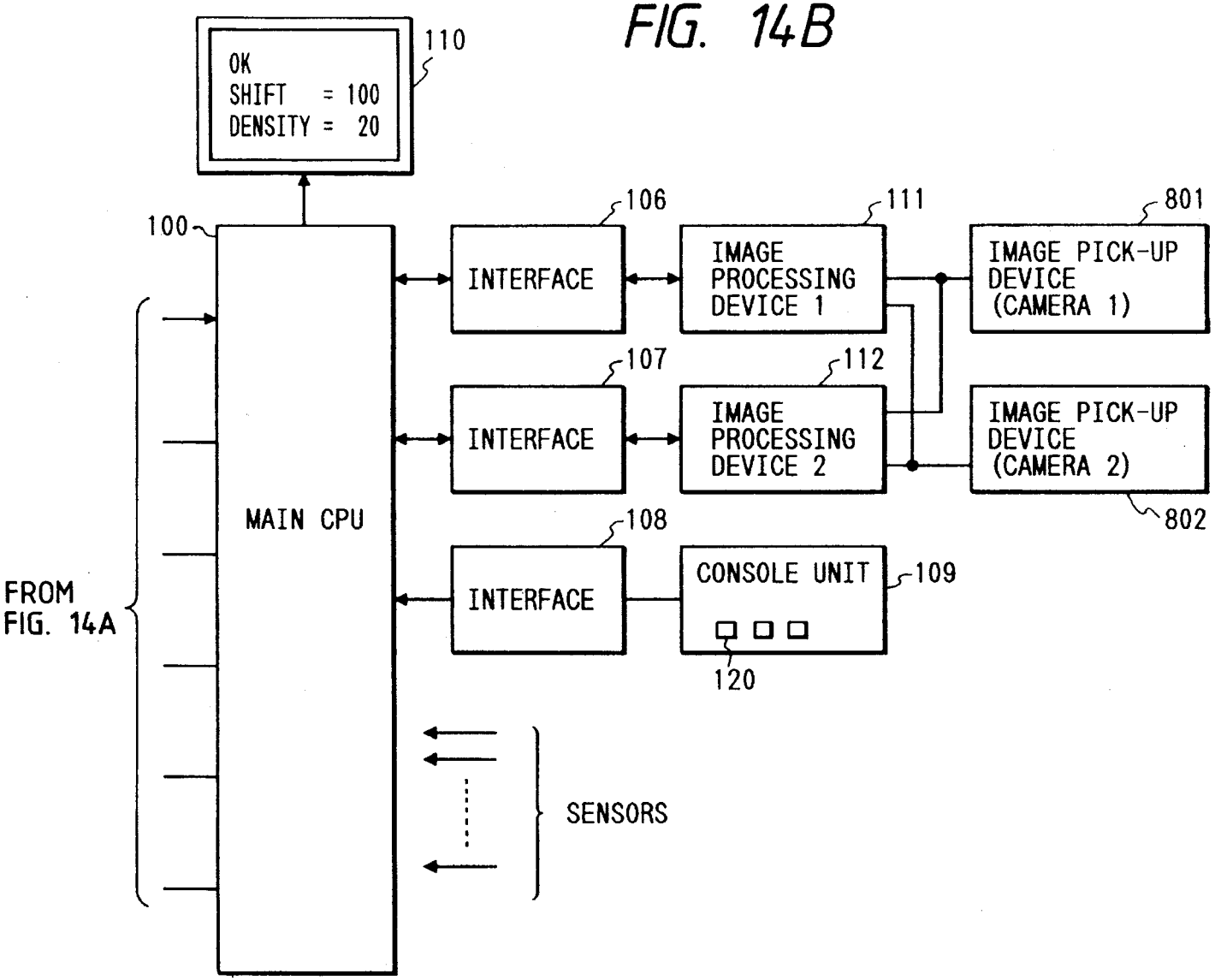

FIG. 14 is a block diagram showing the control unit of the test apparatus of this embodiment. In FIG. 14, a main CPU 100 has a ROM, a RAM, and the like, and controls the respective sections of the test apparatus main body according to a program to be described later. An interface 101 supplies control signals from the main CPU 100 to a rotary table controller 113 for controlling the rotation of the rotary table 505, and to the air supply solenoid 515 for supplying air to the contact pin vertical driving cylinder 511. An interface 102 supplies control signals from the main CPU 100 to the air supply solenoids 557 and 558 in the work clamp unit. An interface 103 supplies control signals from the main CPU 100 to the air supply solenoid 605 and the recovery vacuum pump 602 in the recovery mechanism 600. An interface 104 supplies control signals from the main CPU 100 to the paper take-up motor 703 and the air vacuum solenoid 707 for chucking paper in the paper carry mechanism 700. A stage driver 105 supplies driving signals from the main CPU 100 to the paper feed unit driving motor 709 and the paper carry stage driving motor 713 in the paper carry mechanism 700.

Image processing devices 111 and 112 perform predetermined processing for tests of image signals output from the image pick-up devices 801 and 802, and their details will be described later. The outputs from the image processing devices 111 and 112 are input to the main CPU 100 through interfaces 106 and 107.

A console unit 109 comprises various keys such as a start key 120, and a key input signal is input to the main CPU 100 through an interface 108. A CRT 110 displays, e.g., test results.

The main CPU 100 also receives output signals from various sensors arranged in the work set mechanism 500, the recovery mechanism 600, and the paper carry mechanism 700, and controls the operations of the respective sections on the basis of these sensor output signals.

(4) Description of Operation

The operation of the test apparatus will be described below with reference to FIGS. 15A to 15F.

Figure 15A:
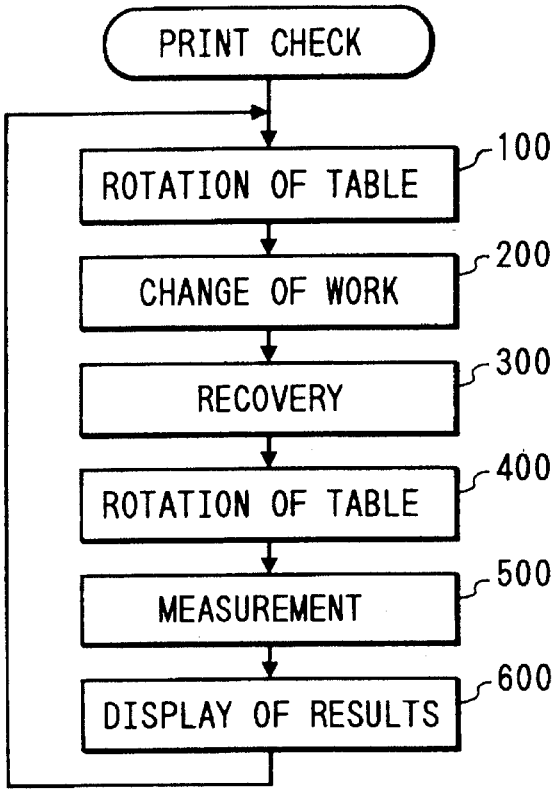
FIGS. 15A to 15F are flow charts for explaining the operations of the test apparatus.

FIG. 15A is a flow chart showing the flow of the basic operation of the test apparatus of this embodiment. First, the rotary table 505 is rotated (step 100). The control waits until an operator changes a work W on the work fixing portion (502-1 in FIG. 6) (step 200), and after the work is changed, the recovery processing is performed for the work W by the recovery mechanism 600 (step 300). After the recovery processing, the rotary table 505 is rotated again to set the work W at the printing position facing the roll paper (step 400). The work W is caused to print a predetermined test pattern, and the roll paper on which the test pattern is printed is moved to the measurement position by the paper carry mechanism 700. The test pattern is measured by the image pick-up devices 801 and 802, and predetermined processing for tests is then executed by the image processing devices 111 and 112 (step 500). The measurement result is displayed on the CRT 110 (step 600).

The basic operation flow has been described. In this embodiment, since the two work fixing portions are provided on the rotary table, measurement and result display processing for a work fixed on one work fixing portion are performed, while work change processing and recovery processing can be performed for the other work fixing portion. The operation flow of this embodiment is as shown in FIG. 15B.

Figure 15B:
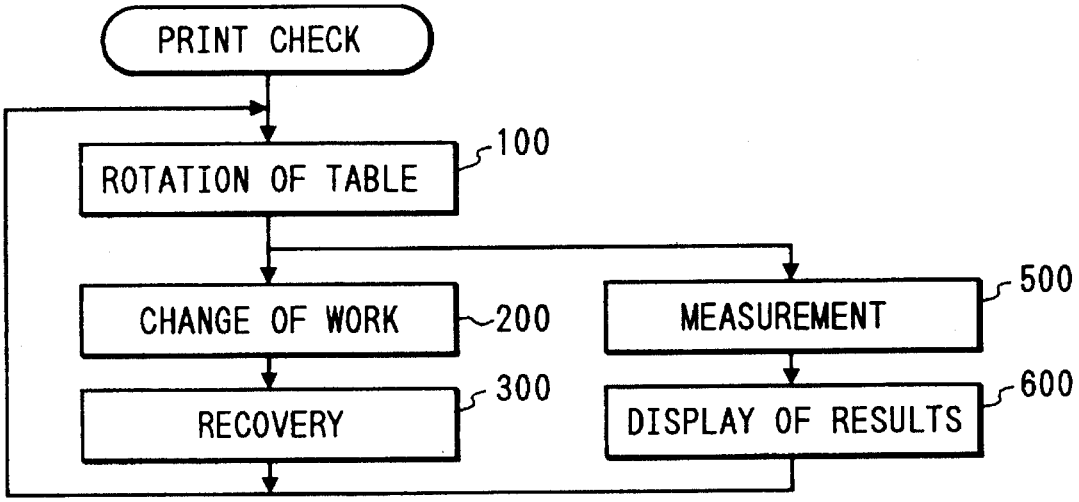

FIGS. 15C to 15F are flow charts showing operations in the respective steps of FIGS. 15A and 15B.

The operations will be described below with reference to FIGS. 15C to 15F. In this case, the operations using the work clamp unit shown in FIG. 8 will be described below.

(a) Work Change Processing

In order to release the clamped work on the work fixing portion (502-1 in FIG. 6) farther from the paper carry mechanism 700 of the two work fixing portions 502-1 and 502-2 on the rotary table 505, the main CPU 100 enables the air supply solenoid 557 through the interface 102 to move the air supply port 555 forward (in the direction of the arrow K) by the air supply port driving cylinder 556 so as to couple it to the air reception port 554 (step 201 in FIG. 1E). When a sensor 559 detects that the air supply port 555 is moved forward and is coupled to the air reception port 554 (step 202), the air supply solenoid 558 is enabled to supply air to the work fixing arm driving cylinder 551 so as to move the work fixing arm 521 in the unclamp direction (direction of the arrow I) until a sensor 561 is turned on, thereby separating the work pressing member 506 and the work connection contact pins 507 from the tested work W (steps 203 and 204). Then, a message for requesting to change the work is displayed on the CRT 110 (step 205).

The control waits until an operator confirms this message, picks up the tested work, inserts a non-tested work in a gap between the work fixing arm 521 and the work fixing jig 523, and turns on the start switch 120 on the console unit 109 (steps 206 and 207).

Figure 5:
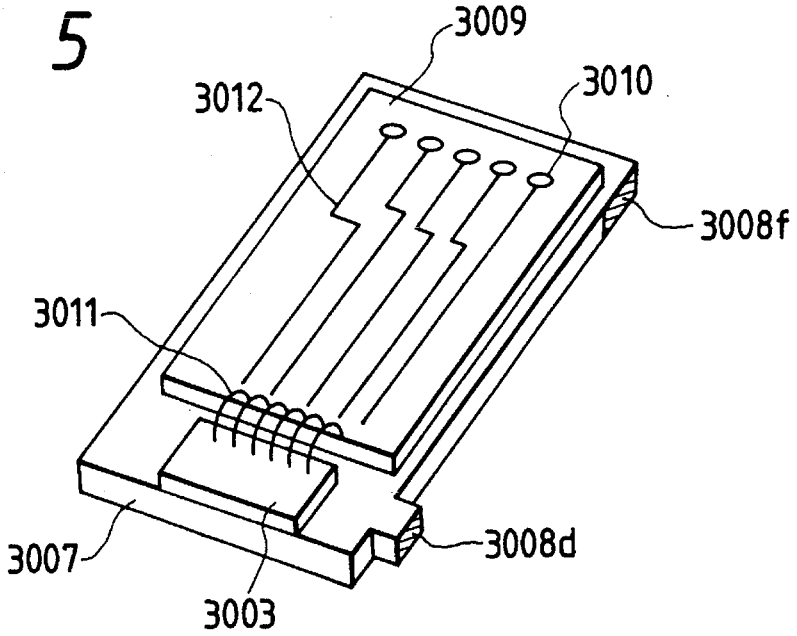
FIG. 5 is a perspective view showing an arrangement of a printed circuit board.

When the main CPU 100 detects that the start switch 120 is ON, it disables the air supply solenoid 558. Thus, the work fixing arm 521 is moved in the clamp direction (direction of the arrow J) by the springs 527 to clamp and fix the work between the work pressing member 506 and the work fixing jig 523. At the same time, the work connection contact pins 507 are connected to the pads 3010 (FIG. 5). When a sensor 562 detects that the work is clamped (step 209), the air supply solenoid 557 is disabled to move the air supply port 555 backward (in the direction of the arrow L) until a sensor 560 is turned on, so that the air supply port 555 is separated from the air reception port 554, and the next operation is started (steps 210 and 211).

The work connection contact pins 507 are connected to the rotary table contact pin reception pads 513 through the driver board 508 and a cable. When the contact pin fixing arm 509 is lowered by the contact pin vertical driving cylinder 511, the rotary table contact pins 510 attached to the end face of the contact pin fixing arm 509 are brought into contact with the reception pads 513.

Therefore, the main CPU 100 supplies a control signal to the driver board 508 through an interface 114, thereby printing an arbitrary pattern using the work.

When the contact pin vertical driving cylinder 511 is raised, the rotary table contact pins 510 attached to the end face of the contact pin fixing arm 509 are separated from the reception pads 513, thus allowing rotation of the rotary table 505.

(b) Recovery Processing

Figure 15C:
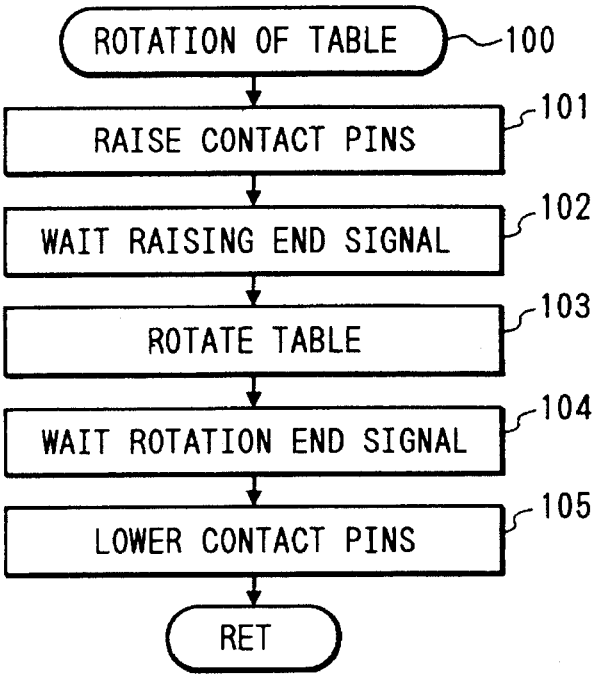
Figure 15D:
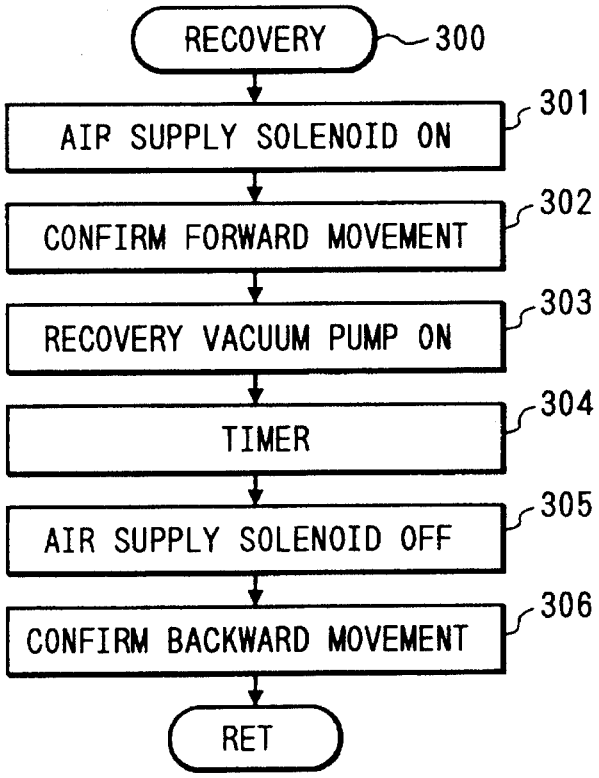
Figure 15E:
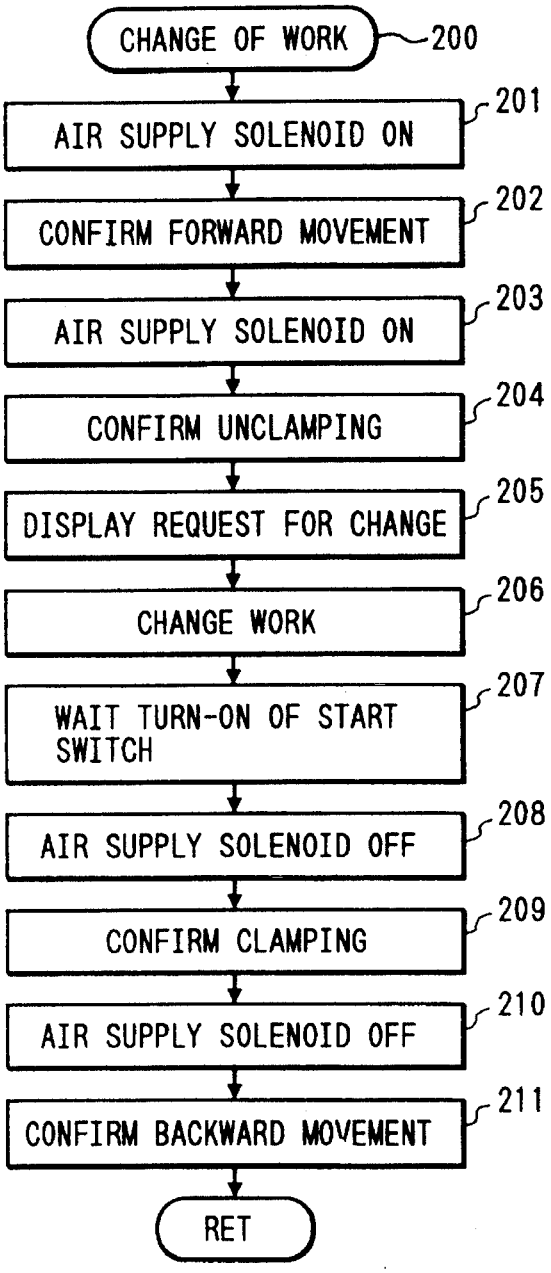

After the work W is clamped, the recovery processing is started, as described in FIG. 15D. The main CPU 100 enables the air supply solenoid 605 through the interface 103 to move the recovery port 601 forward by the recovery port moving cylinder 604 so as to bring it into contact with the discharge surface of the work W (step 301). When the sensor 608 detects that the recovery port 601 is moved to a position where it contacts the discharge surface of the work W, the main CPU 100 drives the recovery vacuum pump 602 via the interface 103 so as to evacuate air in the space A (FIG. 10) surrounded by the recovery port 601 and the work W for a predetermined period of time (steps 303 and 304). Thus, a recovery operation is performed to draw out any ink in the work W by suction. The ink drawn out from the work is exhausted from the ink exhaust port 607 through the recovery port 601, the tube, and the recovery vacuum pump 602.

The air supply solenoid 605 is disabled, and the recovery port 601 is moved backward until the sensor 609 is turned on.

(c) Rotation Processing of Rotary Table

The main CPU 100 enables the air supply solenoid 515 through the interface 101 to drive the contact pin vertical driving cylinder 511, thereby raising the contact pin fixing arm 509 until a sensor 516 is turned on (steps 101 and 102 in FIG. 15C). Thus, the rotary table contact pins 510 arranged on the end face of the contact pin fixing arm 509 are separated from the rotary table contact pin reception pads 513.

Thereafter, the main CPU 100 outputs a control signal for rotating the rotary table to the rotary table controller 113 through the interface 101. Thus, the rotary table controller 113 enables the rotary table driving source 503 to rotate the rotary table 505.

Upon reception of a rotation end signal from the rotary table controller 113 through the interface 101, the main CPU 100 disables the air supply solenoid 515 to lower the contact pin fixing arm 509 by the contact pin vertical driving cylinder 511 until a sensor 517 is turned on under a condition that measurement end signals for the previous work are output from the image processing devices 111 and 112 through the interfaces 106 and 107 (steps 104 and 105). In this manner, the rotary table contact pins 510 are connected to the rotary table contact pin reception pads 513.

(d) Measurement Processing

Figure 15F:
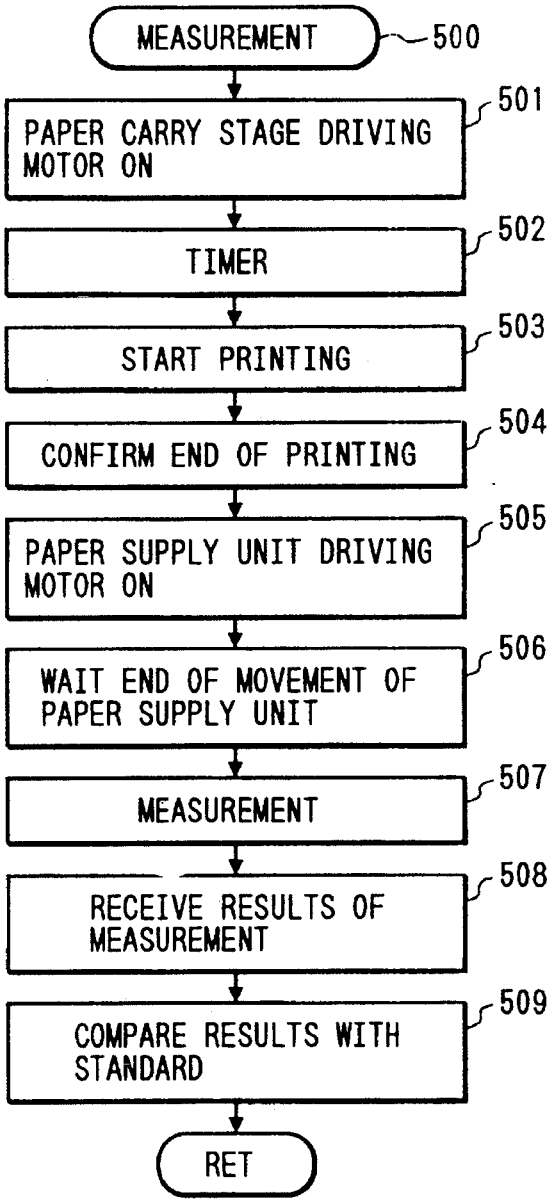

After the rotation processing of the rotary table, the main CPU 100 drives the paper carry stage driving motor 713 for a predetermined period of time through the stage driver 105 so as to move the paper carry stage 712 in a direction of an arrow M (FIG. 6), thereby setting the printing position of the work W at a position separated from the paper chucking jig 705 in the direction of the arrow M (FIG. 6) by a predetermined distance (50 mm in this embodiment) (steps 501 and 502 in FIG. 15F).

Data stored in the RAM in the main CPU 100 is output to the stage driver 105 to drive the paper carry stage driving motor 713, and the paper carry stage 712 is moved to the position of the image pick-up device 801 having a high-magnification optical system at a speed of 300 m/sec. During this interval, when the main CPU 100 detects a signal from a sensor 710, which is turned on when the paper chucking jig 705 reaches the printing position, it sends a printing signal to the driver board 508, and a pattern is printed according to the content of a ROM in the driver board 508 (steps 503 and 504). After the printing operation, the paper feed unit driving motor 709 is enabled through the stage driver 105 to move the paper feed unit 708 in the y-direction for a predetermined period of time (steps 505 and 506). Upon completion of the movement, the main CPU 100 supplies control signals for starting measurement to the image processing devices 111 and 112 through the interfaces 106 and 107. Upon reception of these signals, the image processing devices 111 and 112 conduct a plurality of tests (to be described later), and supply test end signals and test results to the main CPU 100 through the interfaces 106 and 107. The main CPU 100 displays the test results on the CRT 110, thus informing the results to the operator (steps 507 to 509).

Upon reception of a signal indicating that the paper carry stage 712 is stopped at the measurement position of the image pick-up device 801, the main CPU 100 rotates the rotary table 505.

In the above embodiment, the work W is manually changed by an operator, but may be automatically changed using an auto or robotic hand. In this case, the main CPU 100 is connected to the auto hand through an interface and a cable. When a work is to be changed, the main CPU 100 supplies a change start signal to an auto hand controller to start a work change operation, and when the change operation is ended, the auto hand controller supplies a change end signal to the main CPU 100.

In the above embodiment, in a printing operation, the paper carry stage is moved to print a test pattern. Alternatively, the paper may be fixed in position, and the work may be moved to print a test pattern.

Similarly, when the test pattern is read, the image pick-up device may be moved.

In this embodiment, an ink-jet recording head for discharging an ink using heat energy has been exemplified as a recording head to be tested. However, the present invention is not limited to this, but may be applied to a head for discharging an ink using pressure energy from, e.g., an electro-mechanical converter such as a piezoelectric element. In addition, the present invention may be applied to a thermal recording head using thermal paper or an ink sheet.

(5) Test Content

The content of the processing executed by the image processing devices 1 (111) and 2 (112) will be described in detail below.

(a) Arrangement of Image Processing Devices 1 and 2

Figure 16:
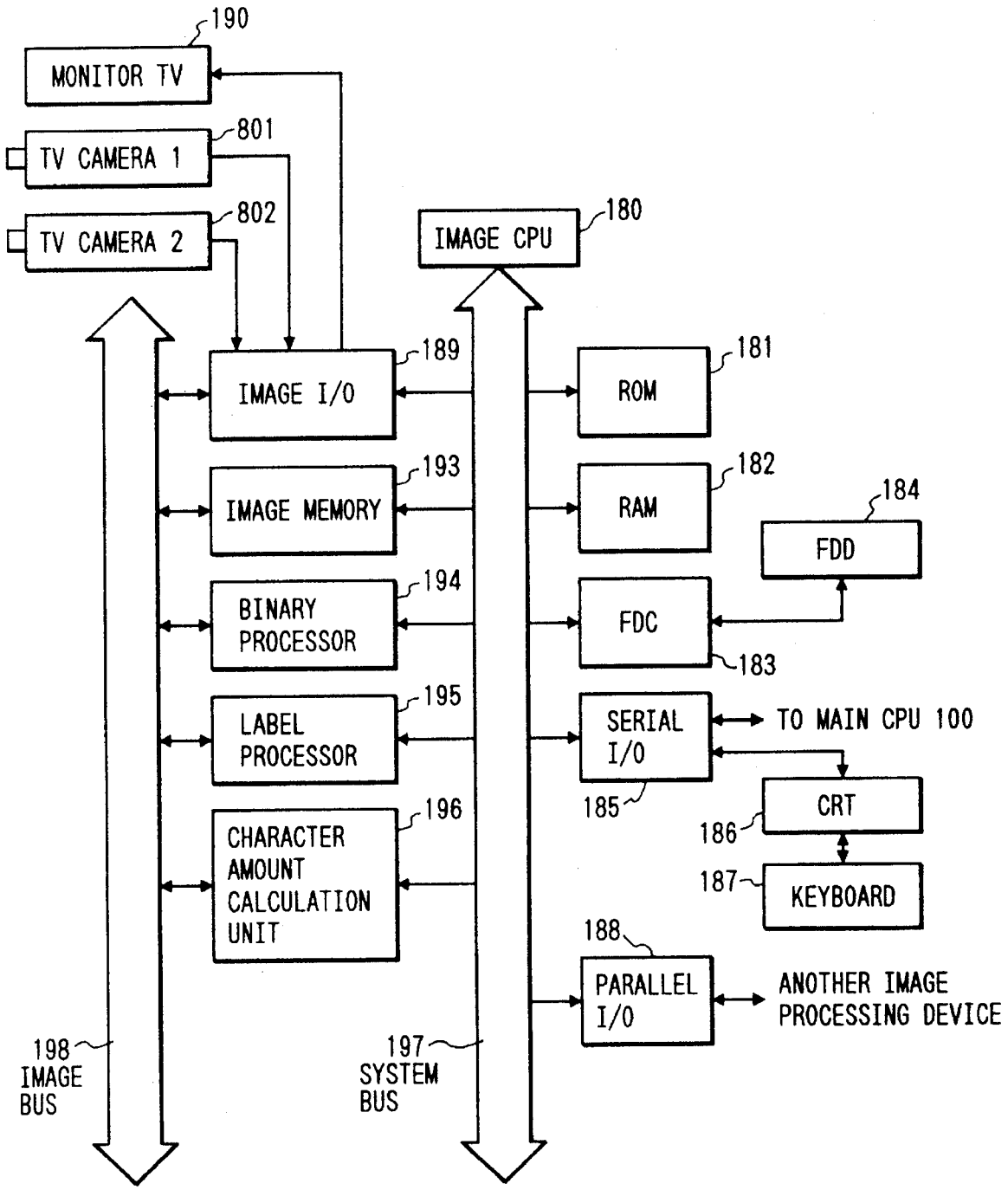
FIG. 16 is a block diagram showing details of an image processing device.

FIG. 16 is a block diagram of the image processing device 1 (111) and the image processing device 2 (112).

In FIG. 16, the image processing device comprises a ROM 181, which stores a start program of the device, a RAM 182 which temporarily stores an execution program, and is used by the execution program, an FDD (floppy disk drive) 184 as an external storage device for recording the execution program and parameters, an FDC (floppy disk controller) 183 for controlling the FDD 184, a serial I/O 185, comprising, e.g., an RS-232C, for performing communications with the main CPU 100, and communications with I/O devices such as the CRT 110, the console unit 109, and the like, a parallel I/O 188, comprising, e.g., a GPIB, for performing communications of a large amount of data between the image processing devices 1 (111) and 2 (112), an image I/O 189 for converting image signals from the image pick-up device 801 (to be referred to as a TV camera 1 hereinafter) and the image pick-up device 802 (to be referred to as a TV camera 2 hereinafter) into digital image signals, and outputting the digital image signals to a monitor TV 190, an image memory 193 for storing the digital image signals, a binary processor 194 for converting a density image signal into a binary image signal, a label processor 195 for numbering continuous areas to identify the areas, and a character amount calculation unit 196 for calculating character amounts of areas in an image. These units are controlled by an image CPU 180 through a system bus 197. Image data is transferred at high speed through an image bus 198 among the image I/O 189, the image memory 193, the binary processor 194, the label processor 195, and the character amount calculation unit 196.

(b) Relationship between Pattern and Pick-up Image Areas

Figure 17:
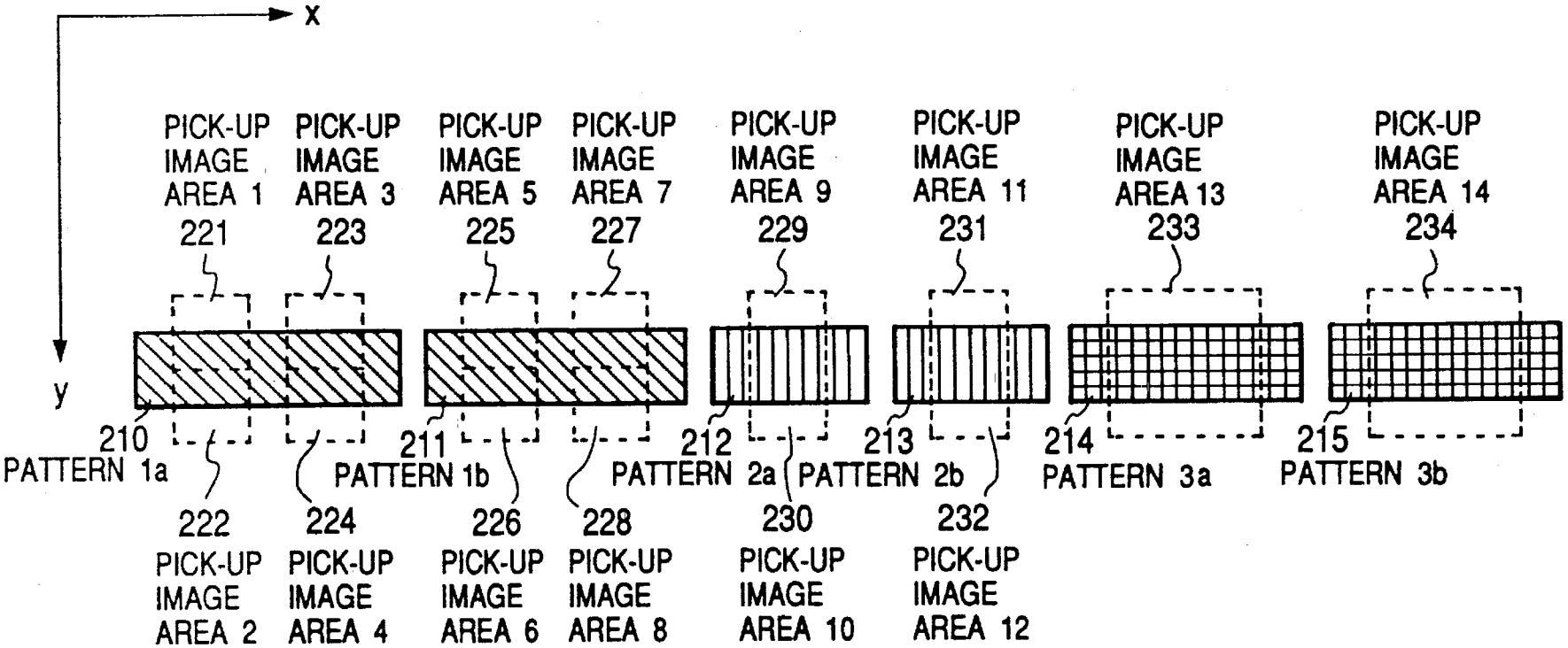
FIG. 17 is a view for explaining the relationship between a printed pattern and a pick-up image area.

FIG. 17 shows the relationship between a pattern to be tested as a test pattern printed on the roll paper by the work W, and pick-up image areas to be picked up by the TV cameras 1 and 2.

Patterns 1*a* (210) and 1*b* (211), patterns 2*a* (212) and 2*b* (213), and patterns 3*a* (214) and 3*b* (215) are respectively the same patterns, and have different relative moving directions between the head (work W) and the roll paper when the patterns are formed. More specifically, the patterns 1*a* (210), 2*a* (212), and 3*a* (214) are obtained by forward printing, and the patterns 1*b* (211), 2*b* (213), and 3*b* (215) are obtained by backward printing.

Of these patterns, the pattern 1 is measured twice each in the forward and backward movements of the paper carry stage 712 for measurements by the TV cameras 1 and 2, the pattern 2 is measured once each in the forward and backward movements of the paper carry stage 712, and the pattern 3 is measured once each in the forward and backward movements of the paper carry stage 712. The patterns 1 and 2 are picked up twice in the z-direction by the TV camera 1 having a high-magnification optical system so-as to perform high-luminance measurements, and the pattern 3 is picked up once by the TV camera 2 having a low-magnification optical system so as to grasp the overall pattern. Therefore, the number of pick-up image areas is a total of 14.

FIG. 18 is a table showing the content of measurement condition data 250 stored in the RAM in the main CPU 100.

The main CPU 100 supplies instructions to the paper carry stage 712 and the image processing devices 1 (111) and 2 (112) by referring to the measurement condition data 250, thereby performing the measurement processing.

The measurement condition data 250 stores, in the order of measurement processing operations in units of pick-up image areas, a pick-up image area number 251 for identifying pick-up image areas, moving positions (stage positions) 252(1) and 252(2) of the paper carry stage 712 for setting a pattern to be measured within the view fields of the TV cameras 1 and 2, an image processing device number 253 for designating an image processing device for receiving and processing an image signal of a pattern to be measured, area connection data 254(1) and 254(2) for identifying that pick-up image areas 1 (221) and 2 (222) are connected to each other, a pattern number 255 for identifying patterns, and performing processing according to the identified patterns, and a print direction 256 (1: forward printing, 2: backward printing). After the final pick-up image area, (pick-up image area number)=−1 is stored as data indicating the end of the measurement condition data.

(c) Measurement Processing

Figures 19, 19A:
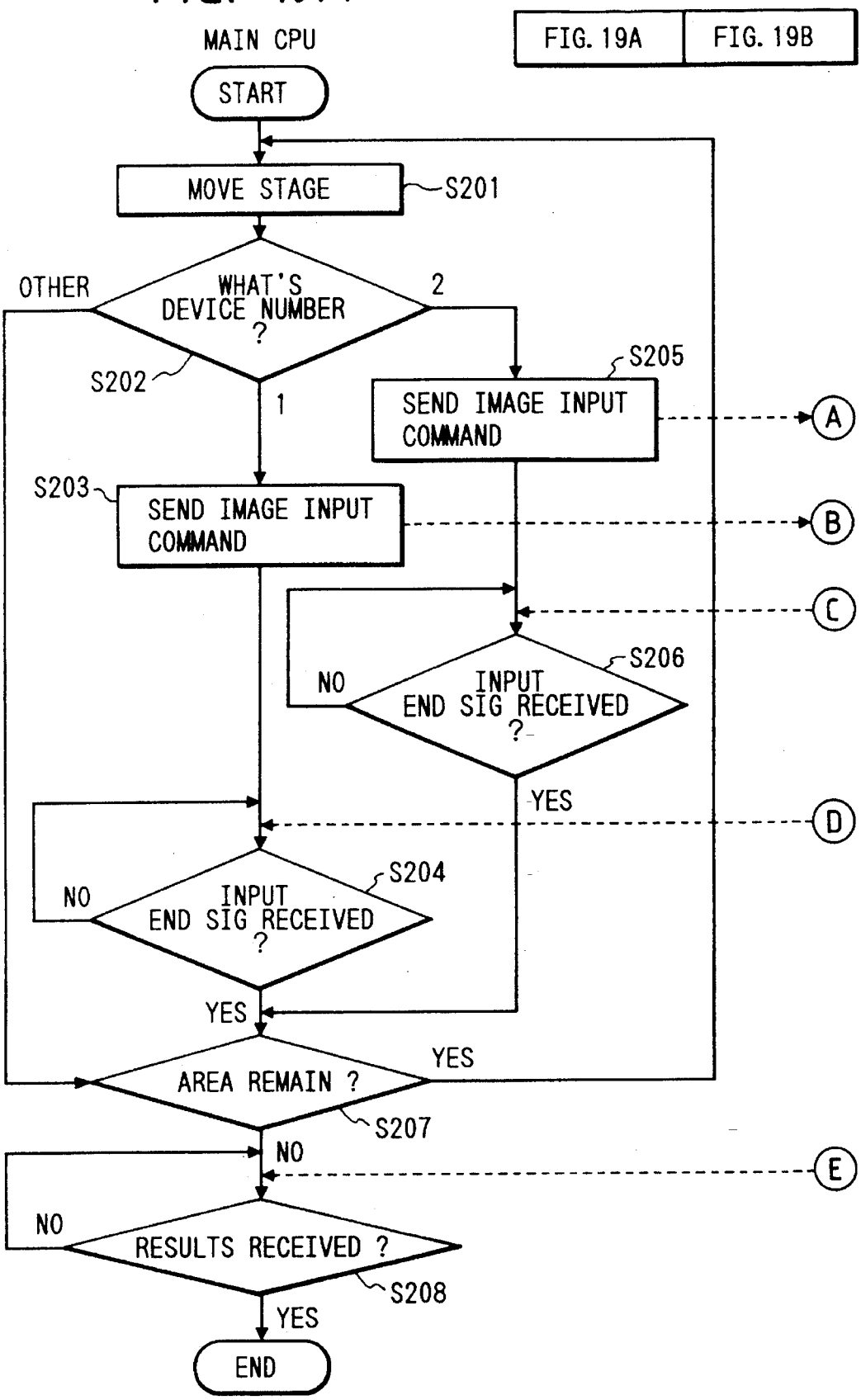
FIG. 19, which is comprised of FIGS. 19A and 19B, is a flow chart showing measurement processing.
Figure 19B:
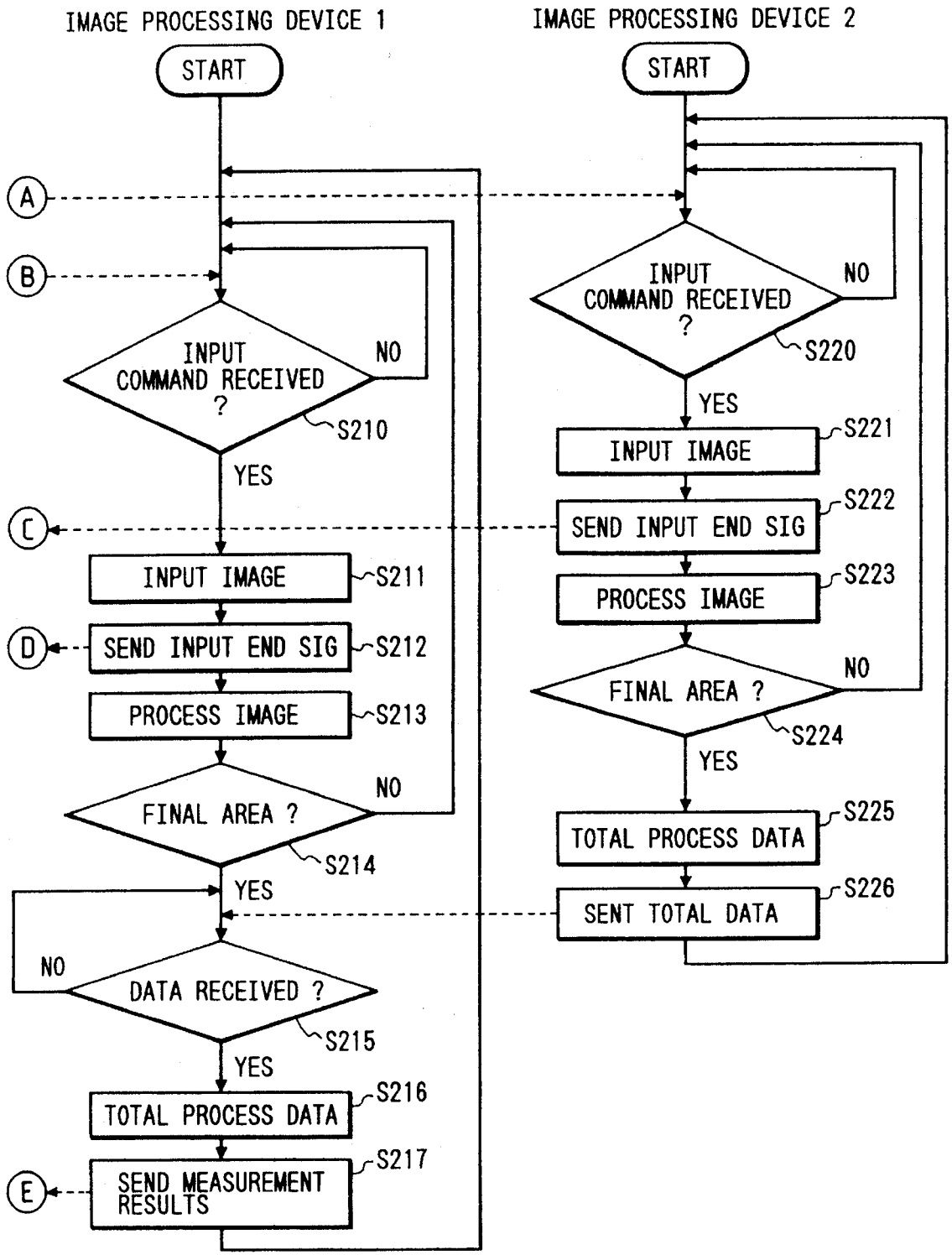

FIG. 19 is a flow chart showing the measurement processing. A case will be exemplified below wherein the measurement processing is performed according to the content of the measurement condition data 250.

The main CPU 100 refers to data 250(1) associated with the first pick-up image area in the measurement condition data 250 to obtain position data X=1,000 and Y=100 of the paper carry stage 712, issues a moving command to the paper carry stage driving motor 713 on the basis of these data, and waits for completion of the movement (step S201). The main CPU 100 then refers to the image processing device number in the measurement condition data 250(1), and starts processing (S203 or S205) corresponding to the image processing device number (S202). At this time, when data indicating a non-existing image processing device is stored (when data other than 1 or 2 is stored in this embodiment), this means that no measurement is performed at this position, and the main CPU advances the control to the remaining area confirmation step (S207: to be described later).

In this embodiment, since the image processing device number is "2", the main CPU sends an image input command to the image processing device 2 (112) to cause it to input a pattern image (S205). At this time, the main CPU sends the measurement condition data 250(1) and final area information indicating whether or not the current area is the final measurement area of each image processing device together with the image input command. Whether or not the current area is the final measurement area of each image processing device can be confirmed by referring to the image processing device number 253 after the current area in the measurement condition data 250.

Upon reception of the image input command, the measurement condition data 250, and the final area information (S220), the image processing device 2 (112) inputs an image signal on the basis of the measurement condition data 250 (S221).

Note that the operation based on the measurement condition means that the camera input of the image processing device 2 (112) is switched to select an optical system corresponding to a pattern to be measured (in this embodiment, since pattern number=1, the high-magnification optical system is selected). In this case, combinations of the pattern numbers and the optical systems are set in advance in the image processing devices 1 and 2.

Upon completion of the input operation of the image signal, the image processing device 2 (112) sends an image signal input end signal to the main CPU 100 (S222). Upon reception of the image signal input end signal from the image processing device 2 (112) (S206), the main CPU 100 advances the control to the remaining measurement area confirmation step (S207).

In the remaining measurement area confirmation step (S207), the main CPU refers to the pick-up image area number of the next measurement condition data 250(2) to confirm if the number is the end data. If the number is not the end data, this means that non-measurement areas still remain. Therefore, the main CPU returns the control to step S201 of moving the stage, and refers to the next measurement condition data 250(2). When the main CPU executes the stage moving processing (S201), and refers to the image processing device number 253 in the measurement condition data 250(2), since the image processing device number is "1" this time, the main CPU sends the image signal input command, the measurement condition data, and the final area information to the image processing device 1 (111). The main CPU confirms reception of the image signal input end signal from the image processing device 1 (111) (S204), and then executes the remaining measurement area confirmation step (S207). Upon reception of the image signal input command from the main CPU 100 (S210), the image processing device 1 (111) inputs an image signal in the same manner as in the image input step (S221) of the image processing device 2 (112) (S211), and sends the image signal input end signal to the main CPU 100 (S212). When the image processing device 1 or 2 sends the image signal input end signal to the main CPU 100, it performs image processing corresponding to each pattern (to be described later) (S213 or S223), and confirms based on the final area information whether or not the current area is the final area (S214 or S224). If the current area is not the final area (in the case of the pick-up image area number=1 to 12 in the measurement condition data 250), the flow returns to the image signal input reception step (S210 or S220); otherwise (in the case of the pick-up image area number=13 or 14 in the measurement condition data 250), measurement data total processing (S215 to S217 or S225 to S226) is performed.

The image processing devices 1 (111) and 2 (112) perform different total processing operations. The image processing device 2 (112) totals image processing results calculated in the image processing step (S223) in units of measurement items (S225), and sends the total data to the image processing device 1 (111) after the device 1 is ready to receive the data. After the total data is sent, the image processing device 2 performs a preparation for the next measurement, e.g., initialization of the memory, and returns the control to the image signal input reception step (S220) (S226). On the other hand, the image processing device 1 (111) receives the total data from the image processing device 2 (112) (S215), then totals data calculated therein, and combines the total data with that from the image processing device 2 (112), thereby calculating the final measurement result (S216).

When the image processing device 1 calculates the measurement result, it immediately sends the measurement result to the main CPU 100, and performs a preparation for the next measurement, e.g., initialization of the memory. Thereafter, the device 1 returns the control to the image signal input reception step (S210) (S217).

When the main CPU 100 determines in the remaining area confirmation step that there is no remaining area, it waits for reception of the measurement result. When the image processing device 1 (111) calculates the measurement result, the main CPU immediately receives the measurement result (S208), ends the measurement processing, and then starts the next processing, e.g., comparison processing with a standard value.

(d) Image Processing

The image processing executed in the image processing devices 1 (111) and 2 (112) will be described in detail below.

Figure 20:
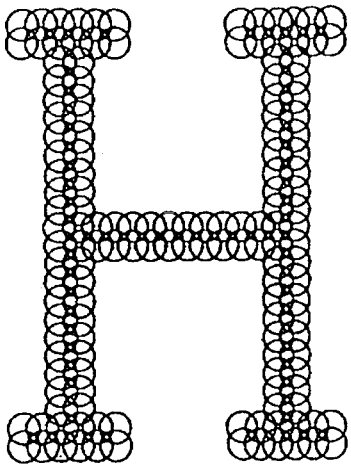
FIG. 20 is a view showing an ideal dot pattern.
Figure 21:
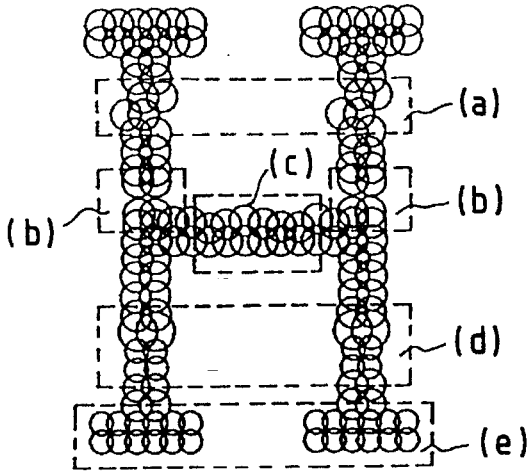
FIG. 21 is a view showing a defective dot pattern.

FIGS. 20 and 21 are views for explaining a defect item, which can be detected by first image processing.

In the first image processing, evenness (position and shape) of dots is measured. A pattern shown in FIG. 20 is an ideal pattern, and FIG. 21 shows a pattern including uneven dots. In FIG. 21, in a portion (a), dot positions are shifted horizontally, and a straight line pattern is not printed as a straight line. In a portion (b), dots are shifted vertically, and a continuous straight line is disconnected. In a portion (c), dot positions vertically vary, and a straight line becomes an irregular line. In a portion (d), the dot sizes are uneven, and the line width varies. In a portion (e), the dot sizes are small, and the line width of a straight line is decreased although the line is straight.

In this manner, when dots become uneven, they form an irregular printed pattern.

Figure 22:
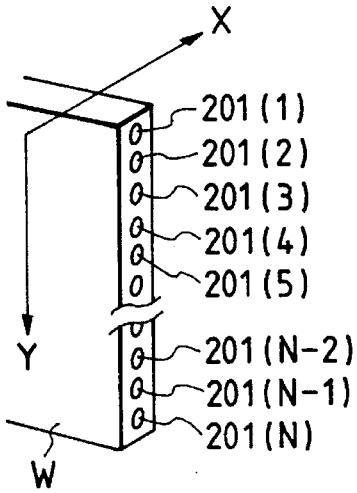
FIG. 22 is a perspective view showing the distal end portion of the recording head.
Figure 23:
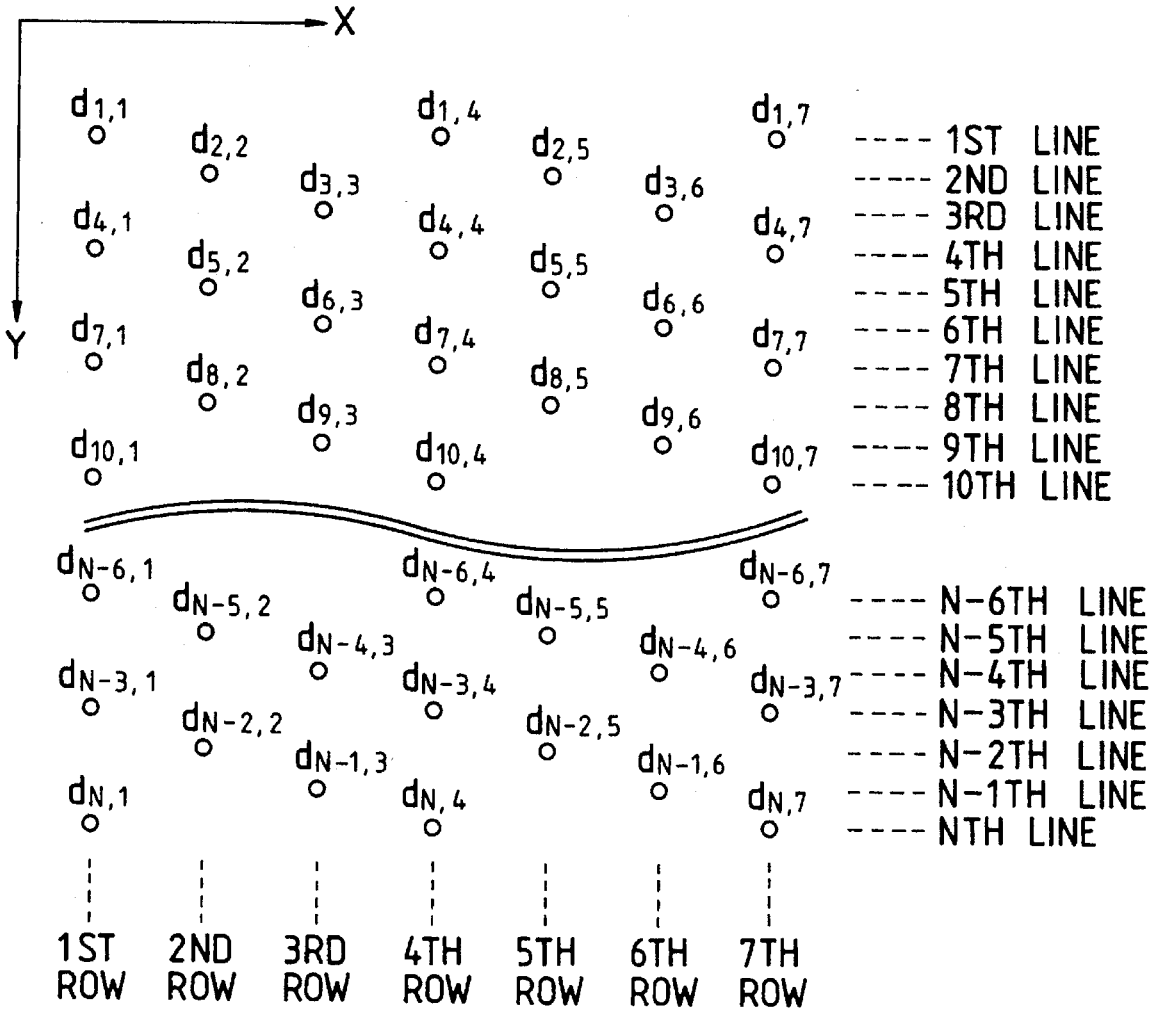
FIG. 23 is a view showing a printed pattern in which dots are separated from each other.

FIGS. 22 and 23 are views for explaining a printed pattern used in the first image processing.

FIG. 22 is a view showing the distal end portion of the recording head (work W). A plurality of holes (nozzles) 201 for discharging an ink are aligned in the y-direction at the distal end portion of the recording head, and a printed pattern is formed on the roll paper by moving the paper carry stage 712 relative to the recording head in the x-direction.

FIG. 23 shows a printed pattern as an object to be tested, which is printed on the roll paper by the recording head. Note that a dot $d_{i,j}$ is output from the nozzle 201($i$). In FIG. 23, if the y-direction (nozzle aligning direction) is assumed as a row, and the x-direction (head moving direction) is assumed as a line, dots $d_{p,j}$ belonging to the p-th line are formed by the same nozzle 201($p$), and dots belonging to the q-th row are formed by a plurality of nozzles at substantially the same time during the relative movement of the recording head.

A dot interval is set, so that adjacent dots do not contact each other. In this embodiment, in each row, every third nozzles are simultaneously subjected to printing, and the row interval is also almost equal to the two-nozzle interval.

When this pattern is used, since dots are isolated, the position and shape of each dot can be measured.

Figure 24:
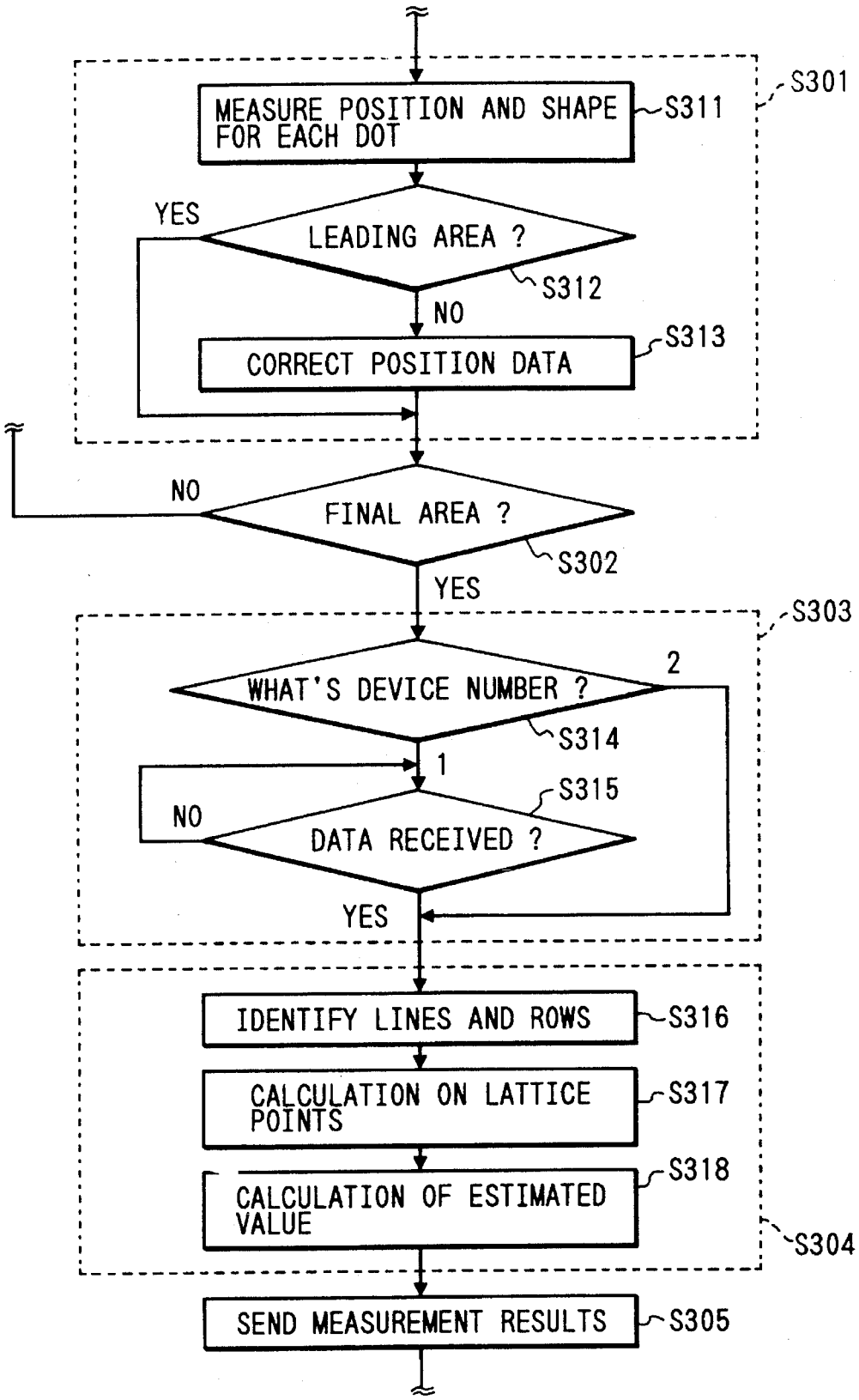
FIG. 24 is a flow chart for measuring the evenness

FIG. 24 is a flow chart showing the first image processing, and explains details of the image processing step and subsequent steps in FIG. 19 (S211 to S217 and S223 to S226).

In FIGS. 19 and 24, steps S213 and S223 in FIG. 19 correspond to step S301 in FIG. 24; S214 and S224 in FIG. 19, S302 in FIG. 24; S215 in FIG. 19, S303 in FIG. 24; S216 and S225 in FIG. 19, S304 in FIG. 24; and S217 and S226 in FIG. 19, S305 in FIG. 24.

Step S301 in FIG. 24 is the step of measuring position and shape data of each dot as fundamental data of this processing, and includes the step (S311) of performing measurement according to the coordinate system in each area, and the step (S313) of calculating position data in which the image pick-up position of the paper carry stage 712 is corrected in consideration of the positional relationship of the areas.

Step S304 in FIG. 24 is the step of converting the measurement value calculated in the step (S301) of measuring the position and shape of each dot into an estimated value for finally discriminating a normal or defective head, and includes the step (S316) of identifying "lines" and "rows" in FIG. 23 to which dots belong, the step (S317) of calculating each dot position by least square approximation, and calculating a position shift of each dot on the basis of a difference between a lattice position and each dot position, and the step (S318) of totaling the data of the dots in units of nozzles (in units of lines in FIG. 23) to calculate the estimated value.

Figure 25:
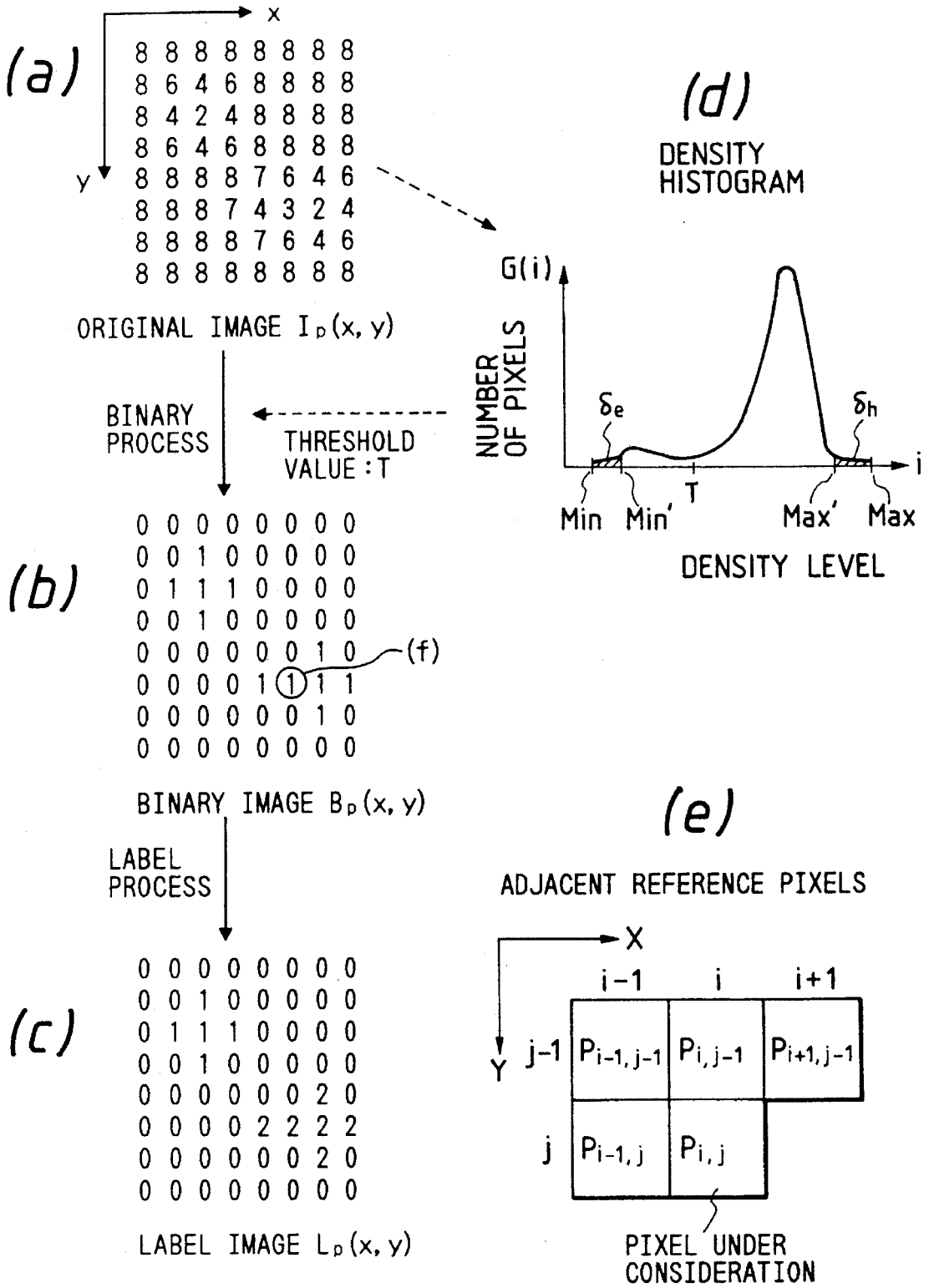
FIG. 25(*a*) to (*e*) are views illustrating operations in the step of measuring the position and shape of each dot.

FIGS. 25(*a*) to 25(*e*) illustrate the operation in the step (S311) of measuring the position and shape of each dot in FIG. 24.

FIG. 25(*a*) shows a digital image of a pattern to be measured stored in the image memory 193, and numerical values in FIG. 25(*a*) indicate density values of pixels.

FIG. 25(*b*) shows a binary image separated into a dot portion and a background portion by threshold value processing of the density values. The threshold value processing is processing for forming an output image B={Bp(x,y)} based on an original image I={Ip(x,y)} according to the following equation:

$$Bp(x,y)=\begin{cases}1: \text{when } Ip(x,y)\leqq T\\ p: \text{when } Ip(x,y)>T\end{cases}$$

where T is a constant, and will be referred to as a threshold value hereinafter.

When the threshold value T is a fixed constant, separation between dot and background portions becomes unstable due to, e.g., a variation in illumination light amount. For this reason, a density histogram (FIG. 25(*d*)) is formed by counting the number of pixels having the same density value from the original image I, and when the minimum density value is represented by Min, the maximum density value is represented by Max, and the number of pixels of a given density level i is represented by G(i), using Min' and Max' satisfying the following relations:

$$\sum_{i=\text{Min}}^{\text{Min}'-1} G(i)<\delta_l\leqq\sum_{i=\text{Min}}^{\text{Min}'} G(i)$$

$$\sum_{i=\text{Max}'+1}^{\text{Max}} G(i)<\delta_h\leqq\sum_{i=\text{Max}'}^{\text{Max}} G(i)$$

($\delta_l$, $\delta_h$: a predetermined numerical value equal to or larger than 0)

T is calculated by the following equation:

$$T=Min'+t(Max'-Min')$$

(t: a predetermined numerical value satisfying 0<t<1)

In this case, although t is a fixed value, since Min' and Max' follow, e.g., a variation in illumination light amount, a binary image, which is stable against such variation, can be output.

FIG. 25(*c*) shows a label image obtained by assigning different numbers to the dots of the binary image shown in FIG. 25(*b*), so that dots can be identified from each other. In order to form the label image, the binary image Bp(x,y) is scanned in the TV raster scanning order. When a pixel Bp(x,y) under consideration>0, the label values of four pixels ($P_{i-1,j-1}$, $P_{i,j-1}$, $P_{i+1,j-1}$, and $P_{i-1,j}$) adjacent to the pixel under consideration are referred to, and if there is a pixel with a label value, this label value is determined as the label value of $P_{ij}$; if there are no pixels with label values, a new label value, which is not used yet, is determined as the label value of $P_{ij}$. In the case of a portion (f) in FIG. 25(*b*), reference pixels have two different label values. In this case, data indicating that two labels correspond to a single label is stored, and these labels are corrected after a single scanning operation is ended. With this processing, the label image Lp(x,y) is obtained.

From the label image Lp(x,y), a moment character amount $M_{pq}(k)$ given by the following equation in units of labels is calculated:

$$M_{pq}(k)=\sum_x\sum_y x^p y^q\times f(x,y)$$

$$\text{for } f(x,y)=\begin{cases}1: \text{when } k=Lp(x,y)\\ 0: \text{when } k\neq Lp(x,y)\end{cases}$$

In this moment character amount, $M_{00}(k)$ represents the area of a label K, $M_{10}(k)/M_{00}(k)$ represents the x-coordinate of the position of the center of gravity, and $M_{01}(k)/M_{00}(k)$ represents the y-coordinate of the position of the center of gravity. Therefore, when the moment character amount is calculated, the position and shape of each dot can be measured.

Figure 26:
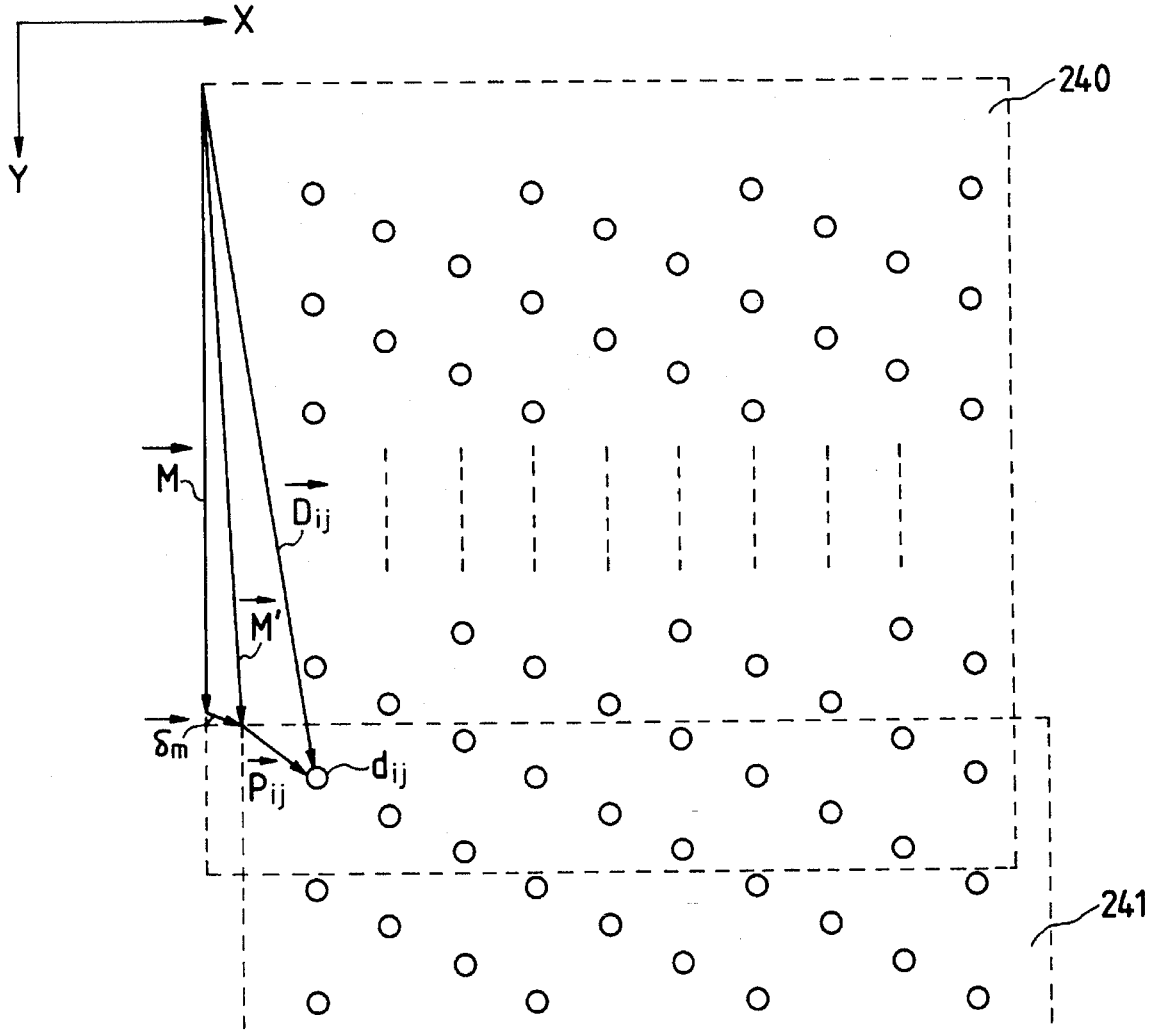
FIG. 26 is a view for explaining correction processing of position data of dots.

FIG. 26 is view for explaining correction of position data of dots. FIG. 26 illustrates an upper area 240 (corresponding to the pick-up image areas 1, 3, 5, 7, 9, and 11 in FIG. 17) as the first pick-up image area of an area obtained by picking up a pattern to be measured in two image pick-up operations, and a lower area 241 (corresponding to the pick-up image areas 2, 4, 6, 8, 10, and 12 in FIG. 17. A relative movement command value of the paper carry stage 712 from the image pick-up position of the first pick-up image area 240 to that of the second pick-up image area 241 is represented by:

$$\vec{M}=(M_x,M_y)$$

a measurement value of a dot $d_{ij}$ in the first pick-up image area 240 is represented by:

$$\vec{D}_{ij}=(DX_{ij},DY_{ij})$$

and, a measurement value in the second pick-up image area 241 is represented by:

$$\vec{P}_{ij}=(PX_{ij},PY_{ij})$$

In this case, if the paper carry stage 712 is moved according to the command, we have:

$$\vec{D}_{ij}=\vec{M}+\vec{P}_{ij}$$

However, due to the linearity or backlash of the driving system, an error given by the following equation occurs:

$$\vec{D}_{ij}=\vec{M}+\vec{P}_{ij}+\vec{\delta}_m$$

$$\vec{\delta}_m=(\delta_{mx},\delta_{my})$$

Thus, the first and second pick-up image areas 240 and 241 are set to partially overlap each other, and the error $\vec{\delta}_m$ is calculated based on two measurement values $\vec{D}_{ij}$ and $\vec{P}_{ij}$ of dots present in the overlapping area according to the following equation:

$$\vec{\delta}_m=\vec{D}_{ij}-(\vec{P}_{ij}+\vec{M})$$

Then, the second pick-up image area 241 is corrected using a corrected moving amount $\vec{M}'=(M'_x,M'_y)$ corrected by this error $\vec{\delta}_m$.

In this case, although $\vec{D}_{ij}$ and $\vec{P}_{ij}$ include measurement errors, $|\vec{\delta}_m| \simeq$ value between 10 to 19 μm, while errors $\vec{\delta}_{Dij}$ and $\vec{\delta}_{Pij}$ of $\vec{D}_{ij}$ and $\vec{P}_{ij}$ satisfy $|\vec{\delta}_{Dij}|, |\vec{\delta}_{Pij}| \simeq$ several μm. Furthermore, in order to calculate $\vec{\delta}_m$, when an average corresponding to the number of dots in the overlapping area is calculated, we have:

$$|\vec{\delta}_{Dij}|, |\vec{\delta}_{Pij}| < |\vec{\delta}_m|$$

Therefore, the errors of $\vec{D}_{ij}$ and $\vec{P}_{ij}$ can be ignored.

In order to identify the same dots in the first and second pick-up image areas 240 and 241, since the interval between adjacent dots is as large as up to about 200 μm, if the following relation is satisfied between a dot $d_{ij}$ measured in the first pick-up image area 240 and a dot $d_{st}$ measured in the second pick-up image area 241, the dots $d_{ij}$ and $d_{st}$ are determined as the same dot:

$$|\vec{D}_{ij} - \vec{P}_{st} + \vec{M}| < L$$

where L is a predetermined value (up to 100 μm).

In this manner, after the measurement values in the first and second pick-up image areas 240 and 241 are converted into values on the same coordinate system, of the measurement values of dots measured in both the first and second pick-up image areas 240 and 241 in the overlapping area, the measurement values in one area are deleted, and thereafter, the measurement values are stored in the image memory 193.

In this embodiment, the measurement values in the second pick-up image area 241 are corrected in correspondence with the coordinate system of the first pick-up image area 240. However, a correction opposite to that described above may be performed. In this embodiment, since the first pick-up image area 240 is subjected to measurement first, the above-mentioned correction is performed simultaneously when the second pick-up image area 241 is picked up, and the dot positions are measured. However, when the image pick-up order is reversed, the correction may be performed immediately before the step (S316) of identifying "lines" and "rows" in the total processing step (S304) in FIG. 24.

The number of divided areas is not limited to two.

A lattice point as the basis of the step (S304 in FIG. 24) of calculating an estimated value for discriminating a normal or defective head will be described below.

Figure 27:
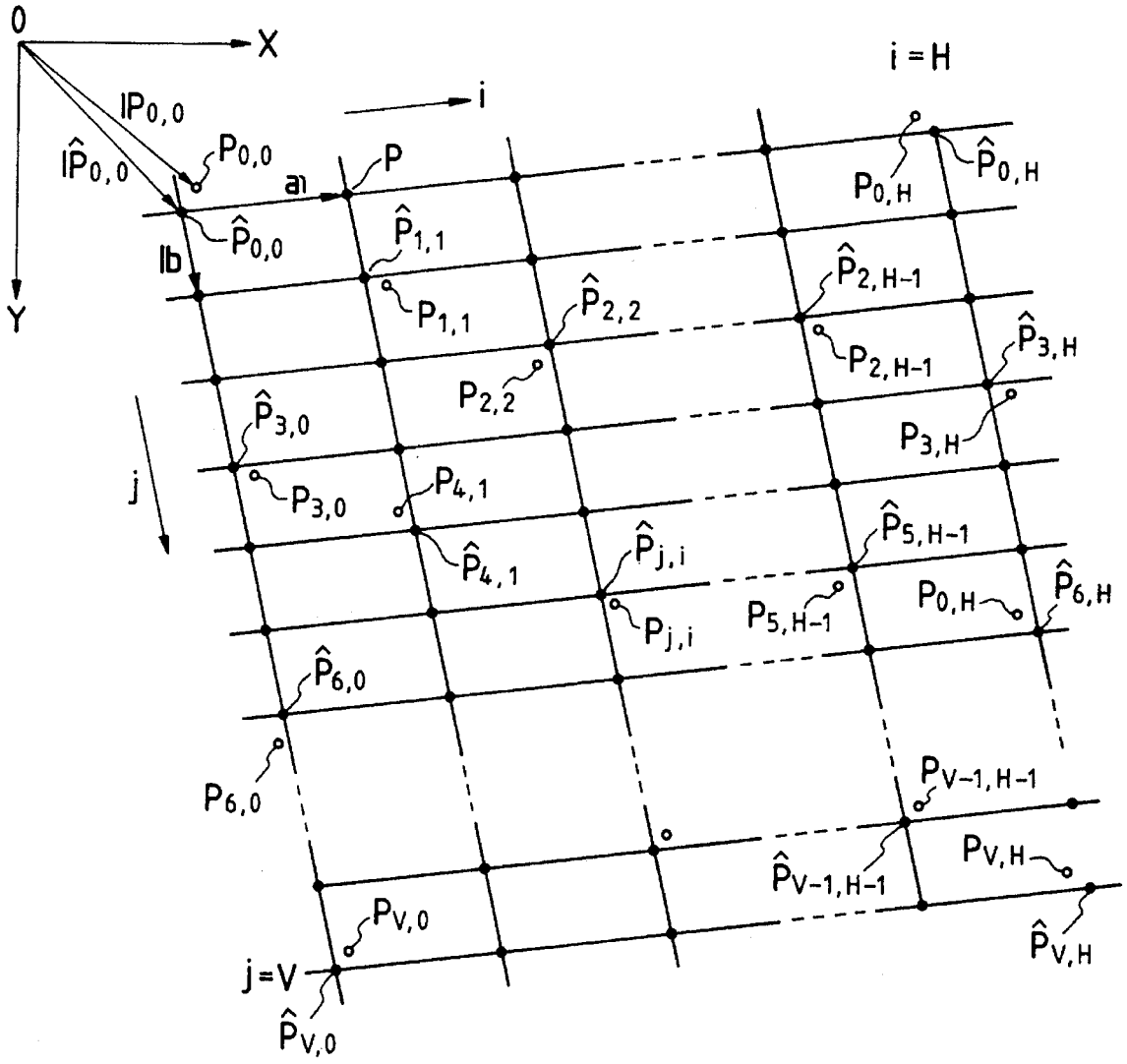
FIG. 27 is a view for explaining lattice points in the step of calculating an estimated value.

In FIG. 27, "○" represents an actual dot, and "●" represents a lattice point obtained by a calculation, and like in FIG. 23, a direction of an arrow i will be referred to as a "line" hereinafter, and a direction of an arrow j will be referred to as a "row" hereinafter.

In an ideal printed pattern, "line" and "row" intervals are constant, and if the "lines" and "rows" are respectively expressed as a and b using vectors, a position $\hat{P}_{ij}$ of an arbitrary dot $\hat{P}_{ij}$ can be expressed by:

$$\hat{P}_{ij} = i \cdot a + j \cdot b + \hat{P}_{0,0} \tag{1}$$

If the position of an actual dot is represented by $P_{ij}$, and we assume:

$$Q = \Sigma |P_{ij} - \hat{P}_{ij}|^2 \tag{2}$$

then, $$\frac{\delta Q}{\delta a} = \frac{\delta Q}{\delta b} = \frac{\delta Q}{\delta P_{0,0}} = \phi \tag{3}$$

can be solved to obtain a, b, and $\hat{P}_{0,0}$ by the least square method, and an ideal position of each dot can be obtained.

More specifically, if the "lines" and "rows" of the actually printed dots can be identified, and we assume:

$$P_{ij} = \begin{bmatrix} P_x(i,j) \\ P_y(i,j) \end{bmatrix}, P_{ij} = \begin{bmatrix} P_x(i,j) \\ P_y(i,j) \end{bmatrix}, a = \begin{bmatrix} a_x \\ a_y \end{bmatrix}, b = \begin{bmatrix} b_x \\ b_y \end{bmatrix}$$

N: the number of dots the normal equation of the least square method is given by:

(Σ: sum of all the actual dots)

$$\begin{bmatrix} \Sigma P_x(i,j) & \Sigma P_y(i,j) \\ \Sigma i \times P_x(i,j) & \Sigma i \times P_y(i,j) \\ \Sigma j \times P_x(i,j) & \Sigma j \times P_y(i,j) \end{bmatrix} = \begin{bmatrix} N & \Sigma i & \Sigma j \\ \Sigma i & \Sigma i^2 & \Sigma i \times j \\ \Sigma j & \Sigma i \times j & \Sigma j^2 \end{bmatrix} \begin{bmatrix} P_x(0,0) & P_y(0,0) \\ a_x & a_y \\ b_x & b_y \end{bmatrix}$$

This equation is modified to:

$$\begin{bmatrix} P_x(0,0) & P_y(0,0) \\ a_x & a_y \\ b_x & b_y \end{bmatrix} = \begin{bmatrix} N & \Sigma i & \Sigma j \\ \Sigma i & \Sigma i^2 & \Sigma i \times j \\ \Sigma j & \Sigma i \times j & \Sigma j^2 \end{bmatrix}^{-1} \begin{bmatrix} \Sigma P_x(i,j) & \Sigma P_y(i,j) \\ \Sigma i \times P_x(i,j) & \Sigma i \times P_y(i,j) \\ \Sigma j \times P_x(i,j) & \Sigma j \times P_y(i,j) \end{bmatrix} \tag{4}$$

Thus, a, b, and $\hat{P}_{0,0}$ are obtained, and a point $\hat{P}_{ij}$ which is ideal about a condition "constant interval" of an actual dot $P_{ij}$ can be obtained by the following equation:

$$\hat{P}_{ij} = i \cdot a + j \cdot b + \hat{P}_{00}$$

This point will be referred to as a lattice point hereinafter.

Another lattice point will be explained below. In FIG. 27, b is mainly influenced by the characteristics of the head itself, and a depends on the head traveling characteristics, i.e., the characteristics of the printer main body side.

Therefore, when the head itself is to be estimated, the following condition is preferably not used:

a=constant

Thus, when the condition "a=constant" is removed from equation (1), we have:

$$\hat{P}_{ij} = i \cdot b + \hat{P}_{i0} \tag{10}$$

In order to calculate $\hat{P}_{ij}$, b, and $\hat{P}_{i0}$ in equation (10) by the least square method, the following H+1 equations can be simultaneously solved using Q in equation (2):

$$\frac{\delta Q}{\delta b}=0,\ \frac{\delta Q}{\delta P_{i,0}}=0 \tag{11}$$

$$(i=0, 1, 2, \ldots, H)$$

The expression of equations (11) can be modified as:

$$\sum_j P_x(i,j)=\sum_j \{P_x(i,0)+j\times b_x\} \tag{12}$$

$$\sum_j P_y(i,j)=\sum_j \{P_y(i,0)+j\times b_y\} \tag{13}$$

$$\sum_{ij} j\times P_x(i,j)=\sum_{ij} \{j\times P_x(i,0)+j^2\times b_x\} \tag{14}$$

$$\sum_{ij} j\times P_y(i,j)=\sum_{ij} \{j\times P_y(i,0)+j^2\times b_y\} \tag{15}$$

If the number of dots in the i-th row is represented by N(i), and a total sum of j is represented by J(i), equations (12) and (13) can be rewritten as:

$$\sum_j P_x(i,j)=N(i)\times P_x(i,0)+J(i)\times b_x \tag{16}$$

$$\sum_j P_y(i,j)=N(i)\times P_y(i,0)+J(i)\times b_y \tag{17}$$

When these equations are substituted in equations (14) and (15), we obtain:

$$\sum_{ij} j\times P_x(i,j)=\sum_i \frac{J(i)}{N(i)}\sum_j P_x(i,j)+b_x\times\left\{\sum_{ij} j^2-\sum_i \frac{J(i)^2}{N(i)}\right\} \tag{18}$$

$$\sum_{ij} j\times P_y(i,j)=\sum_i \frac{J(i)}{N(i)}\sum_j P_y(i,j)+b_y\times\left\{\sum_{ij} j^2-\sum_i \frac{J(i)^2}{N(i)}\right\} \tag{19}$$

From these equations, we have:

$$b_x=\frac{\left\{\sum_{ij} j\times P_x(i,j)-\sum_i \frac{J(i)}{N(i)}\sum_i P_x(i,j)\right\}}{\left\{\sum_{ij} j^2-\sum_i \frac{J(i)^2}{N(i)}\right\}} \tag{20}$$

$$b_y=\frac{\left\{\sum_{ij} j\times P_y(i,j)-\sum_i \frac{J(i)}{N(i)}\sum_j P_y(i,j)\right\}}{\left\{\sum_{ij} j^2-\sum_i \frac{J(i)^2}{N(i)}\right\}} \tag{21}$$

$$P_x(i,0)=\frac{\left\{\sum_j P_x(i,j)-J(i)\times b_x\right\}}{N(i)} \tag{22}$$

$$(i=0, 1, 2, \ldots, H)$$

$$P_y(i,0)=\frac{\left\{\sum_i P_y(i,j)-J(i)\times b_y\right\}}{N(i)} \tag{23}$$

$$(i=0, 1, 2, \ldots, H)$$

In this manner, since b, $P_{0,0}$, $P_{1,0}$, $P_{2,0}$, . . . , $P_{H,0}$ can be obtained, lattice points with indefinite "row" intervals can be obtained.

The actual operation in the total processing step (S304) in FIG. 24 will be described in detail below.

Figure 28:
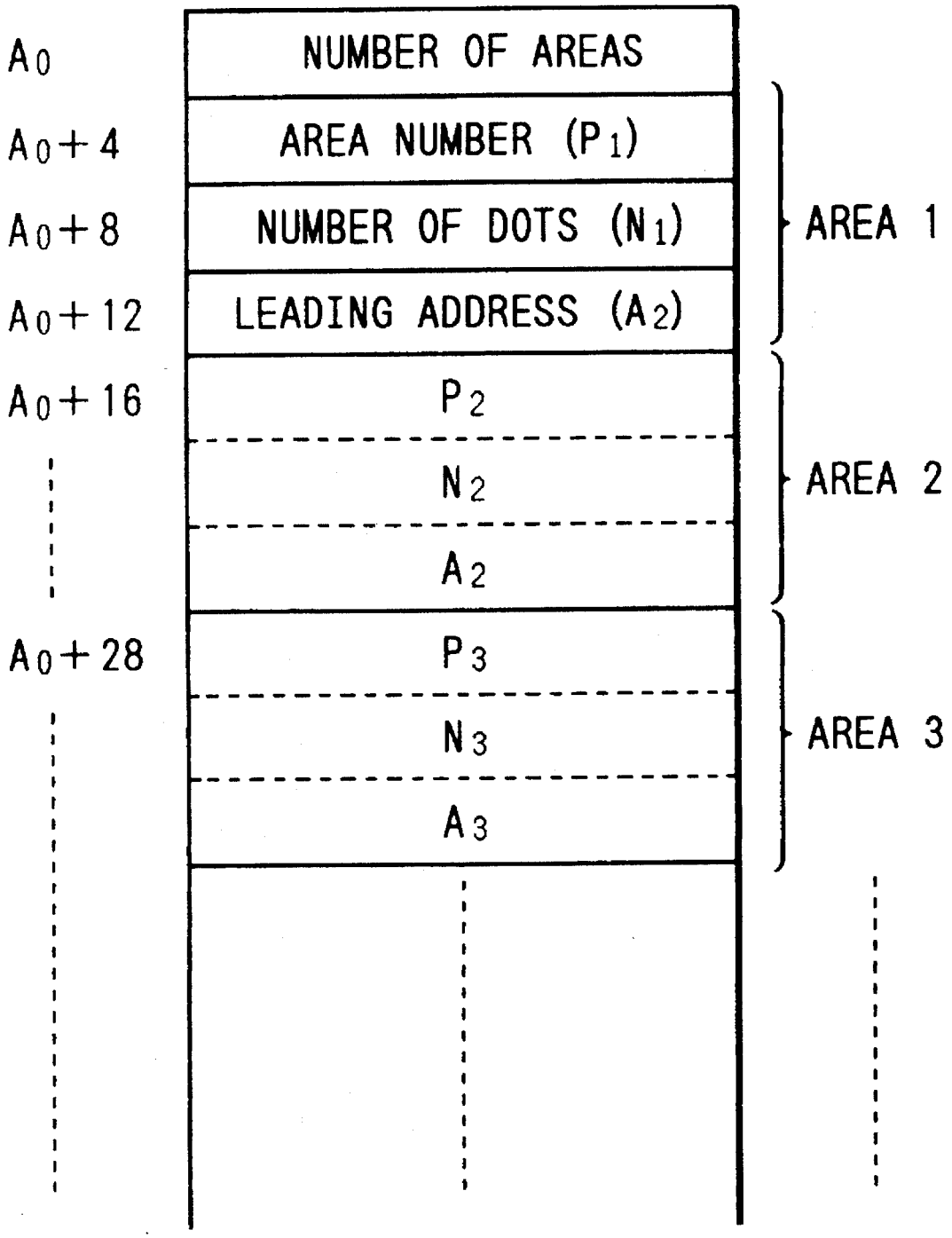
FIG. 28 shows a dot management table.
Figure 29:
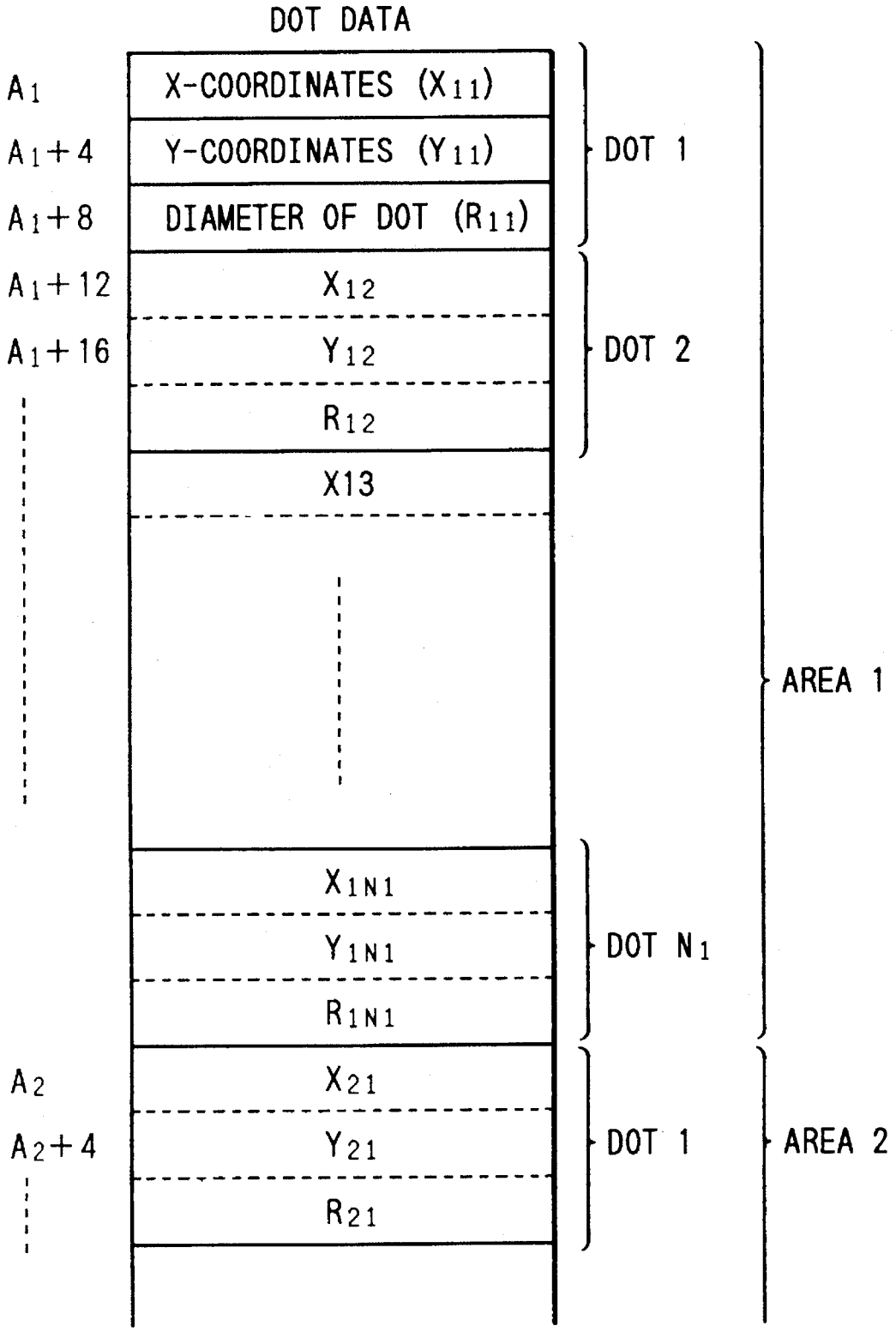
FIG. 29 shows the storage format of dot data.

FIGS. 28 and 29 are views showing the storage formats of dot data obtained in the step (S301) of measuring the position and shape of each dot. As dot data, sets of x-coordinate data ($X_{ij}$), y-coordinate data ($Y_{ij}$), and dot diameter data ($R_{ij}$) of dots corresponding to the number of dots in an area are stored, and thereafter, data of the next area are stored in the same format. In this case, a dot whose area falls outside a predetermined range is determined not to be a dot but a "stain" or "dust", and its data are not stored. The dot diameter $R_{ij}$ is an equivalent diameter calculated by $R_{ij}=2\sqrt{S_{ij}/\pi}$ on the basis of a dot area ($S_{ij}$) obtained in the step (S301) of measuring the position and shape of each dot.

Since dot data of the respective areas are continuously stored, a set of a pick-up image number ($P_i$), the number of dots ($N_i$), and a leading data storage address ($A_i$) of each area is stored in a dot data management table shown in FIG. 28, and the number of areas is stored at the leading address of the dot data management table. When data are stored in this format, even when the total number of dots is changed, the memory can be efficiently used.

The measurement condition data received from the main CPU 100 in the input command reception step (S210, S220) in FIG. 19 are stored, and the connection relationship among the respective pick-up image areas is obtained on the basis of the measurement condition data and the dot data management table. Thus, the "rows" and "lines" of dots are identified, and lattice points and estimated values are calculated, in units of connected areas.

In this embodiment, the dot diameter $R_{ij}$ is calculated based on the dot area. Alternatively, a circumferential length $L_{ij}$ may be obtained in the step of measuring the shape of each dot, and the dot diameter may be calculated by $R_{ij}=L_{ij}/\pi$ based on (circumference)=π×(diameter).

Figure 30:
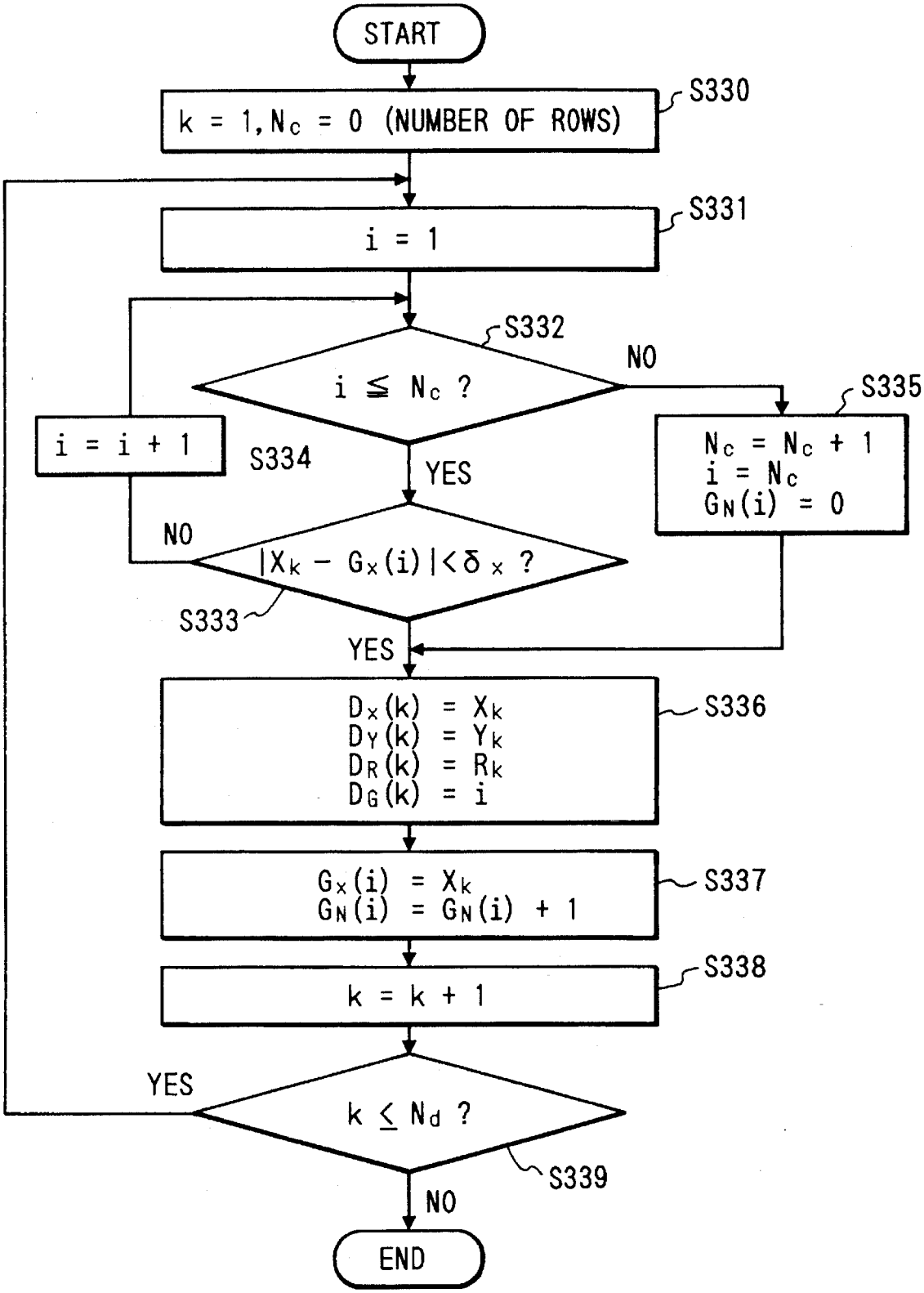
FIG. 30 is a flow chart of processing for identifying rows to which dots belong.

FIG. 30 is a flow chart for explaining processing of identifying the "rows" to which dots belong.

In FIG. 30, a dot k under consideration and the number $N_c$ of rows are initialized to k=1 and $N_c$=0 (S330), and a number i of a row to be compared is initialized to i=1 (S331). The row number i and the number $N_c$ of rows are compared with each other (S332), and if $i\leqq N_c$, a representative x-coordinate value $G_x(i)$ of a row i is compared with an x-coordinate value $X_k$ of the dot k (S333). At this time, if the difference between $G_x(i)$ and $X_k$ is equal to or larger than a predetermined value $\delta_x$, it is determined that the dot k does not belong to the row i since it is separated from the row i. Then, i is incremented by one so as to be compared with the next row (S334), and the flow returns to the step (S332) of checking the number of rows.

On the other hand, if the difference between $G_x(i)$ and $X_k$ is smaller than the predetermined value $\delta_x$, it is determined that the dot k belongs to this row. The x-coordinate ($X_k$), y-coordinate ($Y_k$), and dot diameter ($R_k$) of the dot k are read out, and the row number i is stored (S336). The representative x-coordinate of the row is updated with $X_k$, and the number of dots belonging to the row is increased by one (S337). Thereafter, the dot number k is incremented by one (S338), and if any dot to be considered remains (S339), the flow returns to the comparison step with the row (S331).

If it is determined in step S332 of checking the number of rows that $i>N_c$, this means that there is no row to which the dot k belongs. For this reason, the row is incremented by one, so that $N_c=N_c+1$ and $i=N_c$, and the number $G_N(i)$ of dots of a new row is initialized to $G_N(i)=0$ (S335). Thereafter, the dot data storage step (S336) is executed.

When a series of these processing operations are performed for all the dots, numbers of rows to which dots belong are assigned. In this case, the numbers are assigned independently of the actual aligning order of dots. For example, in FIG. 23, the row numbers 1 to 3 are assigned to the first, fourth, and seventh rows, the row numbers 4 and 5 are assigned to the second and fifth rows, and row numbers 6 and 7 are assigned to the third and sixth rows. This is because processing is performed in the TV raster scanning order upon dot position measurement, and the dot data are stored in this order. Thus, the row numbers assigned in the processing shown in FIG. 30 must be exchanged to correspond with a pattern.

Figure 31:
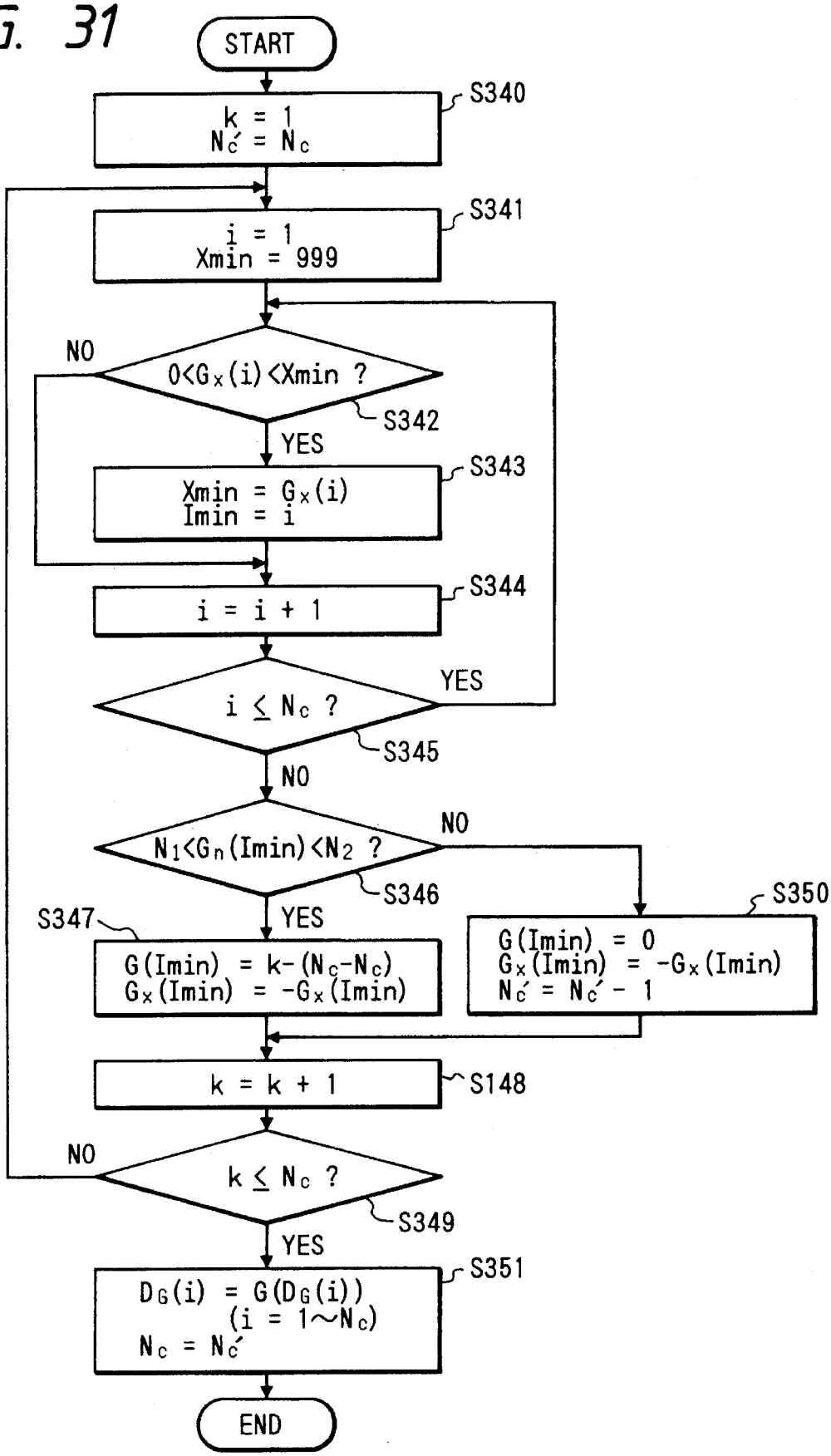
FIG. 31 is a flow chart of processing for exchanging row numbers.

FIG. 31 is a flow chart for explaining processing for exchanging the row numbers to the order from the left side in the pick-up image area.

In step S340, a new row number k is initialized to k=1, and the number $N_c'$ of valid rows used in subsequent processing is initialized to the current total number $N_c$ of rows. A number i of a row to be compared is set to be i=1, and a minimum value $X_{min}$ of a representative x-coordinate value of the row is set to be a large value (e.g., $X_{min}$=999) (S341). $X_{min}$ and the representative x-coordinate value $G_x(i)$ of the row i are compared with each other (S342). At this time, if $0<G_x(i)<X_{min}$, since the row i is present at the left side of $X_{min}$, $X_{min}$ is updated to $X_{min}=G_x(i)$, and the row number is stored as $I_{min}$ (S343). Thereafter, a number of a row to be compared is incremented by one (S344), and is compared with the total number $N_c$ of rows (S345). If $i<N_c$, since rows to be compared remain, the flow returns to step S342. However, if $i>N_c$, since comparison with all the rows is completed, a row stored in $I_{min}$ at this time is a k-th row from the left. In order to discriminate whether or not the row $I_{min}$ is a valid row, the number $G_x(I_{min})$ of dots of the row $I_{min}$ is compared with predetermined values $N_1$ and $N_2$ ($N_1<N_2$) (S346). If $N_1<G_n(I_{min})<N_2$, it is determined that the row $I_{min}$ is a valid row, and a value ($N_c-N_c'$) obtained by subtracting the number of invalid rows from k is registered as $G(I_{min})=k-(N_c-N_c')$ in the conversion table. In order to inhibit this data from being used in the following processing, the sign is inverted, i.e., $G_x(I_{min})=-G_x(I_{min})$ (S347).

On the other hand, if $G_n(I_{min})<N_1$ or $N_2<G_n(I_{min})$, a possibility that the row $I_{min}$ is a row other than dots such as a stain is high. Therefore, the row is determined as an invalid row, and the row number $G(I_{min})=0$ is registered in the conversion table. Like in the case of a valid row, the sign of $G_x(I_{min})$ is inverted, and the number $N_c'$ of valid rows is decremented by one, i.e., $N_c'=N_c'-1$ (S350).

Upon completion of registration to the conversion table, a new row number k is incremented by one to determine the next row (S348), and the new row number k is compared with the total number $N_c$ of rows (S349). If $k\leqq N_c$, since rows whose new row numbers are not determined remain, the flow returns to step S341 to repeat the series of processing operations.

If $k>N_c$, since the new row numbers of all the rows are determined, the row numbers are updated by $D_G(i)=G(D_G(i))$ (i=1, 2, . . . , $N_c$) using the conversion table G(i). The total number of rows is also updated with the number $N_c'$ of rows obtained by subtracting the number of invalid rows by $N_c=N_c'$.

Figure 32:
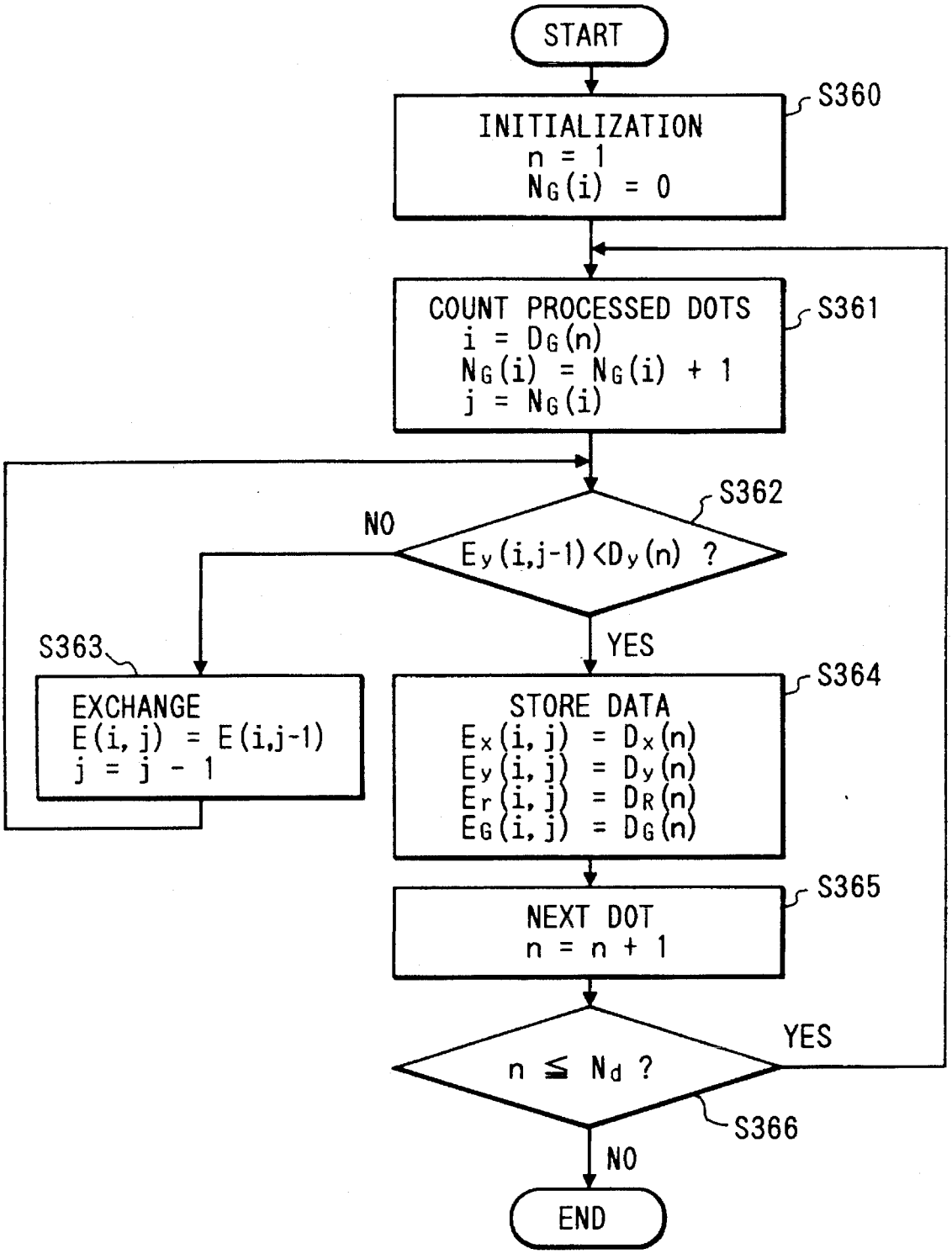
FIG. 32 is a flow chart of processing for identifying lines to which dots belong.

FIG. 32 is a flow chart for explaining processing for storing dot data, whose rows are determined, in accordance with the y-coordinates of dots in units of rows so as to discriminate the lines to which the dots belong.

In the initialization step S360, the numbers $N_G(i)$ to $N_G(N_c)$ of processed dots in units of rows are initialized to 0, and a dot No. under consideration is also initialized to n=b 1.

Then, the row number of a dot n is given by i ($i=D_G(n)$), and the number $N_G(i)$ of processed dots is incremented by one. At this time, a storage position j of the dot n is an ($N_G(i)$)-th position in a data storage area of the row i (S361).

Before dot data is stored, a y-coordinate $E_y(i,j-1)$ of dot data stored at a (j-1)-th position in the data storage area of the row i is compared with a y-coordinate $D_y(n)$ of the dot n (S362). If $E_y(i,j-1)>D_y(n)$, since the dot n is present at an upper position than a dot stored in the (j-1)-th area, (j-1)-th data is moved to a j-th area, and j=j−1 to shift the storage position of the dot n upward-by one (S363). The flow then returns to the y-coordinate comparison step S362.

When the y-coordinate comparison step (S362) and the stored data shift step (S361) are repeated until $E_y(i,j-1)<D_y(n)$ is satisfied, all the dot data located at lower positions than the dot n are shifted to the next area, and an area where data of the dot n is to be stored becomes empty. Thus, the data of the dot n is stored in this area (S364).

Thereafter, the dot number n is incremented by one (S365), and n is compared with the total number $N_d$ of dots (S366). If $n\leqq N_d$, the flow returns to step S361 to perform a series of processing operations for the remaining dots; if $n>N_d$, the processing is ended.

Figure 33:
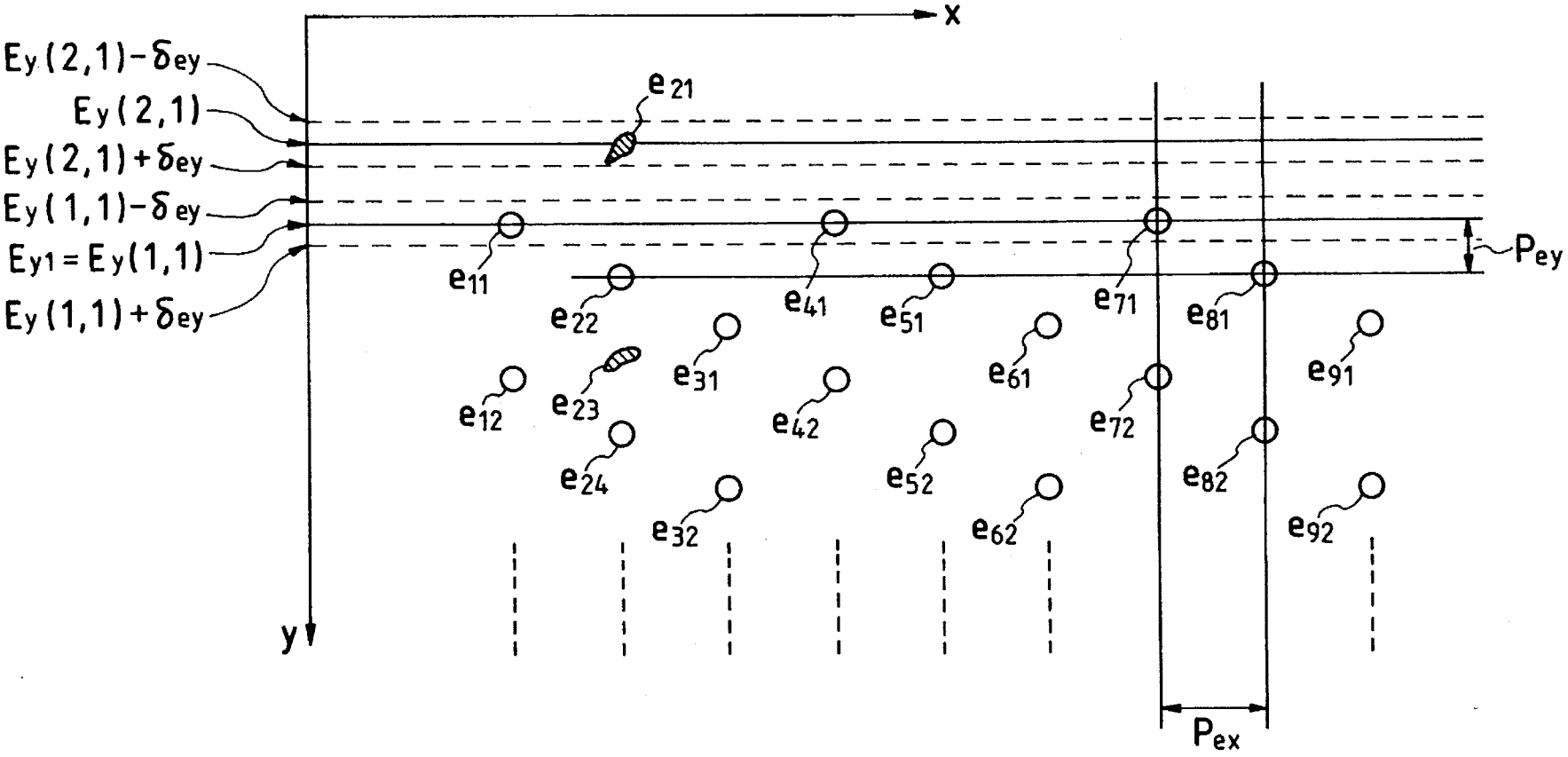
FIG. 33 is a view showing a dot pattern.
Figure 34:
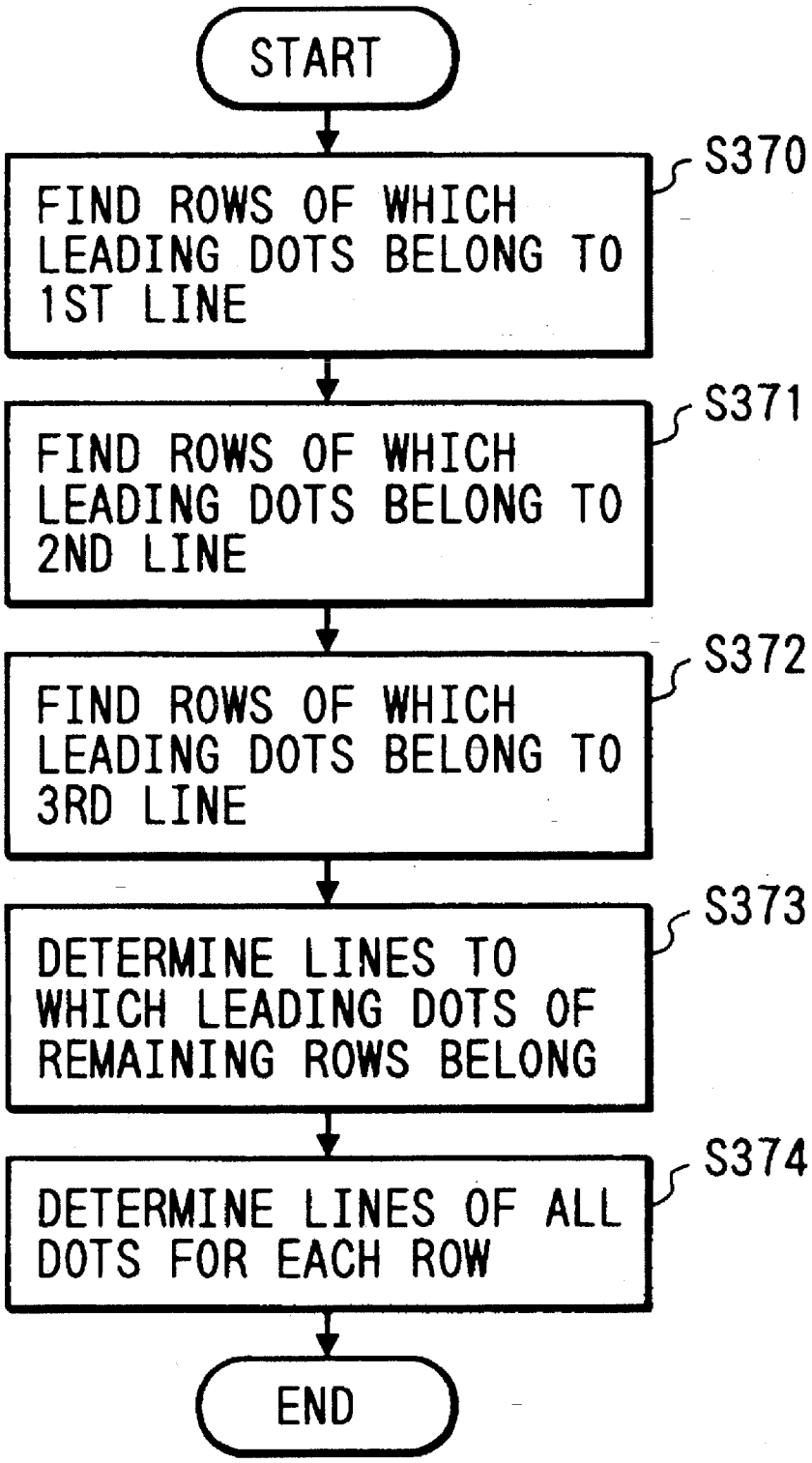
FIG. 34 is a flow chart of processing for determining lines of dots.

FIGS. 33 and 34 are views for explaining processing for determining the "lines" to which dots belong on the basis of dot data classified in units of rows.

FIG. 33 shows a dot pattern. In FIG. 33, $e_{ij}$ indicated by "o" corresponds to a dot, and $e_{21}$ and $e_{23}$ indicated by "●" correspond to, e.g., a "stain" or "dust∞ other than a dot. The standard dot pitch in the vertical (y) direction is represented by $P_{ey}$, and the standard dot pitch in the horizontal (x) direction is represented by $P_{ex}$.

FIG. 34 is a flow chart showing the processing of determining the "lines". This processing consists of the step of finding rows leading dots of which belong to the first line (S370), the step of finding rows leading dots of which belong to the second line (S371), the step of finding rows leading dots of which belong to the third line (S372), the step of determining lines of leading dots for rows leading dots of which cannot be discriminated in the above-mentioned three steps (S373), and the step of determining lines of all the dots in units of rows on the basis of the lines of leading dots of the rows (S374).

In the step of finding rows leading dots of which belong to the first line, dots belonging to the first line are determined. The dots belonging to the first line are those located at the uppermost position, and their y-coordinate values are smaller than other dots. Thus, the y-coordinates of the leading dots of rows are compared to detect the smallest y-coordinate, and the detected y-coordinate value is determined as $E_{y1}$. Then, y-coordinates $E_y(i,j)$ of dot data classified in units of rows are compared to count the number $N_{y1}$ of dots whose $E_y(i,j)$ falls within a predetermined range ($E_{yi}-\delta_{0y}<E_y(i,j)<E_{y1}+\delta_{0y}$). When $N_{y1}$ falls within a predetermined range ($N_{ymin}\leqq N_{y1}\leqq N_{ymax}$), $E_{y1}$ is determined as a representative y-coordinate value of the first line. When $N_{y1}$ falls outside the predetermined range, a possibility that the dot is not a dot like $e_{21}$ in FIG. 33 is high. Thus, the line number $E_s(2,1)$ of $e_{21}$ is set to be $E_s(2,1)=-1$ to store that the data is not a dot. Then, a leading dot having the second smallest y-coordinate of the row is searched, and the processing is repeated in this manner. In FIG. 33, $e_{11}$ becomes a candidate in turn. Thus, $E_{y1}=E_y(1,1)$ is set, and the number $N_{y1}$ of dots whose y-coordinates fall within the predetermined range is counted. At this time, since $e_{41}$ and $e_{71}$ are present, $N_{y1}$=3, and the number of times of repetition of a pattern is 3. For this reason, if $N_{ymin}$=2 and $N_{ymax}$=4, since $N_{y1}$ falls within the predetermined range, $E_{y1}=E_y(1,1)$ is determined, and the line of $e_{11}$, $e_{41}$, and $e_{71}$ is determined as 1. Thus, $E_s(1,1)=E_s(4,1)=E_s(7,1)=1$ is registered.

Assume that the initial value of the line number $E_s(i,j)$ of each dot is 0. The next step is the step of determining dots belonging to the second line. Since dots of the second line have no feature unlike those of the first line, which are located at the uppermost positions, dots located at a position lower by the standard y-dot pitch $P_{ey}$ from the representative y-coordinate $E_{y1}$ of the first line are determined as those belonging to the second line. More specifically, when y-coordinates $E_y(i,j)$ of dots, excluding dots whose line is already determined, and which is set to be $E_s(i,j)=1$, or data which is determined not to be a dot, and is set with $E_s(i,j)=-1$, satisfy the following relation, they are determined to belong to the second line, and are set with $E_s(i,j)=2$:

$$E_{y1}+P_{ey}-\delta_{ey}<E_y(i,j)<E_{y1}+P_{ey}+\delta_{ey}$$

At this time, when $E_y(i,j)<E_{y1}+P_{ey}-\delta_{ey}$, the corresponding dots do not belong to the first and second lines, and are located above the second line. Thus, this means that there are no lines to which these dots belong, and $E_s(i,j)=-1$ is set.

In the step of finding rows leading dots of which belong to the third line, the same processing as in the step of finding rows leading dots of which belong to the second line is performed. In this case, a condition for determining dots which belong to the third line is given by:

$$E_{y1}+2\cdot P_{0y}-\delta_{ey}<E_y(i,j)<E_{y1}+2\cdot P_{ey}+\delta_{0y}$$

When dots in none of the first to third lines are absent, the lines to which rows belong can be determined. However, when one or a plurality of dots in the first to third lines are absent, the lines of some rows cannot often be determined. FIGS. 35A to 35H show this state.

Figure 35A:
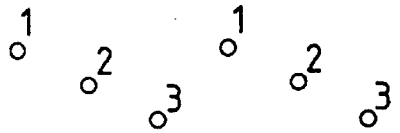
FIGS. 35A to 35H are views showing dot patterns.
Figure 35B:
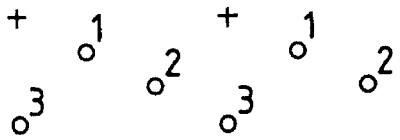
Figure 35C:
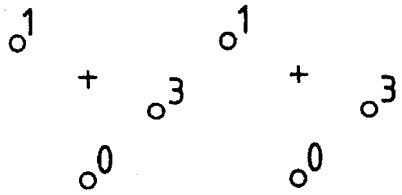
Figure 35D:
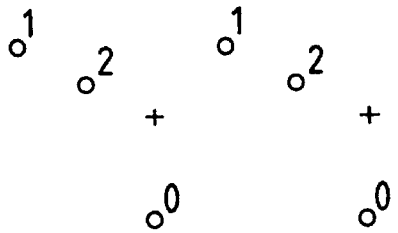
Figure 35E:
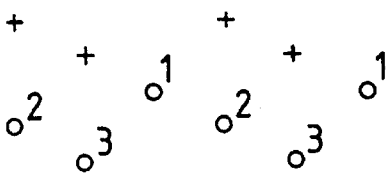
Figure 35F:
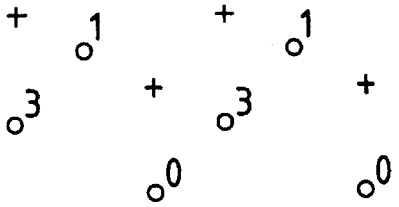
Figure 35G:
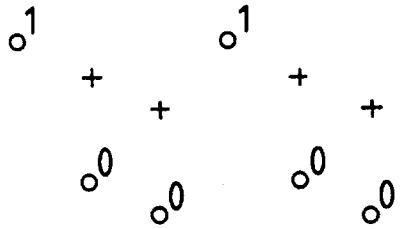
Figure 35H:
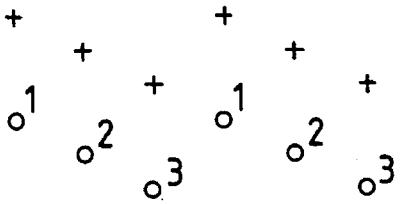

In FIGS. 35A to 35H, "0" indicates a dot, "+" indicates an absent dot, and a numerical value represents a line number determined by the steps of finding rows leading dots of which belong to the first to third lines. FIG. 35A shows a st-ate wherein none of the lines are absent, FIG. 35B shows a case wherein only the first line is absent, FIG. 35C shows a case wherein only the second line is absent, FIG. 35D shows a case wherein only the third line is absent, FIG. 35E shows a case wherein the first and second lines are absent, FIG. 35F shows a case wherein the first and third lines are absent, FIG. 35G shows a case wherein the second and third lines are absent, and FIG. 35H shows a case wherein the first, second, and third lines are absent.

In FIGS. 35B to 35H, FIGS. 35B, 35E, and 35H show a case wherein the lines of all the rows are determined although they are not correct lines. In this case, the number of absent lines can be easily detected since the number of line numbers assigned to dots is decreased by the number of absent lines. Therefore, the cases shown in FIGS. 35C, 35D, 35F, and 35G need only be examined.

In the cases of FIGS. 35C and 35F, the lines to which rows belong on two sides of an absent line are determined. That is, rows on the left side of the absent line belong to the first line, and rows on the right side of the absent line belong to the third line. For this reason, rows whose line is not determined belong to the second line with high possibility. Thus, the above-mentioned representative y-coordinate value $E_{y1}$ of the first line is used to obtain k (an integer equal to or larger than 1), which satisfies:

$$E_{y1}+(1+3k)P_{ey}-\delta_{ey}<E_y(i,1)<E_{y1}+(1+3k)P_{ey}+\delta_{ey}$$

At this time, since this dot belongs to the (2+3k)-th line, $E_s(i,j)=2+3k$ is set. When no k is obtained, determination of the line for dots of this row is ended.

In the case of FIG. 35D, it is assumed that rows belonging to the third line are absent, and in the case of FIG. 35G, it is assumed that rows belonging to the second and third lines are absent. Thus, the lines to which rows belong are determined using the y-coordinate value $E_y(i,j)$ of the leading dots of the rows. Rows belonging to the second lines are determined as described above. As for rows belonging to the third line, when k that satisfies the following relation is present, a line to which a dot $e_{i1}$ belongs is a (3(k+1))-th line.

$$E_{y1}+(2+3k)P_{ey}-\delta_{ey}<E_y(i,1)<E_{y1}+(2+3k)P_{ey}+\delta_{ey}$$

Since the line numbers of the leading dots of at least valid rows are determined in the processing in steps S370 to S373 in FIG. 34, line numbers of remaining dots are then determined using the line numbers of the leading dots.

Figure 36:
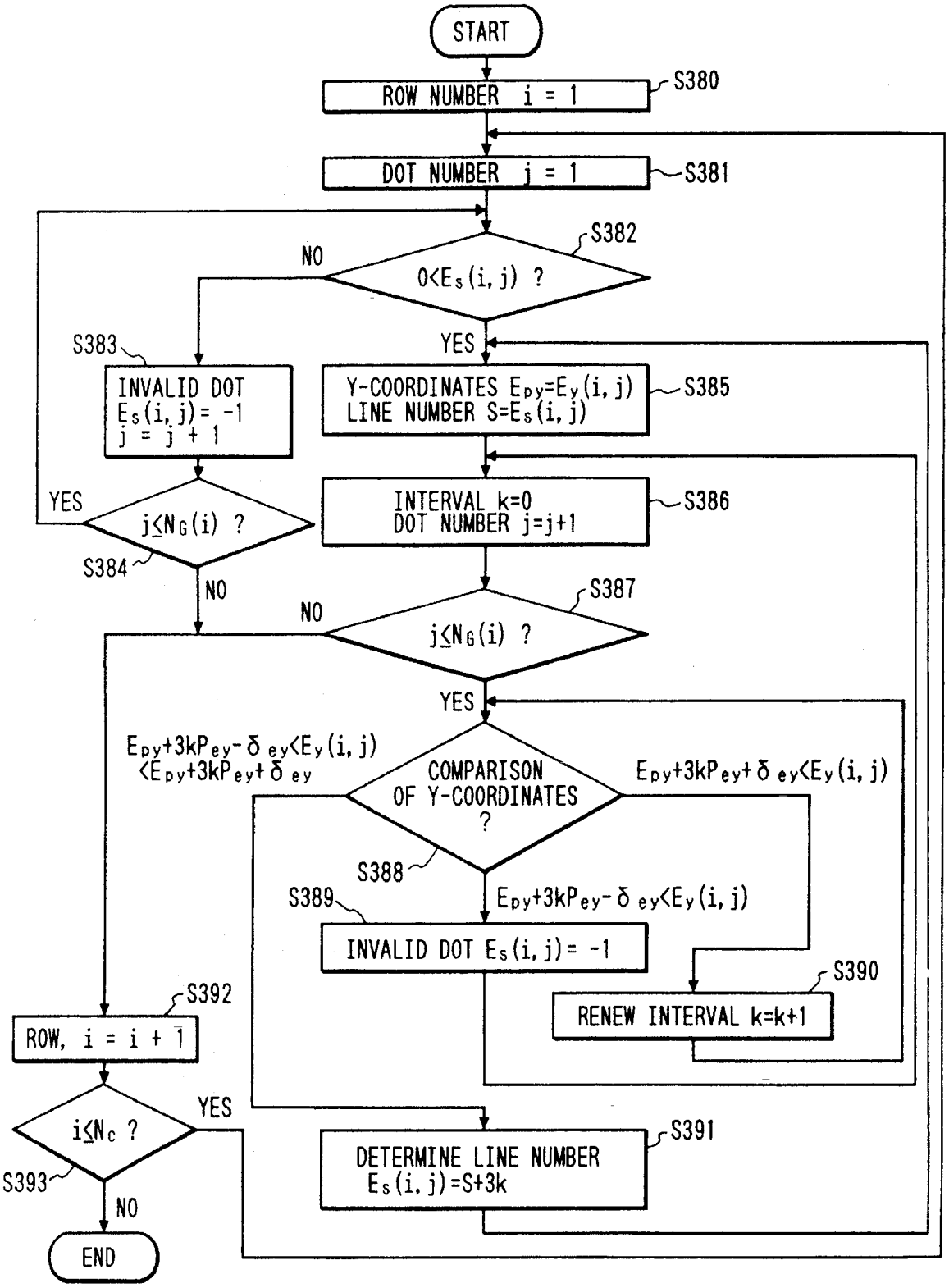
FIG. 36 is a flow chart showing processing in the step of determining lines.

FIG. 36 is a flow chart for explaining processing for determining "lines" of all the dots (S374).

In order to execute processing in units of rows, a row number i is initialized to i=1 (S380), and in order to start processing from a leading dot of each row, a dot number j is initialized to j=1 (S381).

In order to discriminate whether or not a j-th dot of a row i is a leading dot, $E_s(i,j)$ is referred to. If $E_s(i,j)<0$, it is determined that the dot is an invalid dot, and $E_s(i,j)=-1$ is set. Then, the dot number j is incremented by one to discriminate the next dot (S383). At this time, if j is equal to or smaller than the number $N_G(i)$ of dots of the row, since there are non-discriminated dots, the flow returns to the leading dot discrimination step (S382). If j exceeds $N_G(i)$, since all the dots of the row i have already been discriminated, processing for the next row is performed. In this case, all the dots of this row are invalid dots.

If it is determined in the leading dot discrimination step (S382) that the dot is the leading dot, a reference y-coordinate $E_{py}$ and a reference line number S are initialized to those of the leading dot in order to determine line numbers of remaining dots (S385).

An interval k is initialized to k=0, and in order to determine the line number of the next dot, j is incremented by one (S386). The dot number is compared with the number $N_G(i)$ Of dots of the row i (S387). If $j<N_G(i)$, since dots whose lines are not determined remain, y-coordinates are compared to determine the lines (S388). Since the y-coordinate of the reference dot is $E_{py}$, and since dots are aligned in the vertical direction at every third dot positions in each row, the y-coordinate of the next dot is near $E_{py}+3kP_{ey}$, where k is the interval, and $P_{ey}$ is the y-standard pitch. Therefore, if the following relation is satisfied, the line of the dot is determined, and its line number is set to be $E_s(i,j)=S+3k$ (S391):

$$E_{ey}+3kP_{0y}-\delta_{ey}<E_y(i,j)<E_{py}+3kP_{ey}+\delta ey$$

In order to determine the line number of the next dot, the reference y-coordinate $E_{py}$ and the reference line number S are updated to $E_{py}=Ey(i,j)$ based on this dot (S385).

If it is determined in the y-coordinate comparison step (S388) that $E_{py}+3kP_{0y}+\delta_{ey}<E_y(i,j)$, since a dot is a lower dot, the interval is increased by one to set k=k+1 (S390), and thereafter, the y-coordinate comparison step (S388) is executed.

If $E_y(i,j)<E_{py}+3kP_{ey}-\delta_{ey}$, since the dot falls outside a predetermined range, the dot is determined as an invalid dot, and $E_s(i,j)=-1$ is set (S389). Thereafter, the line of the next dot is determined (S386).

When the line numbers are sequentially determined in the row, and the line of the last dot in the row is determined, $j>N_G(i)$ is satisfied in the dot number comparison step (S387), and the row number is incremented by one to determine the lines of the next row (S392). The row number i is compared with the total number $N_c$ of rows (S393). If $i<N_c$, a series of processing operations are performed for the remaining rows; if $i>N_c$, the processing is ended.

The processing for obtaining the above-mentioned lattice points on the basis of the dot data whose "lines" and "rows" are determined (S317 in FIG. 24) will be described below. A case of lattice points with indefinite row intervals will be exemplified below.

If a row number is represented by i, a dot number in a row is represented by n, and a line number of each dot is represented by j, $j=E_s(i,n)$, $P_x(i,j)=E_x(i,n)$, and $P_y(i,j)=E_y(i,n)$ in equations (20), (21), (22), and (23) in the description of the lattice point. If total sums of respective items of dots, which satisfy $E_s(i,n)<0$, of each row are defined as:

$S_n(i)$: the number of dots $S_J(i)$: total sum of line numbers (j)

$S_{JJ}(i)$: total sum of $j^2$ $S_x(i)$: total sum of x-coordinates $S_y(i)$: total sum of y-coordinates $S_{JX}(i)$: total sum of (line number)×(x-coordinate)

$S_{JY}(i)$: total sum of (line number)×(y-coordinate) then, equations (20) to (23) are rewritten as:

$$b_x=\frac{\Sigma\{S_{JX}(i)-S_J(i)\times S_Y(i)/S_n(i)\}}{\Sigma\{S_{JJ}(i)-S_J(i)^2/S_n(i)\}} \tag{20}$$

$$b_y=\frac{\Sigma\{S_{JX}(i)-S_J(i)\times S_Y(i)/S_n(i)\}}{\Sigma\{S_{JJ}(i)-S_J(i)^2/S_n(i)\}} \tag{21}$$

$$\hat{P}_x(i,0)=\{S_X(i)-S_J(i)\cdot b_x\}/S_n(i) \tag{22}$$

$$\hat{P}_y(i,0)=\{S_Y(i)-S_J(i)\cdot b_y\}/S_n(i) \tag{23}$$

Figure 37:
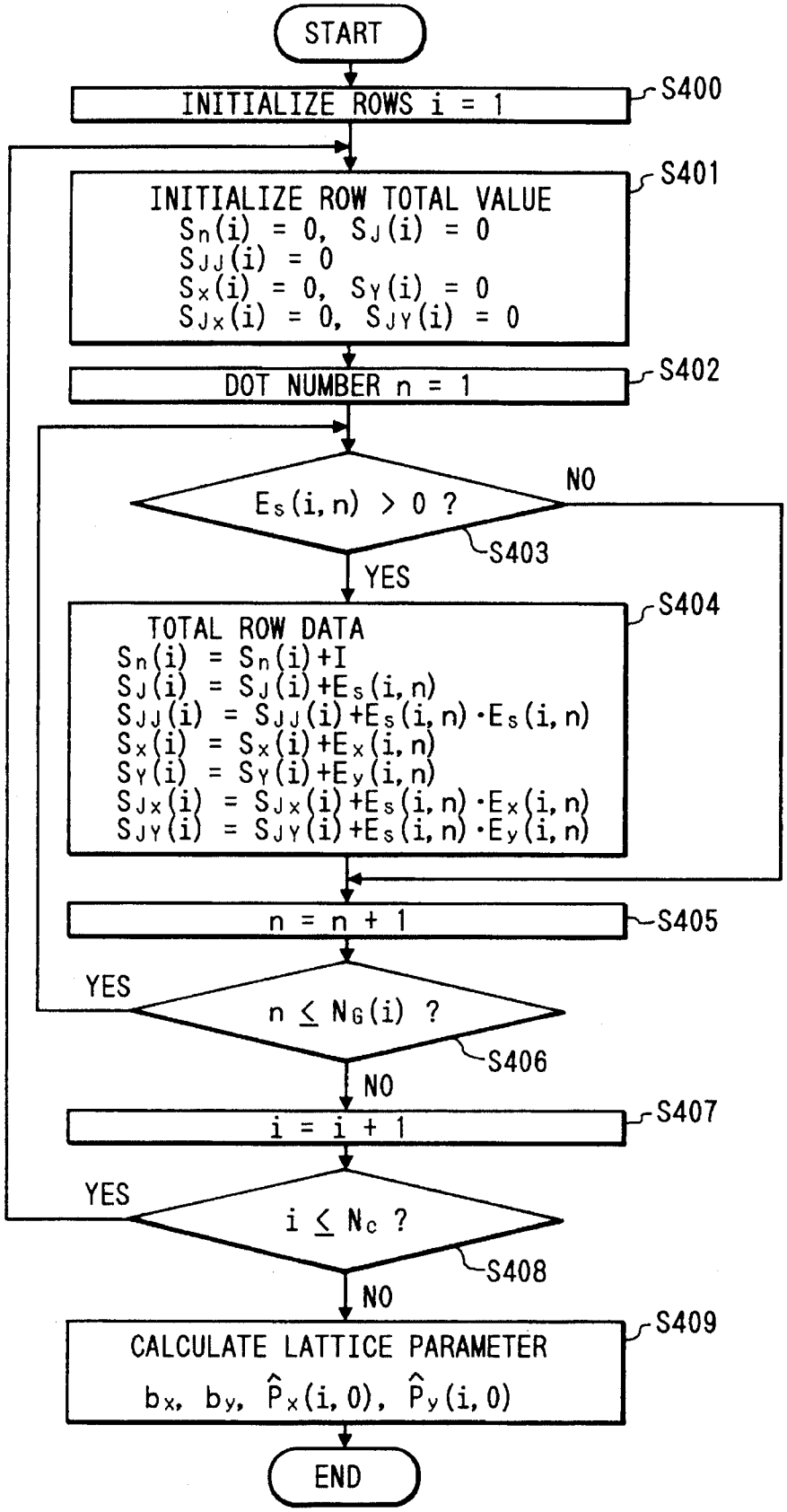
FIG. 37 is a flow chart of processing for obtaining a lattice constant.

FIG. 37 is a flow chart for obtaining lattice parameters $b_x$, $b_y$, $\hat{P}_x(i,0)$, and $\hat{P}_y(i,0)$ according to equations (20) to (23).

In order to sequentially execute processing in units of rows, a row number i is initialized to i=1 (S400), and the total sums $S_n(i)$, $S_J(i)$, $S_{JJ}(i)$, $S_X(i)$, $S_Y(i)$, $S_{JX}(i)$, and $S_{JY}(i)$ of the respective items of the row i are initialized to 0 (S401).

In order to sequentially add dot data in the row, a dot number n is initialized to n=1 (S402), and it is checked if a dot $e_{in}$ is a valid dot (S403).

If $E_s(i,n)>0$, since a dot under consideration is a valid dot whose line number is determined, additions of the respective items are performed as follows:

$S_n(i)=S_n(i)+1$: the number of dots $S_J(i)=S_J(i)+E_s(i,n)$: line number $S_{JJ}(i)=S_{JJ}(i)+E_s(i,n)\cdot E_s(i,n)$: (line number)$^2$ $S_X(i)=S_X(i)+E_X(i,n)$: x-coordinate $S_Y(i)=S_Y(i)+E_Y(i,n)$: y-coordinate $S_{JX}(i)=S_{JX}(i)+E_s(i,n)\cdot E_X(i,n)$: (line number)× (x-coordinate)

$S_{JY}(i)=S_{JY}(i)+E_s(i,n)\cdot E_Y(i,n)$: (line number)×(y-coordinate)

If $E_s(i,n)<0$, since a dot under consideration is an invalid dot, additions are not performed.

In order to add the next dot data, the dot number n is incremented by one (S405), and the dot number n is compared with the number $N_G(i)$ of dots in the row (S406). If $n\leqq N_G(i)$, since dot data which are not added remain, the flow returns to step S403 to repeat the series of processing operations.

If $n>N_G(i)$, the row number i is incremented by one to perform the processing of the next row (S407), and the row number i is compared with the total number $N_c$ of the rows (S408). If $i\leqq N_c$, since non-processed rows remain, the flow returns to step S401, and the series of processing operations are executed. If $i>N_c$, since the total sums of the respective items of all the rows are obtained, lattice parameters $b_x$, $b_y$, $\hat{P}_x(i,0)$, and $\hat{P}_y(i,0)$ are calculated according to equations (20) to (23).

The processing for calculating an estimated value for discriminating a normal or defective head on the basis of the dot data whose "lines" and "rows" are determined, and the lattice point data (S318 in FIG. 24) will be described below.

More specifically, the processing for calculating an estimated value consists of the shift amount calculation step of calculating a shift amount of each dot position from the corresponding lattice point, the total step of totaling the shift amounts from the lattice points and dot diameters in units of lines, and the estimated value calculation step of calculating a final estimated value.

Figure 38:
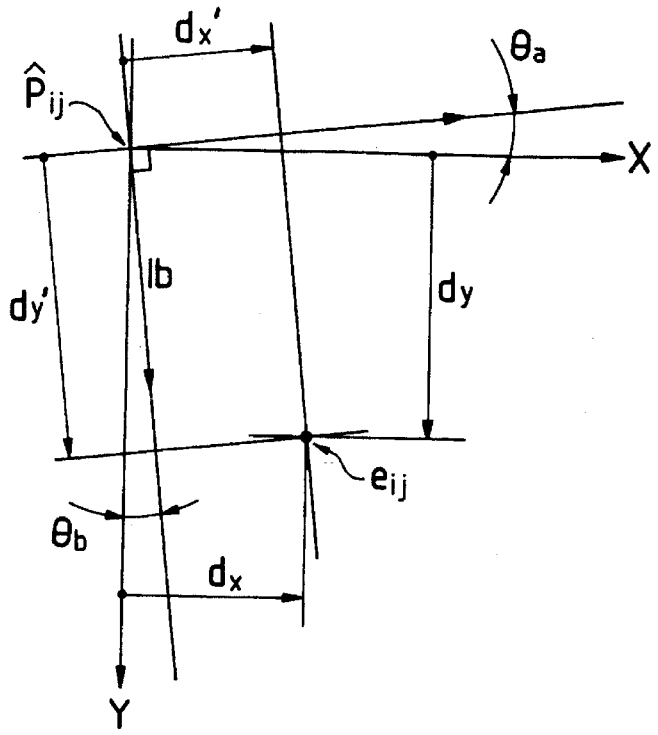
FIG. 38 is a view for explaining a shift amount of a dot from a lattice point.

FIG. 38 is a view for explaining a shift amount of a dot from the lattice point. In FIG. 38, a and b represent vectors representing the lattice pitches (when the row interval is indefinite, a is a vector perpendicular to b), X and Y represent coordinate axes upon measurement of dot positions, $\theta_a$ and $\theta_b$ represent angles respectively defined between a and b, and the X and Y axes, $\hat{P}_{ij}$ represents a lattice point, and $e_{ij}$ represents a dot.

As a shift amount between the lattice point $\hat{P}_{ij}$ and the dot $e_{ij}$, $d_x'$ and $d_y'$ obtained at a position defined by projecting the dot $e_{ij}$ onto the vectors a and b are used as a precise amount. However, $d_x$ and $d_y$ obtained on the coordinate system used in the measurement of the dot positions, which system provides small $\theta_a$ and $\theta_b$, are almost equal to $d_x'$ and $d_y'$. Thus, $d_x$ and $d_y$ requiring only a small calculation amount are determined as a shift amount.

When a row to which dots belong is represented by i, and a dot number in each row is represented by n, shift amounts $d_x$ and $d_y$ are respectively given by:

$$d_x(i,j)=E_x(i,n)-\{\hat{P}_x(i,0)+j\cdot b_x\}$$

$$d_y(i,j)=E_y(i,n)-\{\hat{P}_y(i,0)+j\cdot b_y\}$$

(for $j=E_s(i,n)$)

The shift amounts $d_x(i,j)$ and $d_y(i,j)$, and the dot diameters $E_n(i,j)$ are totaled in units of lines to calculate average values, standard deviations, maximum values, and minimum values. At this time, when measurement values are randomly distributed to the image processing devices 1 (111) and 2 (112), data transfer processing for combining the measurement values is required. When the shift amounts and dot diameters in units of dots are directly transferred, the transfer processing becomes undesirably complicated due to a variation in the number of dots due to the absence of dots. For this reason, each image processing device obtains the numbers of dots, the total sums of the measurement values, the total sums of square values of the measurement values, the maximum values, and the minimum values in units of lines, and then transfers these data. More specifically, when the numbers of dots in the image processing devices 1 (111)

and 2 (112) for a given measurement value $\alpha$ are represented by $N_1$ and $N_2$, the total sums of the measurement values are represented by $$S_{1\alpha}(j)=\sum_i \alpha_{ij}$$

and $$S_{2\alpha}(j)=\sum_i \alpha_{ij},$$

the total sums of square values are represented by $$S_{1\alpha\alpha}(j)=\sum_i \{\alpha_{ij}\}^2$$

and $$S_{2\alpha\alpha}(j)=\sum_i \{\alpha_{ij}\}^2,$$

maximum values are represented by Max1$\{\alpha_{ij}\}$ and Max2$\{\alpha_{ij}\}$, and minimum values are represented by Min1$\{\alpha_{ij}\}$ and Min2$\{\alpha_{ij}\}$, an average value $\bar{\alpha}$, a standard deviation $\sigma_\alpha$, a maximum value Max($\alpha$), and a minimum value Min($\alpha$) upon data combination are respectively calculated by:

$$\bar{\alpha}=(S_{1\alpha}+S_{2\alpha})/(N_1+N_2)$$

$$\sigma_\alpha=\sqrt{\frac{S_{1\alpha\alpha}+S_{2\alpha\alpha})-2(S_{1\alpha}S_{2\alpha})^2/(N_1+N_2)+(S_{1\alpha}+S_{2\alpha})/(N_1+N_2)\}^2}{N_1+N_2-1}}$$

Max($\alpha$)=larger one of Max1$\{\alpha_{ij}\}$ and Max2$\{\alpha_{ij}\}$

Min($\alpha$)=smaller one of Min1$\{\alpha_{ij}\}$ and Min2$\{\alpha_{ij}\}$

Thus, the data transfer processing can be performed based on the fixed length. In addition, since the intermediate calculation results can be independently processed by the two devices, processing can be performed at higher speed than in a case wherein the measurement values are directly transferred.

In the processing data total step (S225 in FIG. 19) of the image processing device 2 (112), processing for obtaining $N_2$, $S_{2\alpha}$, $S_{2\alpha\alpha}$, Max2$\{\alpha_{ij}\}$, and Min2$\{\alpha_{ij}\}$ is performed, and in the total data transmission step (S226), these data are transferred to the image processing device 1 (111). On the other hand, the image processing device 1 (111) receives the data from the image processing device 2 (112), and thereafter, totals its own data. Then, the image processing device 1 (111) combines the data obtained by the two devices, and calculates the average values, the standard deviations, the maximum values, and the minimum values in units of items.

With the above processing, since the average values, the standard deviations, the maximum values, and the minimum values of the respective measurement items (the shift amounts and the dot diameter) in units of lines can be obtained, estimated values are calculated using these values.

The first item of the estimated values is the number N of lines. The number N of lines is the number of lines each including dots, the number of which is equal to or larger than a predetermined value $\delta_n$. When $N(j)<\delta_n$, the corresponding line is determined as an absent line. The number of absent lines can be determined based on the number N of lines.

The second item of the estimated values is the dot diameter. In this case, the average value $\bar{R}=\Sigma\bar{r}(j)/N$, the maximum value $R_{max}=\text{Max}[\bar{r}(j)]$, and the minimum value $R_{min}=\text{Min}[\bar{r}(j)]$ are calculated using the average values $\bar{r}(j)$ of the dot diameters in units of lines. With these values, the evenness of the dot diameters can be estimated.

The third item of the estimated values is the variation in dot diameter. In this case, the average value $\sigma_R=\Sigma\sigma_r(j)/N$ and the maximum value $\sigma_{Rmax}=\text{Max}[\sigma_r(j)]$ are calculated using the standard deviations $\sigma_r(j)$ of the dot diameters of the respective lines. Thus, the stability of the dot diameters can be estimated.

Figure 39A:
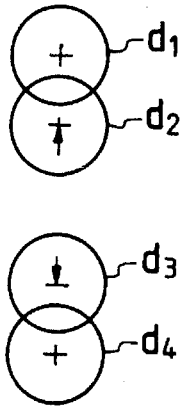
FIGS. 39A and 39B are views for explaining adjacent shift amounts.
Figure 39B:
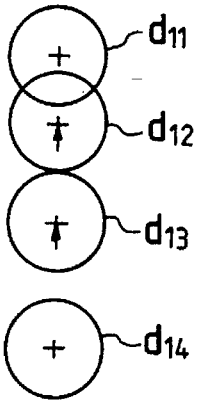

The fourth item of the estimated values is the adjacent shift amount. The adjacent shift amount will be described below with reference to FIGS. 39A and 39B. In FIGS. 39A and 39B, $d_1$ to $d_4$ and $d_{11}$ to $d_{14}$ represent dots, a "+" mark represents the central position of each dot, and an arrow represents a shift amount from the corresponding lattice point. When dots are estimated based on the shift amounts from the lattice points, the dots shown in FIGS. 39A and 39B have the same shift amount. However, in an actual pattern, the dots shown in FIG. 39A seem to have a large shift amount. This is because the dots $d_2$ and $d_3$ have different shift directions. More specifically, in an actual pattern, a shift amount between adjacent dots is a problem rather than the shift amount from the lattice point.

Thus, adjacent shift amounts $nx(i)=\bar{d}x(i+1)-\bar{d}x(i)$, and $ny(i)=\bar{d}y(i+1)-\bar{d}y(i)$ are calculated using the average values $\bar{d}x(i)$ and $\bar{d}y(i)$ of the shift amounts of the dot positions from the lattice points in units of lines. Based on these adjacent shift amounts, the overall standard deviations $$D_x=\sqrt{\sum_i \{nx(i)-\bar{n}x\}^2/N} \quad \text{and}$$

$$D_y=\sqrt{\sum_i \{ny(i)-\bar{n}y\}^2/N},$$

the maximum values $D_{xmax}=\text{Max}[nx(i)]$ and $D_{ymax}=\text{Max}[ny(i)]$, and the minimum values $D_{xmin}=\text{Min}[nx(i)]$ and $D_{ymin}=\text{Min}[ny(i)]$ are calculated. With these values, the evenness of the dot positions can be estimated.

The fifth item of the estimated values is the variation in dot position. In this case, the average values $\sigma_X=\Sigma\sigma_{dx}(j)/N$ and $\sigma_Y=\Sigma\sigma_{dy}(j)/N$, and the maximum values $\sigma_{Xmax}=\text{Max}[\sigma_{dx}(j)]$ and $\alpha_{Ymax}=\text{Max}[\sigma_{dy}(j)]$ are calculated using the standard deviations $\sigma_{dx}(j)$ and $\sigma_{dy}(j)$ of the shift amounts of the dot positions from the lattice points in units of lines. Thus, the stability of the dot positions can be estimated.

The sixth item of the estimated values is the row maximum shift amount. In this case, the row maximum shift amount is calculated using the maximum and minimum values of the shift amounts from the lattice point in the x-direction by the following equation:

$$X_{max}=Max[\bar{d}_x(i)]-Min[\bar{d}_x(i)]$$

Figure 40:
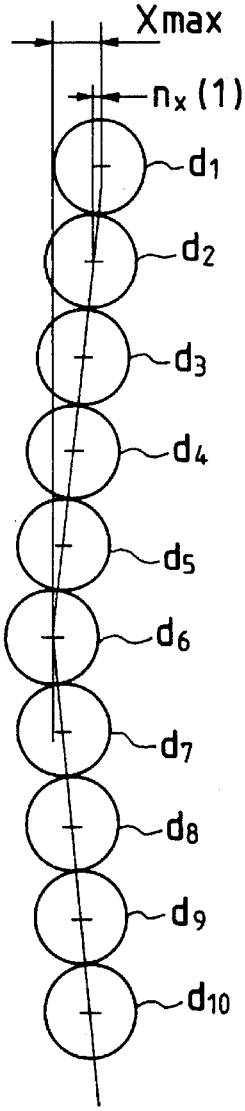
FIG. 40 is a view for explaining a shift amount from a lattice point in the x-direction.

As shown in FIG. 40, this value is used for estimating a case wherein shift amounts between adjacent dots are small, but a shift amount of the overall row is large.

The image processing device 1 (111) calculates the above-mentioned estimated value, and transmits the measurement results to the main CPU 100.

Upon reception of the measurement results, the main CPU 100 compares the data of the respective items with predetermined standard values to discriminate a normal or defective head.

Figure 41:
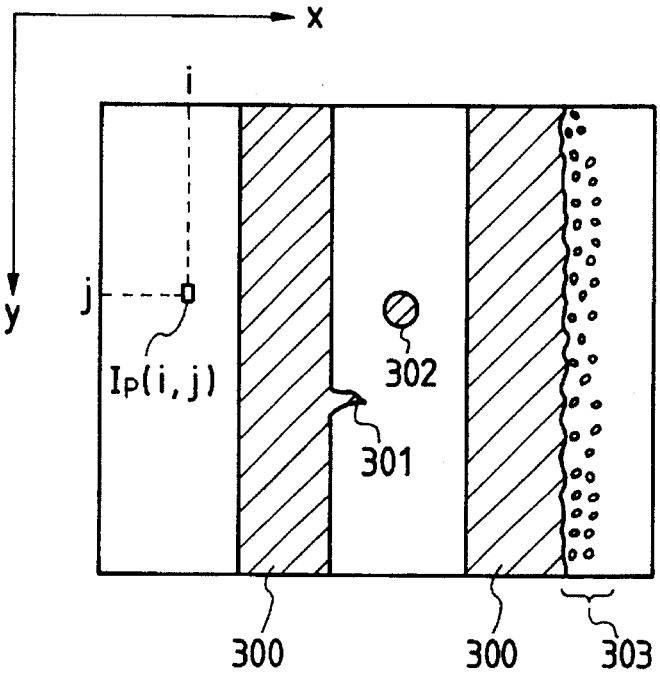
FIG. 41 is a view for explaining a pattern including stains by a scattered dot.

Processing for detecting a stain caused by scattered dots as another image processing performed in the image processing devices 1 (111) and 2 (112) will be described below. FIG. 41 shows an example of "stains" detected by this processing.

FIG. 41 illustrates vertical line patterns 300, a projection-like stain 301 contiguous to the vertical line pattern, a stain 302 isolated from the vertical line pattern, and stains 303 including projection-like stains and isolated stains which are present near the vertical line pattern over a wide range. That is, FIG. 41 illustrates a state wherein the pattern including these stains is scanned by the image processing devices 1 and 2 as a digital image, and the density value at x=i and y=j is expressed as $I_p(i,j)$.

Figure 42:
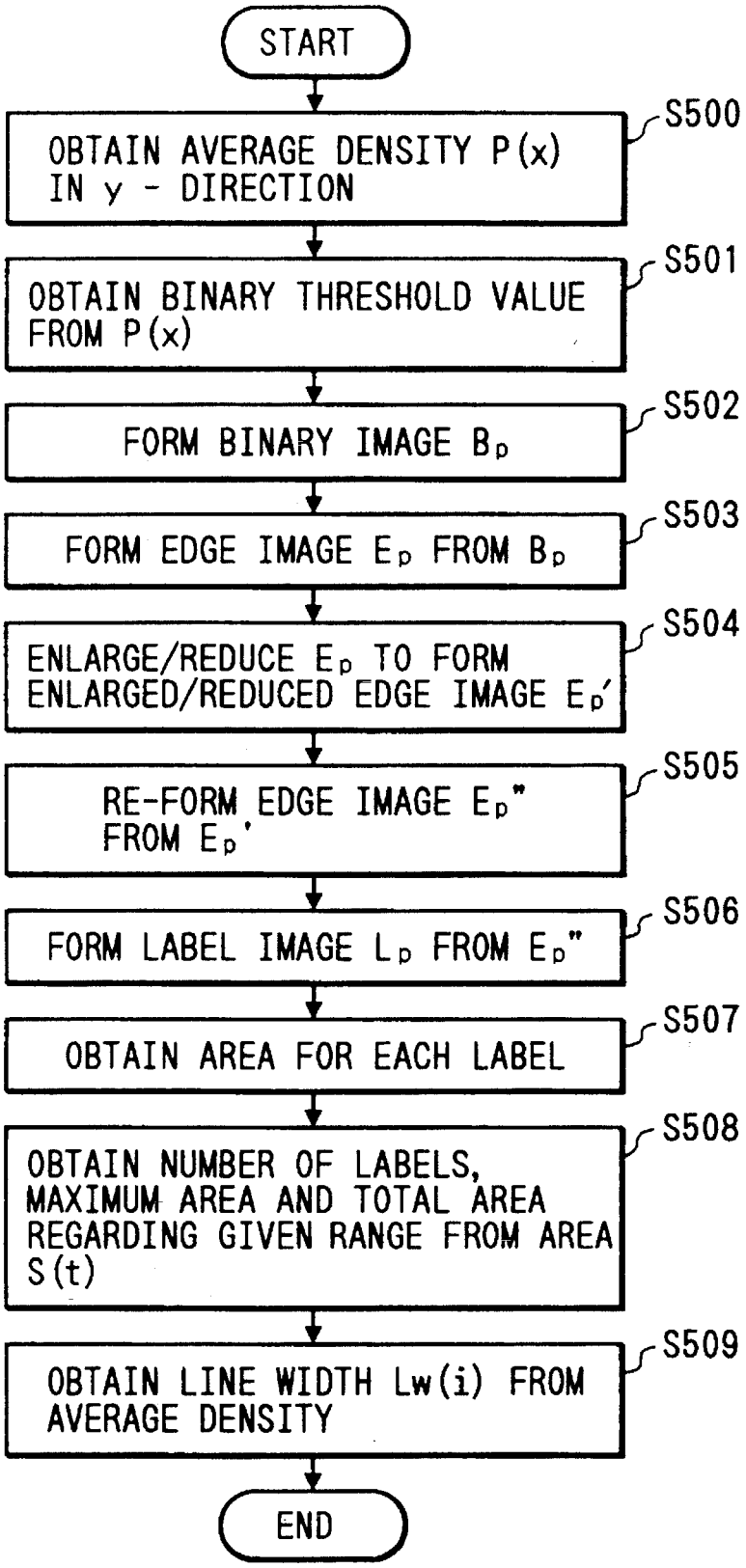
FIG. 42 is a flow chart of stain detection processing.

FIG. 42 is a flow chart showing the stain detection processing.

Figure 43:
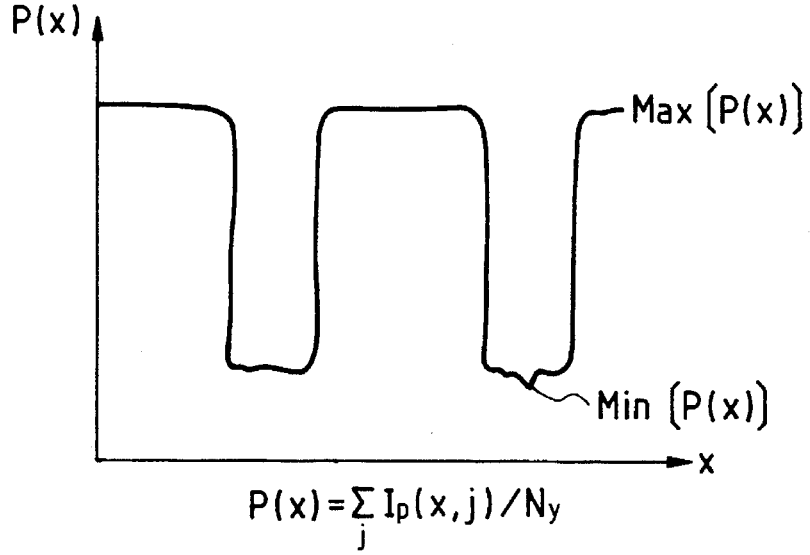
FIG. 43 is a view showing data in the stain detection processing.

The first step is the step (S500) of obtaining an average density P(x) in the y-direction from a digital image $I_p(i,j)$. P(x) is an average value of $I_p(i,j)$ for i=x. With this processing, one-dimensional data shown in FIG. 43 is obtained (S500).

The second step is the step (S501) of obtaining a threshold value $T_1$ for generating a binary image on the basis of the average density P(x). The maximum value Max[P(x)] of P(x) represents a sheet surface density, and its minimum value Min[P(x)] represents a pattern portion density. Thus, the threshold value T for separating a sheet surface and a pattern is calculated by T=Min[P(x)]+t{Max[P(x)]−Min[P(x)]} using a predetermined value $t_1$ which satisfies $0<t_1<1$.

The third step is the step (S502) of generating a binary image $B_p(i,j)$ on the basis of the threshold value $T_1$ calculated in the second step (S501).

Figure 44:
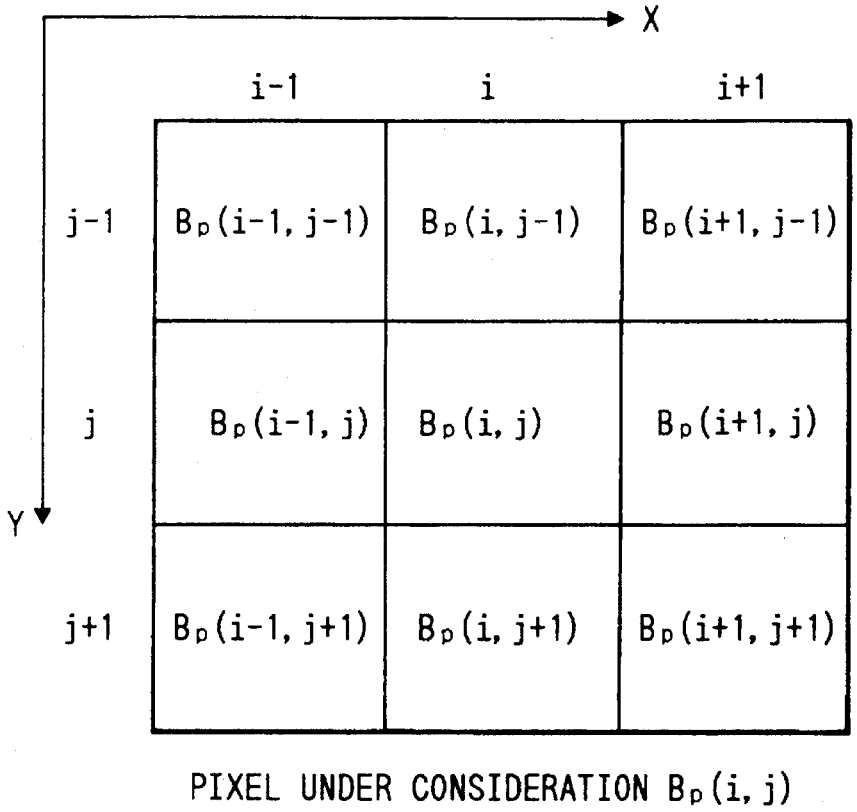
FIG. 44 is a view for explaining processing for obtaining an edge image.

The fourth step is the step (S503) of obtaining an edge image $E_p(i,j)$ from the binary image $B_p(i,j)$. In order to form the edge image $E_p(i,j)$, processing given by the following equation is performed using a 3×3 pixel matrix having a pixel under consideration as the central pixel, as shown in FIG. 44:

$$E_p(i,j)=\begin{cases} 1: & \text{when } B_p(i,j)=1\text{, and at least one pixel of remaining eight pixels is 0} \\ 0: & \text{when } B_p(i,j)=0\text{, or all the nine pixels are 1} \end{cases}$$

Figure 45:
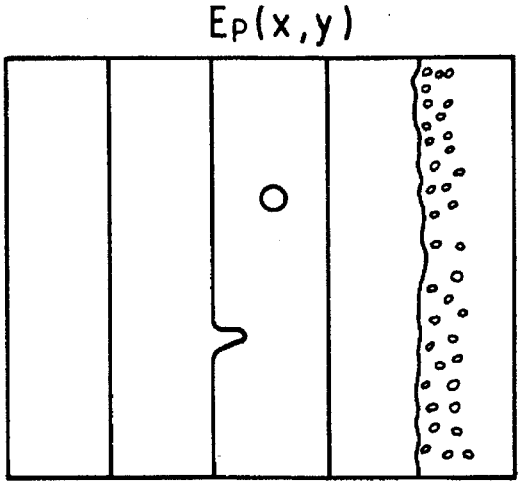
FIG. 45 is a view showing an edge image.

With this processing, an edge image as shown in FIG. 45 can be obtained.

Figure 46:
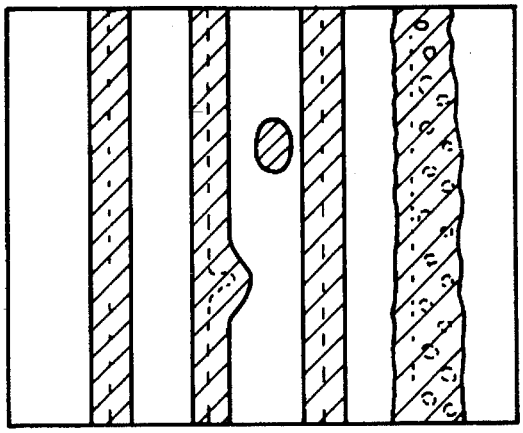
FIG. 46 is a view showing an image obtained by enlarging an edge image.
Figure 47:
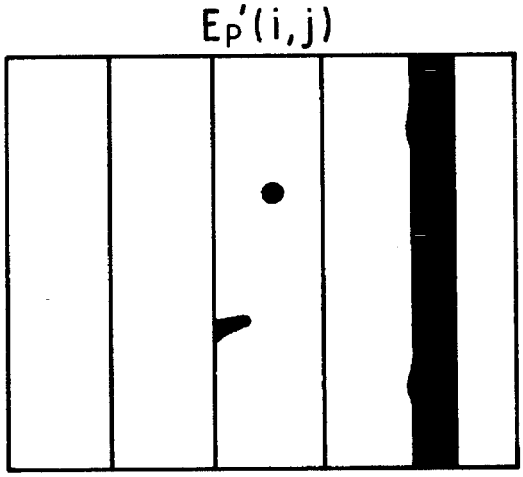
FIG. 47 is a view showing an image obtained by reducing the enlarged edge image.

The fifth step is processing (S504) for separating a stain portion and a pattern by an enlargement or reduction processing operation of the edge image $E_p$. The enlargement or reduction processing operation can be realized by logical arithmetic processing using the 3×3 pixel matrix shown in FIG. 44. When the enlargement processing of the edge image $E_p(i,j)$ is performed, the line width is increased, as shown in FIG. 46. In FIG. 46, hatched portions indicate lines whose line widths are increased. When the reduction processing is performed for this image, an image as shown in FIG. 47 is obtained. With this processing, a portion free from a stain is restored to the same image as that shown in FIG. 45. However, a portion including stains remains not a line but a plane, as indicated by a black-painted portion in FIG. 47.

Figure 48:
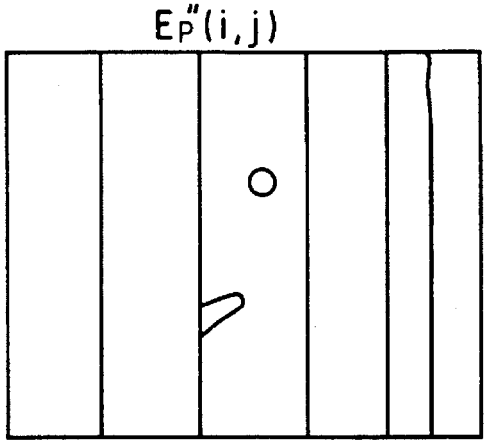
FIG. 48 is a view showing an image obtained by performing another edge processing after the enlargement or reduction processing operation.

In the sixth step, the same edge processing as in the fourth step is performed again for an enlarged or reduced edge image $E_p'(i,j)$ (S505). Since the stain portion is converted into a plane, an edge is formed between the pattern portion and the stain portion by the edge processing, and the pattern portion and the stain portion are separated, thus obtaining an image, as shown in FIG. 48.

Figure 49:
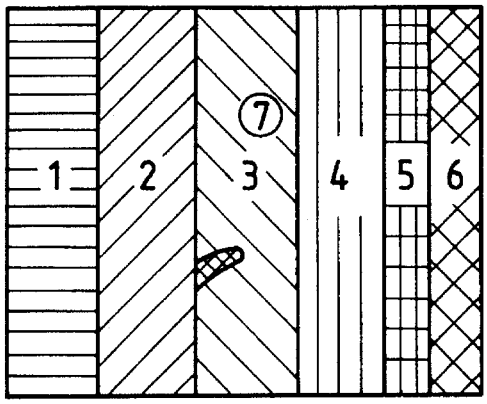
FIG. 49 is a view showing the relationship between areas and labels of the image shown in FIG. 48.

In the seventh step, an edge image $E_p''(i,j)$ having an edge portion="1" and a plane portion="0" is reversed to generate an image including an edge portion="0" and a plane portion="1". The above-mentioned label assigning processing is performed for the generated image to obtain a label image $L_p(i,j)$ (S506). FIG. 49 illustrates a state wherein labels 1 to 8 are assigned to the image shown in FIG. 48.

The eighth step is the step (S507) of obtaining areas in units of labels, An area S(k) is the number of pixels given by $k=L_p(i,j)$ in the label image $L_p(i,j)$. The ninth step is the step (S508) of separating the pattern portion and the stain portion based on the areas S(k). Since the area of the portions of the projection-like stains and isolated stains is considerably smaller than that of the pattern portion, if the area of the stain portion is represented by $S_d(k)$ and the area of the pattern portion is represented by $S_d(k)$, the pattern portion and the stain portion can be separated by a predetermined value $\delta_s$ which satisfies $S_d(k)<\delta_s<<S_p(k)$.

Therefore, the number $N_d$ of labels satisfying $(Sk)<\delta_s$ is defined as the number of stains, the total sum $S_d$ of S(k) satisfying $(Sk)<\delta_s$ is defined as the area of stains, and the maximum value $S_{maxd}$ of S(k) satisfying $(Sk)<\delta_s$ is defined as the maximum stain. Thus, these values are used as estimated values of projection-like stains and isolated stains.

Since the stains 303 present near the pattern do not have a large area difference from the pattern portion as in label 5 in FIG. 49, it is difficult to separate these stains based on the area. Thus, in the tenth step, a pattern width is obtained based on the average density P(x) in the y-direction, thereby detecting stains present near the pattern portion (S509).

Figure 50:
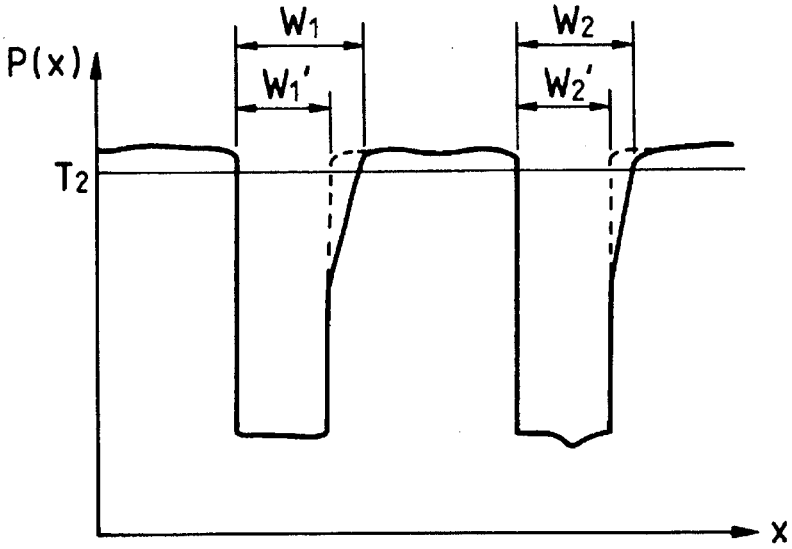
FIG. 50 is a view showing an average density when a stain is present near a pattern.

FIG. 50 shows the average density P(x) obtained when stains are present near a pattern. A solid line represents a case wherein stains are present, and a broken line represents a case wherein no stains are present. When stains are present, the average density of the corresponding portion is decreased. When pattern widths $W_1$ and $W_2$ are obtained using a threshold value $T_2$ near Max[P(x)], the widths are increased as compared to widths $W_1'$ and $W_2'$ obtained when no stains are present. Thus, these widths are used as estimated values of stains present near a pattern.

As described above, when the areas and widths are obtained as estimated values, stains can be estimated.

What is claimed is:

1. A testing apparatus for testing a printing device on the basis of a test pattern recorded on a recording medium by the printing device, said apparatus comprising:

holding means for holding the printing device;

driving means for driving the printing device held by said holding means to record the test pattern on the recording medium;

measurement means for measuring the test pattern recorded on the recording medium by the printing device;

data generating means for generating data for judgment of the printing device on the basis of a measurement result by said measurement means; and changing means for exchanging the printing device with another printing device during a measurement of the test pattern by said measurement means, the printing device being released from the holding thereof by said holding means after the printing device records the test pattern.

2. An apparatus according to claim 1, wherein said holding means comprises first and second holding portions, and moving means capable of moving said first and second holding portions between a printing position of the test pattern and a changing position of the printing device, and said changing means allows the changing operation of the printing device to said second holding portion at the changing position during a measurement of the test pattern recorded by the printing device held by said first holding portion.

3. An apparatus according to claim 2, wherein said moving means comprises a rotary table or a reversal table.

4. An apparatus according to claim 2, wherein each of said first and second holding portions comprises fixing means for fixing the printing device.

5. An apparatus according to claim 4, wherein said changing means comprises release means for releasing a fixed state of the printing device by said fixing means.

6. An apparatus according to any one of claims 1 to 5, wherein the printing device comprises a recording head which discharges an ink droplet by causing a change in state of an ink by energy generated by an energy generation element.

7. An apparatus according to claim 6, wherein said energy generation element generates heat energy, and causes the change in state of the ink by generating a bubble by the heat energy.

8. A testing apparatus for testing a printing device on the basis of a test pattern recorded on a recording medium by the printing device, said apparatus comprising:

holding means for holding the printing device;

driving means for driving the printing device held at a recording position by said holding means to record the test pattern on the recording medium;

moving means for moving the recording medium relative to the printing device when the test pattern is printed;

measurement means for measuring the test pattern recorded on the recording medium at a predetermined measurement position, said measurement means measuring the test pattern while said measurement means is moved relative to the recording medium on a reciprocating basis;

release means for releasing the printing device from the holding condition by said holding means after the printing device records the test pattern; and processing means for obtaining test data for judging the printing device by means of practicing a predetermined operation processing of image data of the test pattern measured by said measurement means.

9. An apparatus according to claim 8, further comprising recording medium holding means for holding the recording medium, wherein said recording medium holding means comprises a supply reel for supplying a roll of the recording medium to the printing position, a rotatable take-up reel for taking up a printed recording medium, and support means for supporting said supply reel and said take-up reel.

10. An apparatus according to claim 9, wherein said moving means comprises first driving means for moving said support means, and second driving means for pivoting said take-up reel, causes said first driving means to move said support means when the test pattern is printed, and causes said second driving means to perform movement to the next printing position of the test pattern.

11. An apparatus according to claim 10, wherein after the test pattern is printed, said first driving means moves said support means from the printing position to the measurement position.

12. An apparatus according to any one of claims 9 to 10, wherein said recording medium holding means comprises inhibition means for inhibiting movement of the recording medium at the printing position.

13. An apparatus according to claim 12, wherein the printing device comprises a recording head which discharges an ink droplet by causing a change in state of an ink by energy generated by an energy generation element.

14. An apparatus according to claim 13, wherein said energy generation element generates heat energy, and causes the change in state of the ink by generating a bubble by the heat energy.

15. An apparatus according to any one of claims 8 to 10 and 11, wherein the printing device comprises a recording head which discharges an ink droplet by causing a change in state of an ink by energy generated by an energy generating element.

16. An apparatus according to claim 15, wherein said energy generation element generates heat energy, and causes the change in state of the ink by generating a bubble by the heat energy.

17. A testing method of testing a printing device on the basis of a test pattern recorded on a recording medium by the printing device which is adapted to record a dot image, said method comprising the steps of:

forming the test pattern consisting of a plurality of dot images in which the dot images are arranged so as not to contact each other on the recording medium, using the printing device to be tested;

picking up an image of the test pattern formed in the forming step with an image pick-up device, and converting the picked up image into image data;

extracting a plurality of amounts of dot characters each representing at least one of a dot pattern and dot shape or size from the image data obtained in the image pick-up step;

calculating pattern estimated values representing a state of the test pattern according to the dot character amounts in units of dots obtained in the extracting step;

judging, using the pattern estimated values obtained in the calculating step, whether or not the printing device to be tested is normal; and informing of a discrimination result determined in the judging step.

18. A method according to claim 17, wherein each dot image has a plurality of dot character amounts.

19. A method according to claim 17 or 18, wherein a central position of each dot image is used as the dot character amount.

20. A method according to claim 19, wherein a position of a center of gravity is used as the central position of dot image.

21. A method according to claim 20, wherein the printing device to be tested is an ink-jet type recording head.

22. A method according to claim 21, wherein the recording head discharges an ink droplet by causing a change in state of an ink using heat energy.

23. A method according to claim 19, wherein the printing device to be tested has a plurality of elements for outputting the dot images, and the ideal dot position is a lattice point position obtained by a least square method on the basis of a dot interval in an aligning direction of the elements.

24. A method according to claim 19, wherein the printing device to be tested is an ink-jet type recording head.

25. A method according to claim 24, wherein the recording head discharges an ink droplet by causing a change in state of an ink using heat energy.

26. A method according to claim 17 or 18, wherein a shift amount from an ideal position as a difference between an ideal dot position and an actual dot position is used as the dot character amount.

27. A method according to claim 26, wherein the printing device to be tested has a plurality of elements for outputting the dot images, and the ideal dot position is a lattice point position obtained by a least square method on the basis of a dot interval in an aligning direction of the elements 28. A method according to claim 26, wherein the printing device to be tested is an ink-jet type recording head.

29. A method according to claim 28, wherein the recording head discharges an ink droplet by causing a change in state of an ink using heat energy.

30. A method according to claim 17 or 18, wherein the printing device to be estimated has a plurality of elements for outputting the dot images, and the ideal dot position is a lattice point position obtained by a least square method on the basis of a dot interval in an aligning direction of the elements.

31. A method according to claim 30, wherein the printing device to be tested is an ink-jet type recording head.

32. A method according to claim 31, wherein the recording head discharges an ink droplet by causing a change in state of an ink using heat energy.

33. A method according to claim 17 or 18, wherein a dot diameter is used as the dot character amount.

34. A method according to claim 33, wherein the printing device to be tested is an ink-jet type recording head.

35. A method according to claim 34, wherein the recording head discharges an ink droplet by causing a change in state of an ink using heat energy.

36. A method according to claim 33, wherein the dot diameter is an equivalent dot diameter calculated based on a dot area.

37. A method according to claim 17 or 18, wherein the printing device to be tested is an ink-jet type recording head.

38. A method according to claim 37, wherein the recording head discharges an ink droplet by causing a change in state of an ink using heat energy.

39. A testing apparatus for testing a printing device on the basis of a test pattern recorded on a recording medium by the printing device which is adapted to record a dot image, said apparatus comprising:

image input means for picking up an image of the test pattern on the recording medium consisting of a plurality of dots printed by the printing device to be tested, in which dots are arranged so as not to contact each other, and for converting the picked up image into image data;

character amount extracting means for extracting an amount of dot character representing at least one of a dot pattern and dot shape or size of each dot based on the image data obtained from said image input means; and pattern estimated value calculation means for calculating pattern estimated values representing a state of the test pattern according to the dot character amounts in units of dots, which dot character amounts are extracted by said character amount extracting means, wherein said apparatus determines whether the printing device to be tested is normal, using the pattern estimated value.

40. An apparatus according to claim 39, wherein each dot has a plurality of dot character amounts.

41. An apparatus according to claim 39 or 40, wherein a central position of the dot is used as the dot character amount.

42. An apparatus according to claim 41, wherein a position of a center of gravity is used as the central position of the dot.

43. An apparatus according to claim 42, wherein the printing device to be tested is an ink-jet type recording head.

44. An apparatus according to claim 43, wherein the recording head discharges an ink droplet by causing a change in state of an ink using heat energy.

45. An apparatus according to claim 41, wherein the printing device to be tested has a plurality of elements for outputting the dots, and the ideal dot position is a lattice point position obtained by a least square method on the basis of a dot interval in an aligning direction of the elements.

46. An apparatus according to claim 45, wherein the printing device to be tested is an ink-jet type recording head.

47. An apparatus according to claim 46, wherein the recording head discharges an ink droplet by causing a change in state of an ink using heat energy.

48. An apparatus according to claim 41, wherein the printing device to be tested is an ink-jet type recording head.

49. An apparatus according to claim 48, wherein the recording head discharges an ink droplet by causing a change in state of an ink using heat energy.

50. An apparatus according to claim 39 or 40, wherein a shift amount from an ideal position as a difference between an ideal dot position and an actual dot position is used as the dot character amount.

51. An apparatus according to claim 50, wherein the printing device to be tested has a plurality of elements for outputting the dots, and the ideal dot position is a lattice point position obtained by a least square method on the basis of a dot interval in an aligning direction of the elements.

52. An apparatus according to claim 51, wherein the printing device to be tested is an ink-jet type recording head.

53. An apparatus according to claim 52, wherein the recording head discharges an ink droplet by causing a change in state of an ink using heat energy.

54. An apparatus according to claim 50, wherein the printing device to be tested is an ink-jet type recording head.

55. An apparatus according to claim 54, wherein the recording head discharges an ink droplet by causing a change in state of an ink using heat energy.

56. An apparatus according to claim 39 or 40, wherein the printing device to be tested has a plurality of elements for outputting the dots, and the ideal dot position is a lattice point position obtained by a least square method on the basis of a dot interval in an aligning direction of the elements.

57. An apparatus according to claim 56, wherein the printing device to be tested is an ink-jet type recording head.

58. An apparatus according to claim 57, wherein the recording head discharges an ink droplet by causing a change in state of an ink using heat energy.

59. An apparatus according to claim 39 or 40, wherein a dot diameter is used as the dot character amount.

60. An apparatus according to claim 57, wherein the dot diameter is an equivalent dot diameter calculated based on a dot area.

61. An apparatus according to claim 59, wherein the printing device to be tested is an ink-jet type recording head.

62. An apparatus to claim 61, wherein the recording head discharges an ink droplet by causing a change in state of an ink using heat energy.

63. An apparatus according to claim 39 or 40, wherein the printing device to be tested is an ink-jet type recording head.

64. An apparatus according to claim 63, wherein the recording head discharges an ink droplet by causing a change in state of an ink using heat energy.

65. A testing method of testing a printing device on the basis of a test pattern recorded on a recording medium by the printing device, said method comprising the steps of:

forming the test pattern on the recording medium using a printing device to be estimated;

picking up an image of the test pattern formed in the forming step using an image pick-up device, and storing density image data obtained by said image pick-up device;

generating a first edge image based on the density image data obtained in the image pick-up step;

performing enlargement/reduction processing of the first edge image obtained in the first edge image generating step to generate a second edge image; performing edge extraction processing of the second edge image obtained in the enlargement/reduction performing step to generate a third edge image;

extracting shape character values in units of areas separated by edge lines in the third edge image; and determining, based on the shape character values, whether or not the printing device to be tested is normal.

66. A method according to claim 65, further including, before the step of generating the first edge image, the steps of:

measuring a line width based on an average density; and detecting a stain based on the line width and the shape character values and judging whether or not the printing device to be estimated is normal.

67. A method according to claim 65 or 66, wherein the printing device to be tested is an ink-jet type recording head.

68. A method according to claim 67, wherein the recording head discharges an ink droplet by causing a change in state of an ink using heat energy.

69. A testing method of testing a printing device on the basis of a test pattern recorded on a recording medium by the printing device, said method comprising the steps of:

forming the test pattern in which straight lines are aligned at regular intervals on the recording medium by the printing device to be tested;

picking up an image of the test pattern formed in the forming step using an image pick-up device;

storing density image data obtained by said image pick-up device in the image pick-up step;

generating one-dimensional average density data in a line direction of the pattern on the basis of the density image data stored in the storing step;

measuring a line width on the basis of the average density data obtained in the generating step; and determining, based on the line width measured in the measuring step, whether or not the printing device to be tested is normal.

70. A method according to claim 69, wherein the printing device to be tested is an ink-jet type recording head.

71. A method according to claim 70, wherein the recording head discharges an ink droplet by causing a change in state of an ink using heat energy.

72. A testing apparatus for testing a printing device on the basis of a test pattern recorded on a recording medium by the printing device, said apparatus comprising:

image pick-up means for reading the test pattern drawn by a printing device to be tested;

storage means for storing density image data corresponding to the test pattern output from said image pick-up means;

first edge extraction means for generating first edge image on the basis of the density image data;

processing means for generating a second edge image by performing enlargement/reduction processing for the first edge image generated by said first edge extraction means;

second edge extraction means for generating a third edge image by performing edge extraction processing for the second edge image generated by said processing means; and calculation means for calculating shape character values in units of areas separated by edge lines in the third edge image generated by said second edge extraction means, wherein whether or not the printing device to be estimated is normal is determined on the basis of the shape character values.

73. An apparatus according to claim 72, wherein the printing device to be tested is an ink-jet type recording head.

74. An apparatus according to claim 73, wherein the recording head discharges an ink droplet by causing a change in state of an ink using heat energy.

75. A test apparatus for testing a printing device on the basis of a test pattern recorded on a recording medium by the printing device, said apparatus comprising:

image pick-up means for reading a test pattern drawn by the printing device to be tested;

storage means for storing density image data corresponding to the test pattern output from said image pick-up means; and processing means for obtaining one-dimensional average density data from the density image data stored in said storage means, and obtaining data associated with a line width on the basis of the average density data, wherein whether or not the printing device to be tested is normal is determined on the basis of the data associated with the line width.

76. An apparatus according to claim 75, wherein the printing device to be tested is an ink-jet type recording head.

77. An apparatus according to claim 76, wherein the recording head discharges an ink droplet by causing a change in state of an ink using heat energy.

78. A testing method of testing a printing device on the basis of a test pattern recorded on a recording medium by the printing device, said method comprising the steps of:

setting the printing device;

recording the test pattern on the recording medium by the printing device set in the printing device setting step;

measuring the test pattern recorded on the recording medium in the recording step;

generating data for estimation of the printing device on the basis of a measurement result in the measuring step;

releasing the printing device from the setting condition thereof after the test pattern is recorded; and setting another printing device during execution of said measuring step after execution of said release step.

79. A testing method according to claim 78, wherein a member having a plurality of setting positions to which printing devices are suitably set is moved so that the plurality of setting positions on the member correspond to a recording position for the test pattern and an exchanging position for printing devices.

80. A testing method according to claim 79, wherein in the another printing device setting step, another printing device is set to the setting position of the member corresponding to the exchanging position.

81. A testing method according to claims 78 or 79, wherein the printing device, which has been set to the setting position in the printing device setting step, is held.

82. A testing method according to claim 81, wherein in the another printing device setting step, the printing device, which has been held at the setting position, is released from the holding state and then is replaced by the another printing device.

83. A testing method according to claim 82, wherein the printing device is a recording head which discharges an ink droplet by causing a change in state of an ink by energy generated by an energy generation element.

84. A testing method according to claim 83, wherein said energy generation element generates heat energy and causes the change in state of the ink by generating a bubble by the heat energy.

85. A testing method according to any of claims 78–80, wherein the printing device is a recording head which discharges an ink droplet by causing a change in state of an ink by energy generated by an energy generation element.

86. A testing method according to claim 85, wherein said energy generation element generates heat energy, and causes the change in state of the ink by generating a bubble by the heat energy.

87. A testing method according to claim 85, wherein a recovery processing for ink ejection condition of the recording head is carried out prior to recording of the test pattern in the recording step.

88. A testing method according to claim 87, wherein the energy generation element generates heat energy, and causes the change in state of the ink by generating a bubble by the heat energy.

89. A testing method of testing a printing device on the basis of a test pattern recorded on a recording medium by the printing device, said method comprising the steps of:

setting the printing device;

recording the test pattern on the recording medium while the printing device set in the printing device setting step is moved relative to the recording medium;

reading the test pattern recorded on the recording medium while image reading means is moved on a reciprocating basis relative to the recording medium;

releasing the printing device from the setting condition thereof after the test pattern is recorded; and obtaining estimation data for testing of the printing device by effecting a predetermined operation processing of image data read in the reading step.

90. A testing method according to claim 89, wherein in the recording step, the test pattern is recorded while the recording medium is moved with respect to the printing device.

91. A testing method according to claim 89 or 90, wherein in the reading step, the estimation pattern is recorded in such a way that the recording medium is moved with respect to the reading means on a reciprocating basis.

92. A testing method according to claim 89, wherein the recording medium is held on a holding member by means of suction when the estimation pattern is recorded in the recording step.

93. A testing method according to any one of claims 89, 90 and 95, wherein the printing device is a recording head which discharges an ink droplet by causing a change in state of an ink by energy generated by an energy generating element.

94. A testing method according to claim 93, wherein a recovery processing for ink ejection condition of the recording head is carried out prior to recording of the test pattern in the recording step.

95. A testing method according to claim 94, wherein the energy generation element generates heat energy and causes the change in state of the ink by generating a bubble by the heat energy.

96. A testing method according to claim 93, wherein said energy generation element generates heat energy, and causes the change in state of the ink by generating a bubble by the heat energy.

* * * * *

UNITED STATES PATENT AND TRADEMARK OFFICE

CERTIFICATE OF CORRECTION

PATENT NO. : 5,477,244 Page 1 of 3

DATED : December 19, 1995

INVENTOR(S) : Masaru SHIBATA, et al.

It is certified that error appears in the above-indentified patent and that said Letters Patent is hereby corrected as shown below:

Title page,
At [56] References Cited - U.S. PATENT DOCUMENTS:

"Ulinski" should read --Ulinski, Sr. et al.--.

Title page,
At [56] References Cited - FOREIGN PATENT DOCUMENTS:

"162350 9/1983 Japan" should read --58-162350 9/1983 Japan--;

"1130948 5/1989 Japan" should read --1-130948 5/1989 Japan--.

COLUMN 3:

Line 38, "evenness" should read --evenness of dots;--.

COLUMN 9:

Line 3, "r" should be deleted.

UNITED STATES PATENT AND TRADEMARK OFFICE

CERTIFICATE OF CORRECTION

PATENT NO. : 5,477,244

DATED : December 19, 1995

INVENTOR(S) : Masaru SHIBATA, et al.

It is certified that error appears in the above-indentified patent and that said Letters Patent is hereby corrected as shown below:

COLUMN 18:

Line 54, "$\vec{\delta}_m=(\delta_{mx},\delta_{my})$" should read --$\vec{\delta}_m=(\delta_{mx},\delta_{my})$--.

COLUMN 23:

Line 62, "n=b" should read --n=1.--;
Line 63, "1." should be deleted.

COLUMN 25:

Line 37, "st-ate" should read --state--.

COLUMN 26:

Line 43, "Of" should read --of--.

COLUMN 35:

Line 2, "of" should read --of the--.

UNITED STATES PATENT AND TRADEMARK OFFICE

CERTIFICATE OF CORRECTION

PATENT NO. : 5,477,244 Page 3 of 3

DATED : December 19, 1995

INVENTOR(S) : Masaru SHIBATA, et al.

It is certified that error appears in the above-indentified patent and that said Letters Patent is hereby corrected as shown below:

COLUMN 37:

Line 8, "57," should read --59,--;
Line 33, "performing edge" should begin a new paragraph.

COLUMN 40:

Line 23, "estimation" should read --test--;
Line 28, "estimation" should read --test--;
Line 31, "95," should read --92,--.

Signed and Sealed this

Fourth Day of June, 1996

Bruce Lehman

*Attest:*

BRUCE LEHMAN

*Attesting Officer*

*Commissioner of Patents and Trademarks*